US012295419B2

(12) United States Patent
Talbot et al.

(10) Patent No.: US 12,295,419 B2
(45) **Date of Patent: *May 13, 2025**

(54) SMOKING SUBSTITUTE DEVICES AND ASSOCIATED METHODS, SYSTEMS AND APPARATUSES

(71) Applicant: Imperial Tobacco Limited

(72) Inventors: Oliver Talbot, Liverpool (GB); Daniel Fard, Liverpool (GB); Kaikai Liu, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 542 days.

This patent is subject to a terminal disclaimer.

(21) Appl. No.: 17/549,436

(22) Filed: Dec. 13, 2021

(65) Prior Publication Data

US 2022/0095688 A1 Mar. 31, 2022

Related U.S. Application Data

(63) Continuation of application No. PCT/EP2020/066388, filed on Jun. 12, 2020.

(30) Foreign Application Priority Data

Jun. 13, 2019 (EP) ..... 19179899
Jun. 13, 2019 (EP) ..... 19179906
Jun. 13, 2019 (EP) ..... 19179932

(51) Int. Cl.
*A24F 40/51* (2020.01)
*A24F 40/53* (2020.01)
*A24F 40/90* (2020.01)

(52) U.S. Cl.
CPC ..... *A24F 40/51* (2020.01); *A24F 40/53* (2020.01); *A24F 40/90* (2020.01)

(58) Field of Classification Search
CPC ..... A24F 40/10; A24F 40/40; A24F 40/50; A24F 40/51; A24F 40/53; A24F 40/90
See application file for complete search history.

(56) References Cited

U.S. PATENT DOCUMENTS 10,159,279 B2 * 12/2018 Lord ..... H05B 1/0202
11,116,254 B2 * 9/2021 Lord ..... H05B 1/0202
(Continued)

FOREIGN PATENT DOCUMENTS

CA 3 037 654 A1 8/2018
CN 109198726 A 1/2019
(Continued)

OTHER PUBLICATIONS

International Search Report and Written Opinion (PCT/EP2020/066388), dated Jul. 2, 2020.
(Continued)

*Primary Examiner* — Abdullah A Riyami
*Assistant Examiner* — Thang H Nguyen
(74) *Attorney, Agent, or Firm* — DUNLAP CODDING, P.C.

(57) ABSTRACT

A smoking substitute device is provided comprising a body housing a power source, an auxiliary component, and an airflow sensor for detecting airflow through the body. The body includes a coupling portion arranged to receive a consumable and is selectively operable in a shipping mode and an active mode. In the active mode, the power source is configured to supply power to the auxiliary component. In the shipping mode, the power source is restricted from supplying power to the auxiliary component. The body is configured to transition from the shipping mode to the active mode upon detection of a consumable being received in the coupling portion and a flow of air through the body.

15 Claims, 13 Drawing Sheets

(56) References Cited

U.S. PATENT DOCUMENTS

| | | | | |
|---|---|---|---|---|
| 11,752,284 | B2 * | 9/2023 | Dickens | H05B 1/0297 131/328 |
| 2010/0188238 | A1 | 7/2010 | Yasuda et al. | |
| 2010/0242974 | A1 | 9/2010 | Pan | |
| 2015/0128975 | A1 * | 5/2015 | Alarcon | H02J 7/0048 131/329 |
| 2015/0272223 | A1 | 10/2015 | Weigensberg et al. | |
| 2016/0316821 | A1 | 11/2016 | Liu | |
| 2017/0013879 | A1 | 1/2017 | Frisbee et al. | |
| 2017/0143043 | A1 | 5/2017 | Liu | |
| 2017/0245551 | A1 | 8/2017 | Reevell | |
| 2017/0245552 | A1 | 8/2017 | Reevell | |
| 2017/0245553 | A1 | 8/2017 | Reevell | |
| 2018/0177238 | A1 | 6/2018 | Bessant et al. | |
| 2018/0184711 | A1 | 7/2018 | Dickens et al. | |
| 2018/0242644 | A1 | 8/2018 | Bessant et al. | |
| 2018/0292250 | A1 | 10/2018 | Colotte et al. | |
| 2019/0089180 | A1 | 3/2019 | Sur | |
| 2019/0295304 | A1 * | 9/2019 | Janardhan | G06T 13/205 |
| 2020/0237004 | A1 * | 7/2020 | Larsen | A24F 40/20 |
| 2021/0227890 | A1 * | 7/2021 | Li | A24F 40/42 |

FOREIGN PATENT DOCUMENTS

| | | | | |
|---|---|---|---|---|
| DE | 202013010986 | U1 | 2/2014 | |
| EP | 3 054 798 | A2 | 8/2016 | |
| EP | 3 155 907 | A1 | 4/2017 | |
| EP | 3 536 176 | A1 | 9/2019 | |
| WO | WO-2013138384 | A2 * | 9/2013 | A24F 47/008 |
| WO | WO 2014/144678 | A2 | 9/2014 | |
| WO | WO 2018/037207 | A1 | 3/2018 | |
| WO | WO 2018/184861 | A1 | 10/2018 | |

OTHER PUBLICATIONS

European Search Report (19179899.0-1202), dated Dec. 19, 2019.
European Search Report (19179906.3-1022), dated Dec. 20, 2019.
European Search Report (19179932.9-1202), dated Dec. 17, 2019.

* cited by examiner

SMOKING SUBSTITUTE DEVICES AND ASSOCIATED METHODS, SYSTEMS AND APPARATUSES

CROSS REFERENCE TO RELATED APPLICATIONS/INCORPORATION BY REFERENCE STATEMENT

This application is a non-provisional application claiming benefit to the international application number PCT/EP2020/066388 filed on Jun. 12, 2020, which claims priority to EP19179932.9 filed Jun. 13, 2019; EP19179906.3 filed Jun. 13, 2019; and EP19179899.0 filed Jun. 13, 2019. The entire contents of each of the above-referenced applications are hereby incorporated herein by reference in their entirety.

The contents and elements of these application are herein incorporated by reference for all purposes.

The following description is divided into multiple parts (A-C). A skilled person would appreciate that the statements and features described in each of these parts may be combined together in any combination, except where such a combination is clearly impermissible or expressly avoided.

PART A (P01021EP)

Technical Field

The present disclosure relates to smoking substitute devices. In particular, although not exclusively, it relates to the management of power supply to components of smoking substitute devices.

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Conventional combustible smoking articles, such as cigarettes, typically comprise a cylindrical rod of tobacco comprising shreds of tobacco which is surrounded by a wrapper, and usually also a cylindrical filter axially aligned in an abutting relationship with the wrapped tobacco rod. The filter typically comprises a filtration material which is circumscribed by a plug wrap. The wrapped tobacco rod and the filter are joined together by a wrapped band of tipping paper that circumscribes the entire length of the filter and an adjacent portion of the wrapped tobacco rod. A conventional cigarette of this type is used by lighting the end opposite to the filter, and burning the tobacco rod. The smoker receives mainstream smoke into their mouth by drawing on the mouth end or filter end of the cigarette.

Combustion of organic material such as tobacco is known to produce tar and other potentially harmful by-products. There have been proposed various smoking substitute devices in order to avoid the smoking of tobacco.

Such smoking substitute devices can form part of nicotine replacement therapies aimed at people who wish to stop smoking and overcome a dependence on nicotine.

Smoking substitute devices may comprise electronic systems that permit a user to simulate the act of smoking by producing an aerosol (also referred to as a "vapor") that is drawn into the lungs through the mouth (inhaled) and then exhaled. The inhaled aerosol typically bears nicotine and/or flavorings without, or with fewer of, the odor and health risks associated with traditional smoking.

In general, smoking substitute devices are intended to provide a substitute for the rituals of smoking, whilst providing the user with a similar experience and satisfaction to those experienced with traditional smoking and tobacco products. Some smoking substitute systems use smoking substitute articles (also referred to as a "consumables") that are designed to resemble a traditional cigarette and are cylindrical in form with a mouthpiece at one end.

The popularity and use of smoking substitute devices have grown rapidly in the past few years. Although originally marketed as an aid to assist habitual smokers wishing to quit tobacco smoking, consumers are increasingly viewing smoking substitute devices as desirable lifestyle accessories. Some smoking substitute devices are designed to resemble a traditional cigarette and are cylindrical in form with a mouthpiece at one end. Other smoking substitute devices do not generally resemble a cigarette (for example, the smoking substitute device may have a generally box-like form).

There are a number of different categories of smoking substitute devices, each utilizing a different smoking substitute approach. A smoking substitute approach corresponds to the manner in which the substitute system operates for a user.

One approach for a smoking substitute device is the so-called "vaping" approach, in which a vaporizable liquid, typically referred to (and referred to herein) as "e-liquid", is heated by a heating device to produce an aerosol vapor which is inhaled by a user. An e-liquid typically includes a base liquid as well as nicotine and/or flavorings. The resulting vapor therefore typically contains nicotine and/or flavorings. The base liquid may include propylene glycol and/or vegetable glycerin.

A typical vaping smoking substitute device includes a mouthpiece, a power source (typically a battery), a tank for containing e-liquid, as well as a heating device. In use, electrical energy is supplied from the power source to the heating device, which heats the e-liquid to produce an aerosol (or "vapor") which is inhaled by a user through the mouthpiece.

Vaping smoking substitute devices can be configured in a variety of ways. For example, there are "closed system" vaping smoking substitute devices which typically have a sealed tank and heating element which is pre-filled with e-liquid and is not intended to be refilled by an end user. One subset of closed system vaping smoking substitute devices include a main body which includes the power source, wherein the main body is configured to be physically and electrically coupled to a consumable including the tank and the heating element. In this way, when the tank of a consumable has been emptied, the main body can be reused by connecting it to a new consumable. Another subset of closed system vaping smoking substitute devices are completely disposable, and intended for one-use only.

There are also "open system" vaping smoking substitute devices which typically have a tank that is configured to be refilled by a user, so the device can be used multiple times.

An example vaping smoking substitute device is the Myblu™ e-cigarette. The Myblu™ e-cigarette is a closed system device which includes a main body and a consumable. The main body and consumable are physically and electrically coupled together by pushing the consumable into the main body. The main body includes a rechargeable battery. The consumable includes a mouthpiece, a sealed tank which contains e-liquid, as well as a heating device, which for this device is a heating filament coiled around a portion of a wick which is partially immersed in the e-liquid. The device is activated when a microprocessor on board the main body detects a user inhaling through the mouthpiece. When the device is activated, electrical energy is supplied from the power source to the heating device, which heats e-liquid from the tank to produce a vapor which is inhaled by a user through the mouthpiece.

Another example vaping smoking substitute device is the blu PRO™ e-cigarette. The blu PRO™ e-cigarette is an open system device which includes a main body, a (refillable) tank, and a mouthpiece. The main body and tank are physically and electrically coupled together by screwing one to the other. The mouthpiece and refillable tank are physically coupled together by screwing one of the other, and detaching the mouthpiece from the refillable tank allows the tank to be refilled with e-liquid. The device is activated by a button on the main body. When the device is activated, electrical energy is supplied from the power source to a heating device, which heats e-liquid from the tank to produce a vapor which is inhaled by a user through the mouthpiece.

Another approach for a smoking substitute system is the so-called Heated Tobacco ("HT") approach in which tobacco (rather than an "e-liquid") is heated or warmed to release vapor. HT is also known as "heat not burn" ("HNB"). The tobacco may be leaf tobacco or reconstituted tobacco. The vapor may contain nicotine and/or flavorings. In the HT approach the intention is that the tobacco is heated but not burned, i.e., the tobacco does not undergo combustion.

A typical HT smoking substitute system may include a device and a consumable. The consumable may include the tobacco material. The device and consumable may be configured to be physically coupled together. In use, heat may be imparted to the tobacco material by a heating element of the device, wherein airflow through the tobacco material causes components in the tobacco material to be released as vapor. A vapor may also be formed from a carrier in the tobacco material (this carrier may for example include propylene glycol and/or vegetable glycerin) and additionally volatile compounds released from the tobacco. The released vapor may be entrained in the airflow drawn through the tobacco.

As the vapor passes through the consumable (entrained in the airflow) from the location of vaporization to an outlet of the consumable (e.g., a mouthpiece), the vapor cools and condenses to form an aerosol for inhalation by the user. The aerosol will normally contain the volatile compounds.

In HT smoking substitute systems, heating as opposed to burning the tobacco material is believed to cause fewer, or smaller quantities, of the more harmful compounds ordinarily produced during smoking. Consequently, the HT approach may reduce the odor and/or health risks that can arise through the burning, combustion and pyrolytic degradation of tobacco.

There may be a need for improved design of smoking substitute systems, in particular HT smoking substitute systems, to enhance the user experience and improve the function of the HT smoking substitute system.

An example of the HT approach is the IQOS™ smoking substitute device from Philip Morris Ltd. The IQOS™ smoking substitute device uses a consumable, including reconstituted tobacco located in a wrapper. The consumable includes a holder incorporating a mouthpiece. The consumable may be inserted into a main body that includes a heating device. The heating device has a thermally conductive heating knife which penetrates the reconstituted tobacco of the consumable, when the consumable is inserted into the heating device. Activation of the heating device heats the heating element (in this case a heating knife), which, in turn, heats the tobacco in the consumable. The heating of the tobacco causes it to release nicotine vapor and flavorings which may be drawn through the mouthpiece by the user through inhalation.

A second example of the HT approach is the device known as "Glo"™ from British American Tobacco p.l.c. Glo™ comprises a relatively thin consumable. The consumable includes leaf tobacco which is heated by a heating device located in a main body. When the consumable is placed in the main body, the tobacco is surrounded by a heating element of the heating device. Activation of the heating device heats the heating element, which, in turn, heats the tobacco in the consumable. The heating of the tobacco causes it to release nicotine vapor and flavorings which may be drawn through the consumable by the user through inhalation. The tobacco, when heated by the heating device, is configured to produce vapor when heated rather than when burned (as in a smoking apparatus, e.g., a cigarette). The tobacco may contain high levels of aerosol formers (carrier), such as vegetable glycerine ("VG") or propylene glycol ("PG").

The present inventor(s) have observed that most smoking substitute devices currently on the market are configured to operate in isolation of other devices, which limits the functions the smoking substitute devices can perform.

The present inventor(s) have observed that smoking substitute devices require intelligent management, to prevent wasting power when they are not in active use, for example during transportation.

The present disclosure has been devised in light of the above considerations.

SUMMARY OF THE DISCLOSURE

At its most general, the present disclosure provides a device and method that enable intelligent, sophisticated control of a smoking substitute device and ensure that power is not used unnecessarily, when the device is not in active use, or when certain functions are not required. The smoking substitute device can be configured so that it enters a shipping mode, in which it can restrict power supply to one or more auxiliary components within the device, in order to prevent power being used by them at a time at which a user will not require them. The restriction may comprise limiting the power supply to the auxiliary component or entirely preventing it. The device may be configured to transition from a shipping mode to an active mode, when it detects that the user wishes to use the device, or that the user has otherwise performed an action or combination of actions (e.g., a predetermined combination of actions) to indicate that the device should enter an active mode.

The smoking substitute device may be configured to distinguish between a time at which no inhalations are being detected because, for example, the device is in transport—for example, after manufacture and testing and before first purchase or first use of the device by a user—and a time at which because the device is owned/possessed by a user, but no inhalations are being detected due to the user's usage choices.

The smoking substitute device may be configured to require detection of more than one action or condition, for it to transition to active mode. For example, it may require detection of an inhale and activation of another sensor or detector, for example the detection of a valid resistance coil being coupled to the main body of the device, which is indicative that a consumable has been inserted into the device. By requiring this double layer of detection, the device helps to avoid a false transition out of shipping mode. Therefore, power conservation is improved.

According to one aspect of the disclosure, there is provided smoking substitute device comprising a body housing a power source, an auxiliary component, and an airflow sensor for detecting airflow through the body. The body includes a coupling portion arranged to receive a consumable. The body is selectively operable in a shipping mode and an active mode. In the active mode, the power source is configured to supply power to the auxiliary component. In the shipping mode, the power source is restricted from supplying power to the auxiliary component. The body(/smoking substitute device) is configured to transition from the shipping mode to the active mode upon detection of at least two of: a consumable received in the coupling portion; a flow of air through the body; connection of a charging interface to the smoking substitute device.

In some embodiments, the body(/smoking substitute device) may be configured to transition from the shipping mode to the active mode upon detection of: a consumable received in the coupling portion; and a flow of air through the body.

In some embodiments, the smoking substitute device(/body) may be configured so that it will only transition from the shipping mode to the active mode if it detects at least two of: a consumable received in the coupling portion; a flow of air through the body; connection of a charging interface to the smoking substitute device. In other embodiments, there may be additional combinations of actions that will cause the smoking substitute device(/body) to transition from the shipping mode to the active mode.

In some embodiments, the smoking substitute device(/body) may be configured so that it will only transition from the shipping mode to the active mode if it detects both a consumable received in the coupling portion and a flow of air through the body. In other embodiments, there may be additional combinations of actions that will cause the smoking substitute device(/body) to transition from the shipping mode to the active mode.

The smoking substitute device may be configured so that the power source is also restricted from supplying power to a heating element within the device, when it is in shipping mode, to prevent or restrict smoking substitute action. For example, in embodiments in which the consumable includes a heating element, the smoking substitute device may be configured so that the power source is restricted from supplying power to the consumable, as well as to the auxiliary component, when it is in shipping mode.

The coupling portion may be configured to electrically couple with the consumable. For example, the coupling portion of the body may comprise an electrical interface for electrically connecting to an electrical interface of a consumable. For example, the electrical interface may comprise a pair of electrical contacts. The body may be configured to monitor an electrical property the coupling portion to detect whether or not a consumable is received in the coupling portion. For example, the body may be configured to determine that the body is electrically coupled with a consumable by detecting a change in any of current or voltage or resistance at the electrical interface.

The coupling portion may be configured to mechanically couple with the consumable. Any suitable mechanical coupling may be employed, for example an interference fit, a screw fit, a snap fit, a bayonet fit, a push fit, or an interlocking fit.

When the body is in the shipping mode, the power supply from the power source to the auxiliary component may be prevented. Alternatively, when the body is in the shipping mode, the power supply from the power source to the auxiliary component may be restricted or limited. For example, the body may be configured to supply power to the auxiliary component at a restricted low level when the body is in shipping mode. Alternatively, or additionally, the body may be configured to supply power to the auxiliary component for a restricted period of time after the body has entered shipping mode.

The auxiliary component may comprise any suitable component, within a smoking substitute device, the function or purpose of which is auxiliary, or additional, to the device's core function of heating a liquid or tobacco for smoking substitute action. For example, the auxiliary component may comprise a communications interface such as a wireless interface, for example a Wi-Fi or Bluetooth™ interface. For example, the auxiliary component may comprise a position or orientation sensor such as an accelerometer, a magnetometer or a gyroscope. For example, the auxiliary component may comprise a user interface such as an LED screen, light or audio emitter. For example, the auxiliary component may comprise a data reader such as a bar code reader, for example for reading data from a consumable inserted into the smoking substitute device.

The airflow sensor may be positioned in an airflow channel extending through the body of the smoking substitute device. The smoking substitute device may be provided with or without a button or a switch, for activating its operation. Therefore, it may not require a dedicated user input component (e.g., actuation of a button or switch) in order to switch the device on. Instead, it may rely on the detection of an inhale by the airflow sensor, preferably in combination with another detection such as the detection of a consumable being received in the coupling portion, in order to activate operation of the device for a smoking substitute action.

The smoking substitute device may be configured to transition from the active mode to the shipping mode if the airflow sensor does not detect a flow of air through the body for a predetermined period of time.

The smoking substitute device may include a charging port. The charging port may be located on the body. The connection of a charging interface to the smoking substitute device may be detected upon the charging interface (e.g., inserted into or otherwise physically connected) being physically connected to the charging port. The connection of a charging interface to the smoking substitute device may be detected upon the charging interface supplying power to the smoking substitute device via the charging port.

The charging interface may, for example, be a cable (e.g., a USB cable, in which case the charging port may be a USB port) or a charging station (e.g., a docking station).

The smoking substitute device may be configured to detect whether a consumable is received in the coupling portion and, in accordance with that detection, either transition from the active mode to the shipping mode after a first predetermined period of time, if it has detected that a consumable is received in the coupling portion and if the airflow sensor does not detect a flow of air through the main body; or to transition from the active mode to the shipping mode after a second, different predetermined period of time, if it has detected that a consumable is not received in the coupling portion and if the airflow sensor does not detect a flow of air through the main body. The first time period may be longer than the second time period.

Therefore, the time period for which the device allows itself to remain "active", in the absence of an inhalation, may vary dependent on whether or not a consumable is currently inserted in the device. Thus, the device may be configured to use its determination as to whether or not there is a consumable inserted as an indicator of whether or not it is likely that the user intends to use the device again in the short to medium term, and therefore as a determining factor in how long it will wait before transitioning to shipping mode. This also reflects the widely accepted practice of shipping smoking substitute devices, after manufacture and testing, without consumables inserted therein. Therefore, if a smoking substitute device has been in an active mode during testing, once it is packaged up without a consumable, for transportation to a retailer or end user, it may relatively quickly determine that it does not need to be in active mode, and therefore transition to shipping mode.

The active mode of the smoking substitute device may include different sub-modes. For example, it may comprise a first sub-mode, which may be referred to as a "use mode" in which, when the body is in active mode, power can be supplied to the consumable. In particular, if the device is in the use mode, power may be supplied to a heating device in the consumable, to enable liquid or tobacco to be heated for smoking substitute action. For example, the active mode may comprise a second sub-mode, which may be referred to as a "standby mode" in which power is supplied to the auxiliary device but not to the consumable. In such a configuration, the device would therefore not enable liquid or tobacco to be heated for smoking substitute action, when it is in standby mode.

The smoking substitute device may be configured to transition from use mode to standby mode, if the airflow sensor has not detected an inhale, i.e., an airflow through the body, for a pre-determined first period of time. The smoking substitute device may further be configured to transition from standby mode to shipping mode if the airflow sensor has still not detected an inhale after a pre-determined second (additional) amount of time.

The smoking substitute device may be configured to transition from use mode to standby mode if certain operating conditions are met, for example if it is determined that the battery level in the device is running too low to operate both the auxiliary component and the heating device within the consumable.

The smoking substitute device may be configured so that, if it is detected that a consumable is received within the coupling portion of the body of the device, it can transition from use mode to standby mode, if no inhalations have been detected for a predetermined amount of time, but that it should not transition from use mode or standby mode to shipping mode unless it is detected that there is also no consumable received in the coupling portion of the body of the device. Optionally, the device may be configured so that it requires no inhalations to have been detected for a first predetermined amount of time and no consumable to be received in the coupling portion of the body of the device for a second predetermined amount of time (wherein the first and second predetermined amounts of time may be different), before it is allowed to transition from standby mode or use mode (or any other active sub-mode) to shipping mode.

Thus, the device can save power by restricting power to the consumable (and to its heating device) when the device is not being actively used for smoking substitute action, but it can maintain operation of the auxiliary component(s), for example for telemetry or for position/orientation sensing, whilst there is a consumable inserted in the device, since this may be taken as an indicator that the user still intends to use the device again in the short to medium term. The device may also provide a grace period during which it is permissible not to have a consumable received in the device—for example when the user is changing his or her consumable—before the device will transition to shipping mode, in which power to the auxiliary component is restricted.

The device may be configured so that the transition from an active mode to a shipping mode, and/or the transition from a use active sub-mode to a standby active sub-mode, follows different rules for different respective auxiliary components. For example, the device may be configured so that, when the auxiliary component is a position sensor such as an accelerometer, the device can transition from a use sub-mode to a standby sub-mode if no inhalations have been detected for a pre-determined amount of time, regardless of whether a consumable is currently received in the coupling portion of the device. For example, the device may be configured so that when the auxiliary component is a wireless interface, for example a wireless interface configured to communicate with a wireless interface of a mobile device that has an application running on it for managing the smoking substitute device, the device will not transition from a use sub-mode to a standby sub-mode even if no inhalations have been detected for a pre-determined amount of time, if there is a consumable currently received in the coupling portion of the device.

The smoking substitute device may comprise a control unit. It may be comprised within the body of the device. The control unit may be configured to manage signals received from one or more detectors or sensors, and for determining action on the basis of those received signals. The control unit may, for example, receive signals from the airflow sensor and/or from the coupling portion, for example an electrical interface within the coupling portion. The control unit may be further configured to issue instructions to control the supply of power to the auxiliary component and/or to the consumable based on the received sensor/detector signals. For example, it may be configured to only permit power to be supplied to the auxiliary component if it has received positive signals from both the airflow sensor and from the coupling portion to indicate both that an inhalation action has been made and that a consumable is currently received in the coupling portion.

The control unit may also be configured to record, in the memory, information relating to operational aspects or other aspects of the smoking substitute device. For example, for a network enabled smoking substitute device that includes a telemetry means such as a wireless interface, the control unit may be configured to record telemetry data in a memory. For example, for a smoking substitute device that includes a consumable data reader, the control unit may also be configured to record consumable data, read from a consumable inserted into the body of the smoking substitute device, in the memory. Other components of the smoking substitute device may also be configured to transfer data to a memory.

The smoking substitute device may be network-enabled. It may comprise a wireless interface for communication with the wireless interface of another device such as a mobile device, smart phone, mobile phone, laptop or tablet computer, television or gaming device. The smoking substitute may be configured so that aspects of its operation can be managed, monitored or controlled via an application running on another device, with which it communicates wirelessly.

The transition condition that triggering transitioning from the shipping mode to the active mode may use various criteria. To prevent false triggering it is desirable to use criteria from a plurality of different sources, e.g., any two or more of airflow, electrical property of interface, motion sensor, wireless connectivity, etc. According to another aspect of the disclosure, there is provided a smoking substitute device comprising a body housing a power source, an auxiliary component, and an airflow sensor for detecting airflow through the body. The body includes a position sensor and/or an orientation sensor. The body is selectively operable in a shipping mode and an active mode. In the active mode, the power source is configured to supply power to the auxiliary component. In the shipping mode, the power source is restricted from supplying power to the auxiliary component. The body is configured to transition from the shipping mode to the active mode upon detection of a predetermined action, by the position and/or orientation sensor, and a flow of air through the body.

In another aspect of the disclosure, there is provided a computer-implemented method for controlling a smoking substitute device that comprises a body housing a power source, an auxiliary component, and an airflow sensor for detecting airflow through the body, wherein the method comprises: configuring the smoking substitute device in a shipping mode, in which the power source is restricted from supplying power to the auxiliary component; and transitioning from the shipping mode to an active mode upon detection of a transition condition, wherein, in the active mode the power source is configured to supply power to the auxiliary component, wherein the transition condition comprises at least two of: a consumable received in a coupling portion of the body; a flow of air through the body; connection of a charging interface to the smoking substitute device.

The transition condition may comprise: a consumable received in a coupling portion of the body; and a flow of air through the body. In this case, the method may further comprise: detecting, by a control unit in the body, whether or not a consumable is received in the coupling portion; detecting, by the airflow sensor, whether or not there is a flow of air through the body; and upon detection of the transition condition, issuing, by the control unit, a control instruction that causes the body to transition from the shipping mode to the active mode.

In another aspect of the disclosure, there is provided a computer-implemented method for controlling a smoking substitute device that comprises a body housing a power source, an auxiliary component, and an airflow sensor for detecting airflow through the body, wherein the method comprises: configuring the smoking substitute device in an active mode, in which the power source is configured to supply power to the auxiliary component; detecting, by a control unit in the body, whether or not a consumable is received in a coupling portion of the body; upon detecting that a consumable is received in the coupling portion, transitioning from the active mode to a shipping mode if the airflow sensor detects no flow of air through the main body after a first predetermined period of time; and upon detecting that a consumable is not received in the coupling portion, transitioning from the active mode to the shipping mode if the airflow sensor detects no flow of air through the main body after a second predetermined period of time, wherein, in the shipping mode, the power source is restricted from supplying power to the auxiliary component.

In another aspect of the disclosure, there is provided a computer-readable medium containing computer-readable instructions which, when executed by a processor, cause the processor to perform any of the method set out above.

The methods may be implemented or executed by a control unit within a smoking substitute device, such as a microprocessor. Alternatively, or additionally they may be implemented or executed by a separate control means, for example on a mobile device or an application that can wirelessly communicate with the smoking substitute device.

The disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

SUMMARY OF THE FIGURES

Embodiments and experiments illustrating the principles of the disclosure will now be discussed with reference to the accompanying figures in which.

DETAILED DESCRIPTION OF THE DISCLOSURE

Aspects and embodiments of the present disclosure will now be discussed with reference to the accompanying figures. Further aspects and embodiments will be apparent to those skilled in the art. All documents mentioned in this text are incorporated herein by reference.

Figure 1:
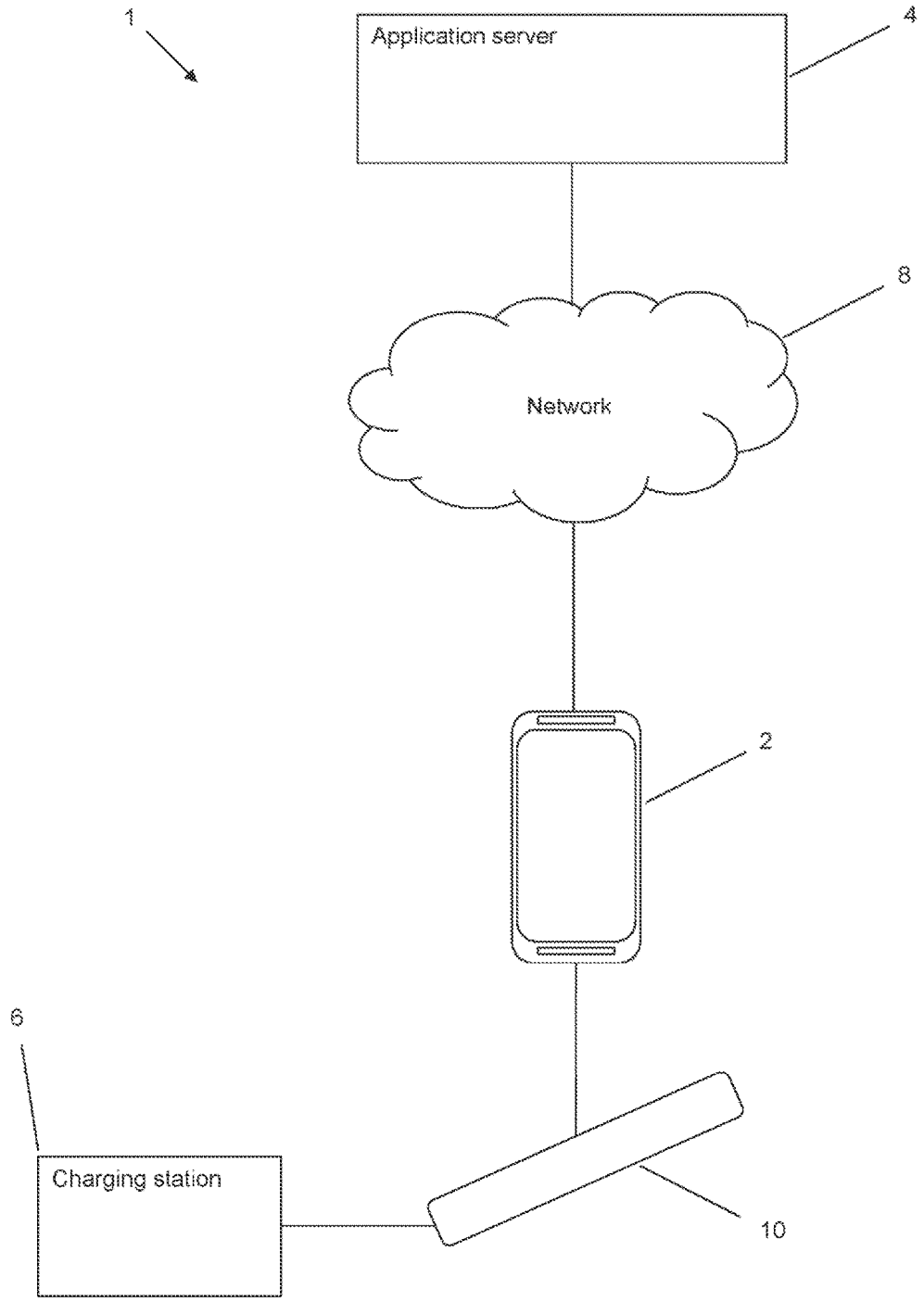
FIG. 1 shows an example system for managing a smoking substitute device.

FIG. 1 shows an example system 1 for managing a smoking substitute device 10.

The system 1 as shown in FIG. 1 includes a mobile device 2, an application server 4, an optional charging station 6, as well as the smoking substitute device 10.

The smoking substitute device 10 is configured to communicate wirelessly, e.g., via Bluetooth™, with an application (or "app") installed on the mobile device 2, e.g., via a suitable wireless interface (not shown) on the mobile device 2. The mobile device 2 may be a mobile phone, for example. The application on the mobile phone is configured to communicate with the application server 4, via a network 8. The application server 4 may utilize cloud storage, for example.

The network 8 may include a cellular network and/or the internet.

A skilled person would readily appreciate that the mobile device 2 may be configured to communicate via the network 8 according to various communication channels, preferably a wireless communication channel such as via a cellular network (e.g., according to a standard protocol, such as 3G or 4G) or via a WiFi network.

The app installed on the mobile device and the application server 4 may be configured to assist a user with their smoking substitute device 10, based on information communicated between the smoking substitute device 10 and the app and/or information communicated between the app and the application server 4.

The charging station 6 (if present) may be configured to charge (and optionally communicate with) the smoking substitute device 10, via a charging port on the smoking substitute device 10. The charging port on the smoking substitute device 10 may be a USB port, for example, which may allow the smoking substitute device to be charged by any USB-compatible device capable of delivering power to the smoking substitute device 10 via a suitable USB cable (in this case the USB-compatible device would be acting as the charging station 6). Alternatively, the charging station could be a docking station specifically configured to dock with the smoking substitute device 10 and charge the smoking substitute device 10 via the charging port on the smoking substitute device 10.

Figure 2A:
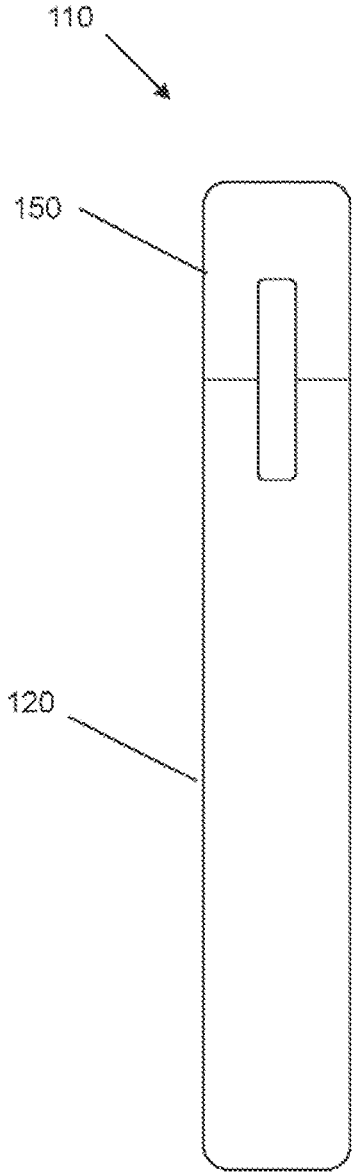
FIG. 2A shows an example smoking substitute device for use as the smoking substitute device in the system of FIG. 1.

FIG. 2A shows an example smoking substitute device 110 for use as the smoking substitute device 10 in the system 1 of FIG. 1.

In this example, the smoking substitute device 110 includes a main body 120 and a consumable 150. The consumable 150 may alternatively be referred to as a "pod".

In this example, the smoking substitute device 110 is a closed system vaping device, wherein the consumable 150 includes a sealed tank 156 and is intended for one-use only.

FIG. 2A shows the smoking substitute device 110 with the main body 120 physically coupled to the consumable 150.

Figure 2B:
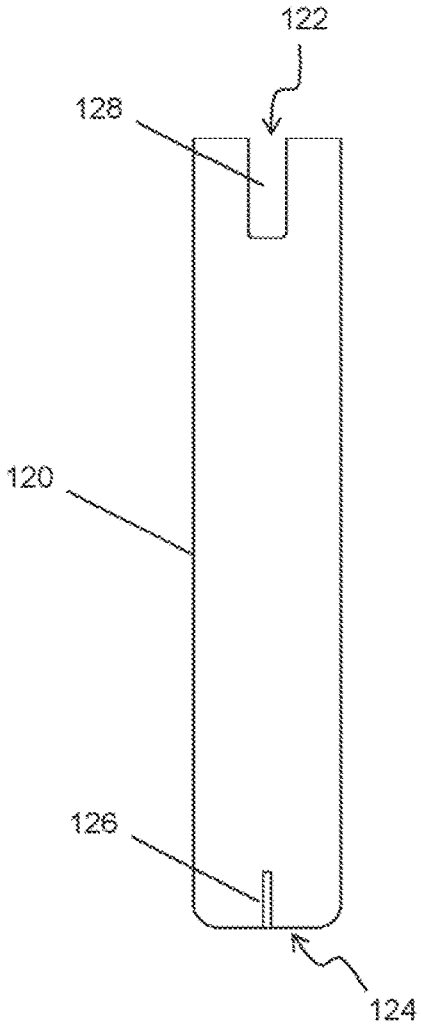
FIG. 2B shows the main body of the smoking substitute device of FIG. 2A without the consumable.

FIG. 2B shows the main body 120 of the smoking substitute device 110 without the consumable 150.

Figure 2C:
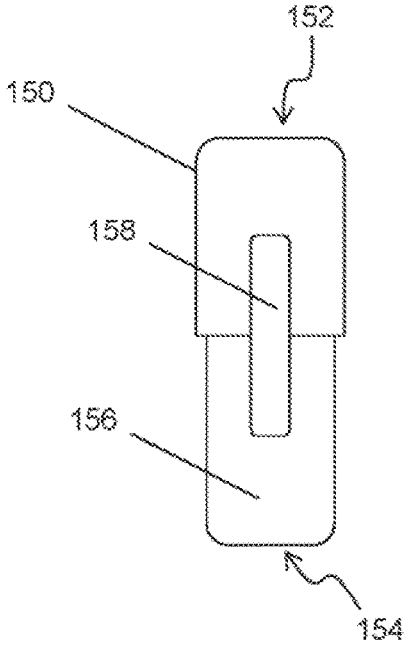
FIG. 2C shows the consumable of the smoking substitute device of FIG. 2A without the main body.

FIG. 2C shows the consumable 150 of the smoking substitute device 110 without the main body 120.

The main body 120 and the consumable 150 are configured to be physically coupled together, in this example by pushing the consumable 150 into a coupling portion of the main body 120. The coupling portion may comprise an aperture in a top end 122 of the main body 120, e.g., with the consumable 150 being retained in the aperture via an interference fit. In other examples, the main body 120 and the consumable could be physically coupled together by screwing one onto the other, through a bayonet fitting, or through a snap engagement mechanism, for example. An optional light 126, e.g., an LED located behind a small translucent cover, is located a bottom end 124 of the main body 120. The light 126 may be configured to illuminate when the smoking substitute device 110 is activated.

The consumable 150 includes a mouthpiece (not shown) at a top end 152 of the consumable 150, as well as one or more air inlets (not shown in FIGS. 2A-2C) so that air can be drawn into the smoking substitute device 110 when a user inhales through the mouthpiece. At a bottom end 154 of the consumable 150, there is located a tank 156 that contains e-liquid. The tank 156 may be a translucent body, for example.

The tank 156 preferably includes a window 158, so that the amount of e-liquid in the tank 156 can be visually assessed. The main body 120 includes a slot 128 so that the window 158 of the consumable 150 can be seen whilst the rest of the tank 156 is obscured from view when the consumable 150 is inserted into the aperture in the top end 122 of the main body 120.

In this present embodiment, the consumable 150 is a "single-use" consumable. That is, upon exhausting the e-liquid in the tank 156, the intention is that the user disposes of the whole consumable 150. In other embodiments, the e-liquid (i.e., aerosol former) may be the only part of the system that is truly "single-use". In such embodiments, the tank 156 may be refillable with e-liquid or the e-liquid may be stored in a non-consumable component of the system. For example, the e-liquid may be stored in a tank located in the device or stored in another component that is itself not single-use (e.g., a refillable tank).

The tank 156 may be referred to as a "clearomizer" if it includes a window 158, or a "cartomizer" if it does not.

Figure 3A:
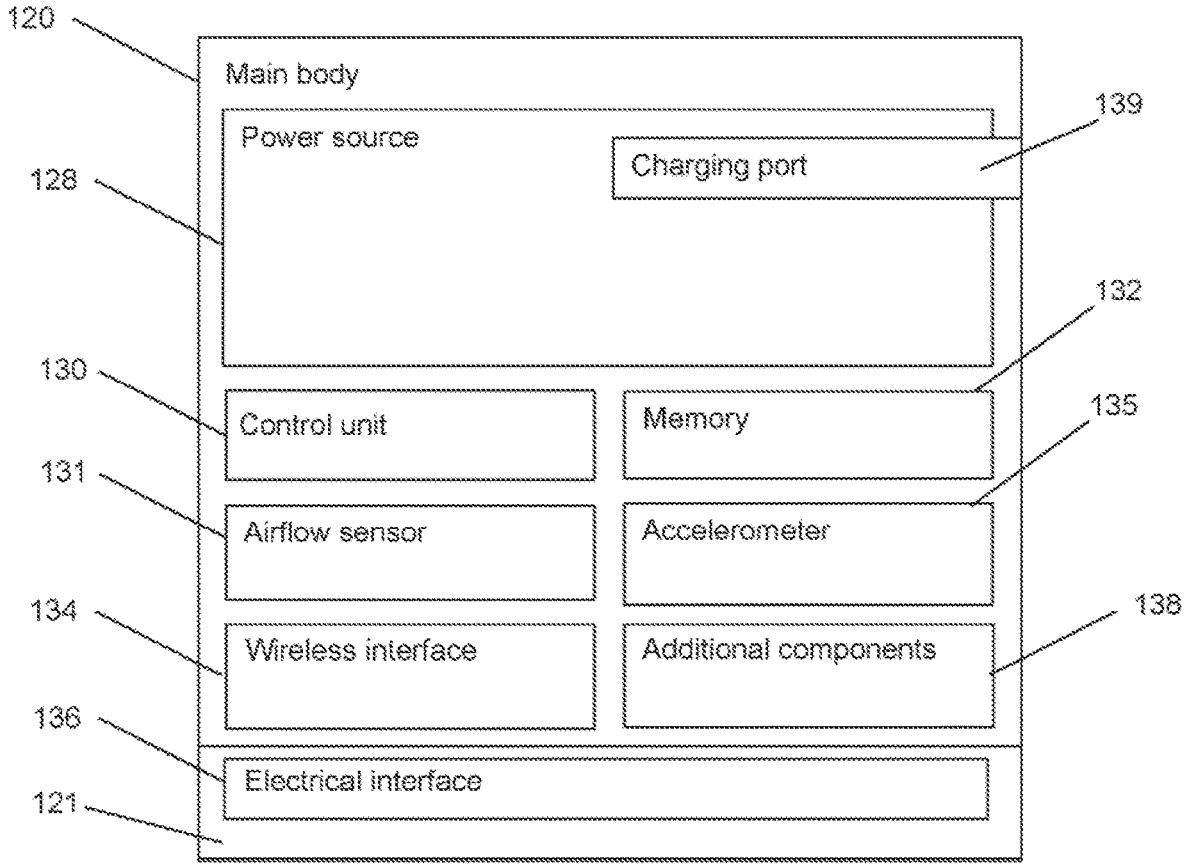
FIG. 3A is a schematic view of the main body of the smoking substitute device of FIG. 2A.

FIG. 3A is a schematic view of the main body 120 of the smoking substitute device 110.

Figure 3B:
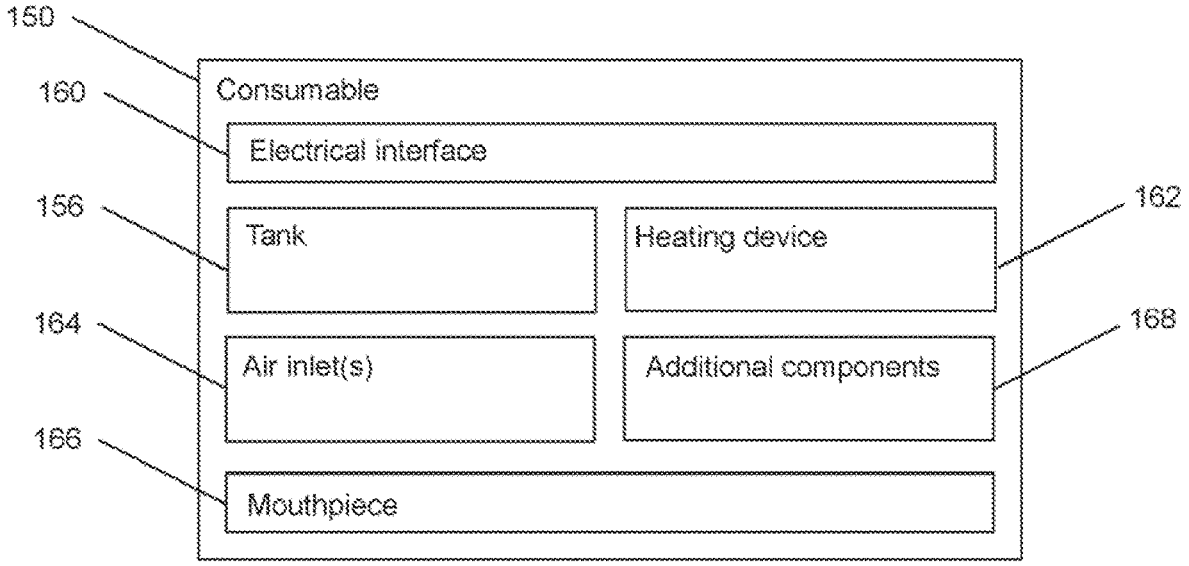
FIG. 3B is a schematic view of the consumable of the smoking substitute device of FIG. 2A.

FIG. 3B is a schematic view of the consumable 150 of the smoking substitute device 110.

As shown in FIG. 3A, the main body 120 includes a power source 128, a control unit 130, an airflow sensor 131, a memory 132, a wireless interface 134, an electrical interface 136, and, optionally, an accelerometer 135 and/or one or more additional components 138. The main body 120 includes one or more auxiliary components, i.e., components that are not essential to the provision of a smoking substitute function. Examples of an auxiliary component include the wireless interface 134, the optional accelerometer 135 or any of the optional additional components, which are discussed below.

The power source 128 is preferably a battery, more preferably a rechargeable battery. A charging port 139 may be provided for connecting the rechargeable battery to an external power source.

The control unit 130 may include a microprocessor, for example.

The memory 132 is preferably includes non-volatile memory.

The wireless interface 134 is preferably configured to communicate wirelessly with the mobile device 2, e.g., via Bluetooth. To this end, the wireless interface 134 could include a Bluetooth™ antenna. Other wireless communication interfaces, e.g., WiFi, are also possible.

The accelerometer 135 may function as a motion sensor to receive inputs for controlling the device.

The main body 120 comprises a coupling portion 121 that includes the electrical interface 136. The electrical interface 136 may include one or more electrical contacts. The electrical interface 136 may be located in, and preferably at the bottom of, the aperture in the top end 122 of the main body 120. When the main body 120 is physically coupled to the consumable 150, the electrical interface 136 may be configured to pass electrical power from the power source 128 to (e.g., a heating device of) the consumable 150 when the smoking substitute device 110 is activated, e.g., via the electrical interface 160 of the consumable 150 (discussed below). As an alternative to the charging port 139, the electrical interface may be configured to receive power from the charging station 6 when the main body 120 is not physically coupled to the consumable 150.

The additional components 138 of the main body 120 may include the optional light 126 discussed above.

The additional components 138 of the main body 120 may, if the power source 128 is a rechargeable battery, include a charging port configured to receive power from the charging station 6. This may be located at the bottom end 124 of the main body 120. Alternatively, the electrical interface 136 discussed above is configured to act as a charging port configured to receive power from the charging station 6 such that a separate charging port is not required.

The additional components 138 of the main body 120 may, if the power source 128 is a rechargeable battery, include a battery charging control circuit, for controlling the charging of the rechargeable battery. However, a battery charging control circuit could equally be located in the charging station 6 (if present).

The airflow sensor 131 is configured to detecting airflow in the smoking substitute device 110, e.g., caused by a user inhaling through a mouthpiece 166 (discussed below) of the smoking substitute device 110. The smoking substitute device 110 may be configured to be activated when airflow is detected by the airflow sensor.

The additional components 138 of the main body 120 may include an actuator, e.g., a button. The smoking substitute device 110 may be configured to be activated when the actuator is actuated. This provides an alternative to the airflow sensor noted, as a mechanism for activating the smoking substitute device 110.

The additional components 138 of the main body 120 may include a reader configured to read information associated with the consumable from a machine readable data source included in (e.g., contained in the body of, or attached to) the consumable 150.

The reader may be configured to read information from the machine readable data source wirelessly, e.g., via electromagnetic waves or optically. Thus, for example, the machine readable data source included in the consumable 150 could be an RFID tag (in which case the reader included in the main body 120 may be an RFID reader) or a visual data source such as a barcode (in which case the reader included in the main body may be an optical reader, e.g., a barcode scanner). Various wireless technologies and protocols may be employed to allow the reader to wirelessly read information from a machine readable data source included in or attached to the consumable 150, e.g., NFC, Bluetooth, Wi-Fi, as would be appreciated by a skilled person.

For avoidance of any doubt, the reader (if present) may be configured to read information from the machine readable data source non-wirelessly, e.g., using a direct electrical connection between the main body 120 and consumable 150.

As shown in FIG. 3B, the consumable 150 includes the tank 156, an electrical interface 160, a heating device 162, one or more air inlets 164, a mouthpiece 166, and, optionally, one or more additional components 168.

The electrical interface 160 of the consumable 150 may include one or more electrical contacts. The electrical interface 136 of the main body 120 and an electrical interface 160 of the consumable 150 are preferably configured to contact each other and therefore electrically couple the main body 120 to the consumable 150 when the main body 120 is physically coupled to the consumable 150. In this way, electrical energy (e.g., in the form of an electrical current) is able to be supplied from the power source 128 in the main body 120 to the heating device 162 in the consumable 150.

The heating device 162 is preferably configured to heat e-liquid contained in the tank 156, e.g., using electrical energy supplied from the power source 128. In one example, the heating device 162 may include a heating filament and a wick, wherein a first portion of the wick extends into the tank 156 in order to draw e-liquid out from the tank 156, and wherein the heating filament coils around a second portion of the wick located outside the tank 156. In this example, the heating filament is configured to heat up e-liquid drawn out of the tank 156 by the wick to produce an aerosol vapor.

The one or more air inlets 164 are preferably configured to allow air to be drawn into the smoking substitute device 110, when a user inhales through the mouthpiece 166.

The additional components 168 of the consumable 150 may include a machine readable data source, which may e.g., be contained in the body of, or attached to the consumable 150. The machine readable data source may store information associated with the consumable. The information associated with the consumable may include information concerning the content of the consumable (e.g., e-liquid type, batch number) and/or a unique identifier, for example.

The machine readable data source may be rewritable, e.g., a rewritable RFID chip, or read only, e.g., a visual data source such as a barcode. As indicated above, the additional components 138 of the main body 120 may include a reader configured to read information associated with the consumable from the machine readable data source.

In use, a user activates the smoking substitute device 110, e.g., through actuating an actuator included in the main body 120 or by inhaling through the mouthpiece 166 as described above. Upon activation, the control unit 130 may supply electrical energy from the power source 128 to the heating device 162 (via electrical interfaces 136, 166), which may cause the heating device 162 to heat e-liquid drawn from the tank 156 to produce a vapor which is inhaled by a user through the mouthpiece 166.

Of course, a skilled reader would readily appreciate that the smoking substitute device 110 shown in FIGS. 2A-2C and 3A-3B shows just one example implementation of a smoking substitute device, and that other forms of smoking substitute device could be used as the smoking substitute device 10 of FIG. 1.

By way of example, a HNB smoking substitute device including a main body and a consumable could be used as the smoking substitute device 10 of FIG. 1, instead of the smoking substitute device 110. One such HNB smoking substitute device is the IQOS™ smoking substitute device discussed above.

Embodiments of the present disclosure relate to the transition of a smoking substitute device of the type discussed above from a shipping mode to an active mode, upon detection of a predetermined set of conditions being fulfilled. The predetermined set of conditions should comprise the positive detection of at least two things—for example, an inhalation event detected by airflow sensor 131 in addition to the presence of a consumable 150 received in the main body 120.

In an embodiment, the main body may be configured to detect when the electrical interface 136 within the main body is electrically coupled with a compatible electrical interface 160 of a consumable 150. The detection functionality may be provided by a suitable detection unit, e.g., sensor, that is sensitive to an electrical property at the electrical interface 136. The detection unit may be a self-contained part of the coupling portion 121, or may be configured to send a signal indicative of the electrical property to the control unit 130. Thus, the detection unit may comprise circuitry configured to communicate electrical signals to the control unit 130, in order to detect a change in any of current, voltage or resistance at the electrical interface 136. The control unit 130 may be configured to determine, based on a signal from the detection unit, whether or not a consumable 150 is received in the coupling portion 121.

In one example, the control unit 130 may be configured to detect a resistance at the electrical interface 136. The resistance may vary depending on whether or not a predetermined type or size or configuration of electrical component, such as a resistance coil, is present (i.e., connected) to the electrical interface 136.

The airflow sensor 131 is configured for detecting an airflow in the main body 120, e.g., caused by a user inhaling through a mouthpiece (which may be comprised within a consumable). When operating in an active mode, the main body 120 is configured to transfer power through the electrical interface when an airflow is detected by the airflow sensor 131.

The airflow sensor 131 may be configured to transmit a detection signal to the control unit, when it detects airflow in the airflow channel. The control unit 130 can then use that detection signal, either in isolation or in combination with other signals or other factors, to control operation of the main body 120.

The control unit 130 may be associate each inhalation event detected by the airflow sensor with a time information. For example, the time information may include a time stamp that indicates when the airflow was initially detected, and/or a time period throughout which an airflow was detected.

When operating in an active mode, the main body 120 is configured to supply power to the consumable 150, in order to activate the heating device 162 to heat the liquid and/or tobacco within the consumable 150, when an inhale action is detected. The control unit 130 may send control instructions to the electrical interface 136, via suitable control circuitry, to instruct it to supply power, from the power source 128, to the electrical interface 160 of the consumable 150, during an inhale action, upon receipt of positive airflow detection signals form the airflow sensor 131. For example, the control instruction from the control unit 130 that power is to be supplied to the consumable 150 initiates the switching on of an electrical switch (not shown) which completes an electrical circuit between the power source 128 and the consumable 160, via the two coupled electrical interfaces 136, 160.

In the active mode, the control unit 130 may permit the switch to be in an ON state, and therefore the heating device 160 to be activated for heating the tobacco and/or liquid, for a short, predetermined period, for example 3 seconds, each time an inhale action is detected. After the predetermined period has ended, the switched is switched off again, breaking the electrical circuit between the power source 128 and the consumable 160, via the two coupled electrical interfaces 136, 160. However in other embodiments the microprocessor may allow the switch to be switched on, and the heating device to be activated, for a different predetermined length of time and/or it may be configured to allow the heating device to be activated for the duration of each inhale, and optionally for a short time interval, after each inhale has ended.

As discussed above, the main body may include one or more auxiliary components. Two auxiliary components are discussed below. The first is wireless interface 134, which may be a Bluetooth™ interface configured to wirelessly communicate with a Bluetooth™ interface of another device (not shown), such as a mobile device (e.g., smartphone). The Bluetooth™ interface can be configured to form a paired or bonded wireless communication link with the mobile device. It can further be configured to transmit data to the other device, and/or to an application running on the other device. The transmitted data may comprise telemetry data, which concerns the wireless communication link itself and activity/operation of the wireless communication link. The transmitted data may also comprise operational data for the smoking substitute device, for example voltage level readouts from the power source 128, which are indicative of remaining battery power or for example position and/or orientation data from the accelerometer (discussed further below), which are indicative of movements or physical actions made using the smoking substitute device. The mobile device and/or the application may be configured to monitor received data from the smoking substitute device and to make calculations or determinations using the received data, and to transmit control signals or notifications to the smoking substitute device, based on the received data. For example, an application may be configured to send the smoking substitute device a notification when it is at low battery level, and possibly to send instructions regarding how various components within the smoking substitute device should be controlled at low battery level.

Therefore, it will be appreciated that operation of the Bluetooth™ interface can prove very useful to a user, even when he or she is not actively using the smoking substitute device for smoking substitute action.

The other auxiliary component in the smoking substitute device according to the present embodiment is an accelerometer 135. An accelerometer is, as the skilled reader will know, an electromechanical device that measures acceleration forces, and provides a measure of "proper acceleration", which is the acceleration of a body or object, relative to free fall. The accelerometer 135 in this embodiment, comprised within the smoking substitute device, is configured to measure dynamic acceleration forces, and so can sense movement or vibrations. The accelerometer 135 is configured to measure acceleration and its outputs may be used to determine position factors and/or orientation factors such as tilt, tilt angle, and incline, as well as being used to determine actions or events such as rotation, vibration and collision.

The accelerometer 135 may be a piezoelectric accelerometer. However other types of accelerometer may be used in a smoking substitute device, such as a capacitance accelerometer. The accelerometer 135 may comprise a three-axis model, to enable it to sense rotational tilt, as well as movement in a two-dimensional plane.

The accelerometer 135 may be configured to detect movement and collisions, and to provide one or more voltage outputs to the control unit 130, as a result of what it has detected. The accelerometer 135 can, for example, detect the action of the smoking substitute device being tapped against (i.e., relatively gently colliding with) a surface. When the user taps the device, the accelerometer 135 transmits a corresponding voltage signal to the control unit 130. The control unit 130 can then control the memory 132 to store (at least temporarily) a measure of the voltage signal, along with an indicator of the time at which it was received. If the smoking substitute device is currently paired with, or bonded to, a mobile device, it may also submit a signal to the mobile device, via the wireless communication link that has been established between them, regarding the detection that the accelerometer 135 has made. This can be very useful as the smoking substitute device may be preconfigured for a tap (or a plurality of taps) to form part of a sequence for the user to convey instructions to the device and/or to the connected mobile device or application.

Therefore, it will be appreciated that operation of the accelerometer 135 can prove very useful to a user, even when he or she is not actively using the smoking substitute device for smoking substitute action.

The present inventors have recognised that it is desirable to control and manage the power supply to auxiliary components within a smoking substitute device, and that is may be particularly useful to manage this control independently of the power supply control to the consumable during normal operation.

Embodiments of the disclosure provide a device and method for controlling the power supply to the auxiliary components of a smoking substitute device, in a reliable and user-controllable manner. In this exemplary embodiment, the auxiliary components comprise an accelerometer 135 and a Bluetooth™ interface 134. However other embodiments may comprise other auxiliary components instead of or as well as these ones. In this exemplary embodiment, the auxiliary components are both treated the same, by the control method. However, in other embodiments, individual auxiliary components, or selected ones or small groups amongst a plurality of auxiliary components, may have their own respective control rules applied thereto.

The smoking substitute device, and the components housed within its main body 120, may be selectively operable in a shipping mode and in an active mode. The shipping mode and the active mode may be mutually exclusive, i.e., the smoking substitute device cannot simultaneously be running in both shipping mode and active mode.

When the device is in the active mode, the power source 128 is configured to supply power to the auxiliary components. Therefore, the auxiliary components operate normally when the device is in the active mode. In some examples, the active mode may comprise a plurality of sub-modes. The sub-modes may permit selective activation of auxiliary components, as discussed in more detail below.

When the smoking substitute device is in the shipping mode, the power source 128 is restricted from supplying power to the auxiliary components. The smoking substitute device in this particular embodiment may thus be configured to entirely prevent power from being supplied to the auxiliary components when the smoking substitute device is in the shipping mode. Therefore, when the smoking substitute device is in shipping mode, the wireless interface 134 and the accelerometer 135 will not operate as there will be no power supplied to them. However, in other embodiments a smoking substitute device may be configured to restrict but not entirely prevent the power supply to the auxiliary components when in shipping mode.

In the present embodiment, when the smoking substitute device is in the shipping mode, the power source 128 may also be prevented from supplying power to the electrical interface 136 within the coupling portion 121. Therefore, in this example of a shipping mode, the smoking substitute device cannot direct power to the heating device 162 of a consumable 160, even if the consumable 150 is received in the smoking substitute device. However, in other embodiments the supply of power to the electrical interface 136 within the coupling portion may not be prevented, although it may be restricted in some embodiments, when the smoking substitute device is in shipping mode.

The smoking substitute device may be configured to enter shipping mode after first manufacture, assembly and testing, so that it is in shipping mode when it is packaged up and transported for distribution or sale, and when it is in a shop or other location, awaiting purchase by a user. The shipping mode is operationally efficient and ensures that minimal power is consumed by the device between manufacture and assembly and unpacking by the user. It also provides a safety feature, for example by preventing overheating of the smoking substitute device, which might otherwise occur if it had several electrical components operating within a confined package, before purchase.

It will be appreciated that a smoking substitute device may have to be operated, at least briefly, in an active mode or in a mode that simulates an active mode, for it to be properly tested before it enters shipping mode for transportation. In some embodiments, a smoking substitute device may be pre-configured, during the manufacture process, to have a separate "initial testing" mode (in addition to the active mode and shipping mode), which allows the components to be at least briefly activated for testing. In such an embodiment, the product manufacturer or tester can activate the initial testing mode for testing and provide a predetermined instruction or set of conditions, in order for the device to then transition to shipping mode, after testing.

In the present embodiment, the smoking substitute device does not have a separate initial testing mode but it is pre-configured so that the manufacturer or tester can briefly operate the device in an active mode, or in a mode that simulates an active mode, for testing. The smoking substitute device will then transition to shipping mode for transportation, if there is no airflow detected for a predetermined period of time. The device may automatically transition to the shipping mode, once the predetermined period of time has passed, after testing is complete. The predetermined period of time applied in this situation, for transitioning the device to shipping mode after testing, can be relatively brief.

In some embodiments, the transition from the initial testing mode to shipping mode may also have a requirement that the smoking substitute device should not have a consumable received in the coupling portion. It is known that smoking substitute devices are typically not packaged or sold with consumables received therein. Consumables and smoking substitute devices are typically sold separately.

It will be appreciated that, once the smoking substitute device has been transported and sold to an end user, that end user will wish to transition the device from the shipping mode to an active mode, in order to enjoy and make use of the complete operational capabilities of the smoking substitute device. In embodiments of the disclosure, the smoking substitute device is configured so that the user must ensure that two conditions are met, in order to transition the smoking substitute device from the shipping mode to the active mode. The two conditions are: (1.) a consumable must be received in the coupling portion of the device; and (2.) a flow of air must be detected through the main body of the device.

Therefore, in practice all the user needs to do, in order to transition the smoking substitute device from the shipping mode to the active mode, is to correctly insert a suitable consumable 150 into the smoking substitute device, so that it couples mechanically and electrically with the coupling portion 121, and to perform an inhalation through the smoking substitute device, via the mouthpiece 166 of the inserted consumable 150. Therefore, advantageously, the user can switch the smoking substitute device to the active mode—which means that power will be supplied to is auxiliary components—without requiring the actuation of (or even the presence in the device of) a separate dedicated user input component, for example an on/off button or switch.

In the present embodiment, following the steps to transition the smoking substitute device to operating in the active mode will also enable the supply of power to the heating device 162 of the consumable 150, via the coupled electrical interfaces 136, 160 of the smoking substitute device and of the consumable 150. However, in other embodiments, a separate routine may be required in order to initiate the supply of power to the heating device 162 of the consumable 150, for the first time. Moreover, in either case, the subsequent operation of the heating device 162 when the smoking substitute device is in the active mode, can be controlled as described in detail above, based on detection signals issued by the airflow sensor 131, when a user inhales through the smoking substitute device.

According to the present embodiment, the method for controlling the operation of the heating device 162 when the smoking substitute device is in the active mode is further refined, because the active mode has two sub-modes. Other embodiments may not have any sub-modes, and still others may have more than two sub-modes. Other embodiments may also have sub-modes within the shipping mode, but this particular embodiment does not.

The first sub-mode, according to the present embodiment, may be referred to as a so-called "use mode". It is a sub-mode of the active mode in which the control unit 130 of the smoking substitute device permits power to be supplied to the consumable 150. Notably, if the smoking substitute device is in "use mode", power can be supplied to the heating device 162 in the consumable 150, to enable liquid or tobacco to be heated for smoking substitute action. Power need not be continually supplied to the heating device 162 when the smoking substitute device is in the use mode. Instead, the times at which power will be supplied to the heating device 162 will still be controlled according to the detection signals received from the airflow sensor 131, indicating user inhale actions. According to the present embodiment, the smoking substitute device will default to being in the use mode (or sub-mode) when the device transitions from operating in a shipping mode to operating in an active mode, unless certain pre-set operating conditions determine that it cannot be in use mode. This will be understood further from the description of the second sub-mode, below.

The second sub-mode of the active mode, which may be referred to as a so-called "standby mode" is a sub-mode in which power is supplied to the auxiliary components, but not to the consumable 150. The smoking substitute device therefore does not enable liquid or tobacco in the consumable 150 to be heated for smoking substitute action, when it is in standby mode. In the present embodiment, the smoking substitute device will only enter standby mode if, when the device transitions from operating in a shipping mode to operating in an active mode, there is insufficient power (i.e., insufficient battery level) to operate both the auxiliary components and the heating device 162 within the consumable 150. The standby mode therefore enables the auxiliary components to continue to operate, and carry out their important functions as detailed above, but prevents smoking substitute action. During subsequent operation of the smoking substitute device, once it has sufficient power (and if the conditions for transitioning back to shipping mode, as detailed below, have not been met) the smoking substitute device will default to being in active mode, in which supplying power to the heating device is permissible, in accordance with the control signals based on the detected airflows within the smoking substitute device.

According to an alternative embodiment, the "use" sub-mode refers to the operating mode of the smoking substitute device when it is actively supplying power to the heating device for smoking substitute action. Therefore, the device would be operating in "use mode" when the user is inhaling on the smoking substitute device. Conversely, according to such an embodiment, the "standby" sub-mode refers to the operating mode of the smoking substitute device when it has transitioned out of shipping mode, but it is not currently actively supplying power to the heating device for smoking substitute action. Therefore, the device would be operating in "standby mode" in between inhalation actions, if the conditions are not met for it to transition back to shipping mode.

According to some embodiments, it may not be possible for a smoking substitute device to automatically transition back to being in shipping mode. It may instead require a dedicated user input, either directly made at the smoking substitute device or made via a connected mobile device or application. However, in this embodiment the smoking substitute device is configured so that it can transition back to shipping mode automatically, if certain conditions are met.

According to the present embodiment, the smoking substitute device is configured to transition back to operating in shipping mode if no further inhale actions are detected during a pre-determined period of time following the most recent inhale action. That pre-determined period of time may be relatively long. For example, it may be of the order of a few days or even a few weeks. The transition can be controlled by the control unit, which is configured to make determinations based on signals received from the air flow sensor and the electrical interface within the coupling portion, and to issue control instructions accordingly.

The present inventor(s) recognise that it is likely to be inconvenient to the user if the smoking substitute device transitions back to shipping mode too readily, because operation of the auxiliary components that the user finds useful is disabled when the device is in shipping mode. However, the present inventors have further recognised that this potential inconvenience should be balanced against the inconvenience and inefficiency disadvantages of continually operating the auxiliary components if the smoking substitute device is going unused by the user for smoking substitute action for extended periods of time.

According to a refinement of the present embodiment, the length of the pre-determined period of time, after which the smoking substitute device will transition back to being in shipping mode if no inhale actions are detected, will be different dependent on whether or not the device has a consumable inserted therein. If the smoking substitute device has a consumable inserted therein, which is detectable via the electrical interfaces of the smoking substitute device and consumable as detailed above, the control unit in this refinement of the present embodiment may be configured to interpret the presence of that consumable as an indication that the user is likely to want to use the device for smoking substitute action again in the short to medium term. The microprocessor will therefore be configured only to transition the device back to shipping mode if no inhalation actions are detected for a relatively long first period of time.

On the other hand, if it is determined that there is no consumable inserted in the device, the microprocessor will be configured to interpret this as an indication that the user may not want to use the device for smoking substitute action again in the short to medium term and therefore it will be configured to transition the device back to shipping mode if no inhalation actions are detected for second period of time, that is shorter than the aforementioned first period of time.

Figure 4:
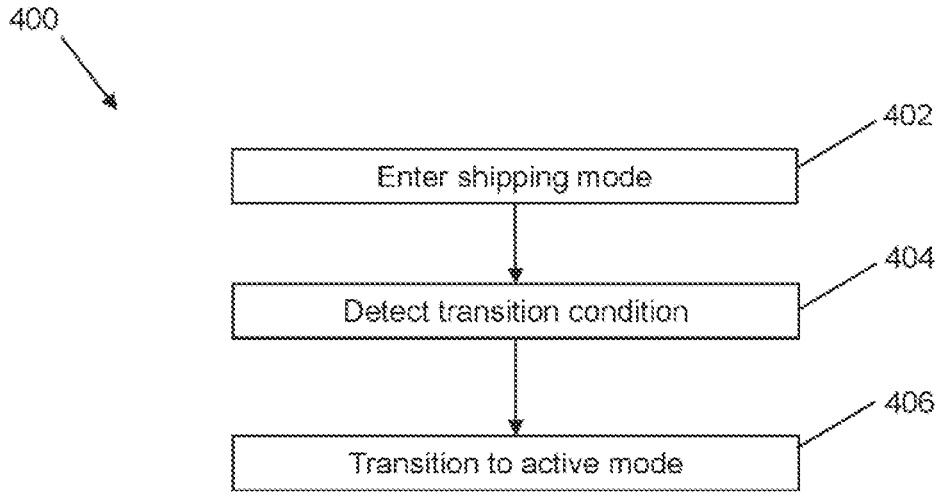
FIG. 4 is a flow diagram of a method of managing a smoking substitute device that is an embodiment of the disclosure.

FIG. 4 is a flow diagram for a method 400 of controlling the operating mode of a smoking substitute device according to an embodiment of the disclosure. This method 400 concerns the transition from the shipping mode to the active mode.

The method 400 begins with a step 402 of entering the shipping mode, e.g., after manufacture before transportation to a sale port, or upon detecting a certain period of inactivity.

The method continues with a step 404 of detecting a transition condition. As discussed above, the transition condition preferably has two or more criteria, such as detection of airflow through the device and detection of a connected consumable. The detection of the transition condition may be performed by the control unit of the smoking substitute device, e.g., based on signals from components therein that are active in the shipping mode.

The method continues with a step 406 of transitioning to the active mode if the transition condition is fulfilled.

Figure 5:
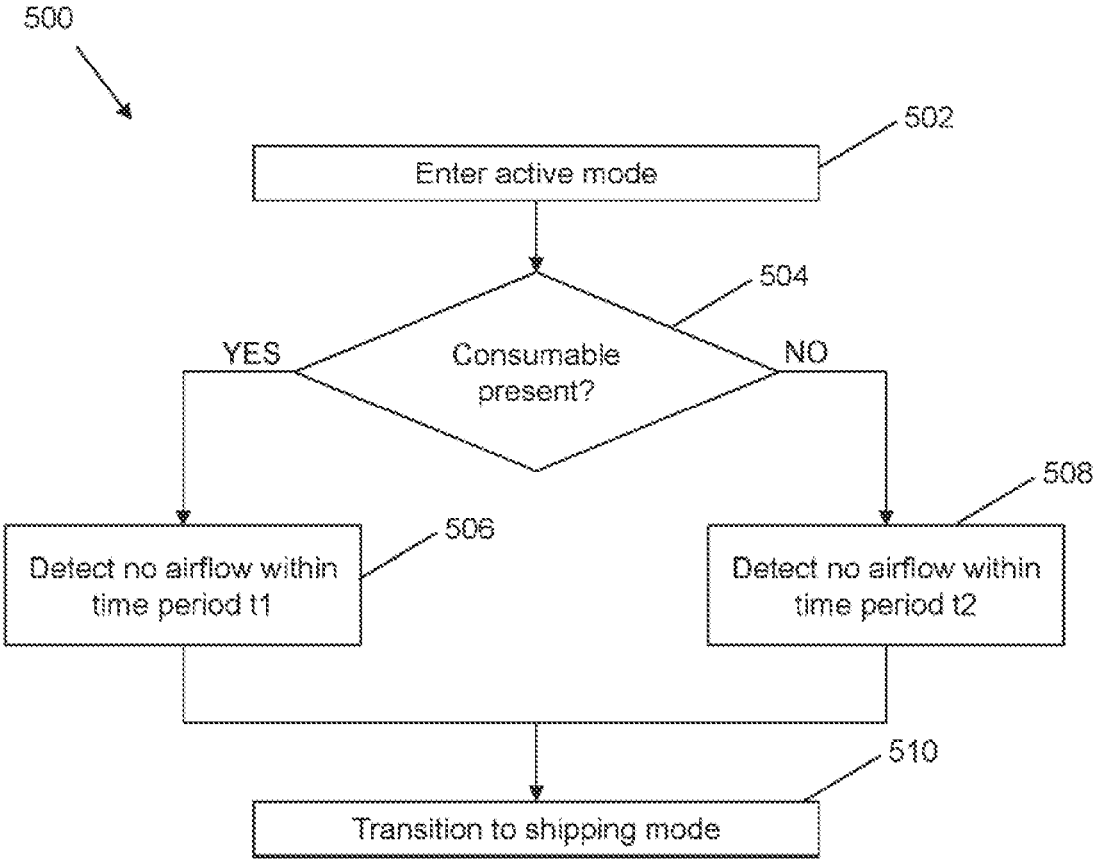
FIG. 5 is a flow diagram of a method of managing a smoking substitute device that is another embodiment of the disclosure.

FIG. 5 is a flow diagram of a method 500 of controlling the operating mode of a smoking substitute device according to an embodiment of the disclosure. This method 500 concerns the transition from the active mode to the shipping mode.

The method 500 begins with a step 502 of entering the active mode, e.g., after the method 400 of FIG. 4 is performed.

The method continues with a step 504 of detecting whether or not a consumable is present. This step may be performed by the control unit 130 detecting an electrical property (e.g., resistance) at the electrical interface 136, as discussed above.

If an outcome of the step 504 is that a consumable is present, the method continues with a step 506 of detecting no airflow through the main body within a first time period t1. This step 506 may be performed by the control unit 130 monitoring an output from the airflow sensor 131. If no airflow is detected through the main body within the first time period t1, the method continues with a step 510 of transitioning to the shipping mode.

If an outcome of the step 504 is that a consumable is not present, the method continues with a step 508 of detecting no airflow through the main body within a second time period t2. The second time period t2 is preferably shorter than the first time period t1. This step 508 may be performed by the control unit 130 monitoring an output from the airflow sensor 131. If no airflow is detected through the main body within the second time period t2, the method continues with a step 510 of transitioning to the shipping mode.

Of course, FIG. 5 is just one example implementation and other processes are possible. In particular, the smoking substitute device may be configured to transition from the shipping mode to the active mode upon detection of any two or more of: (i) a consumable received in the coupling portion; (ii) a flow of air through the body; and/or (iii) connection of a charging interface to the smoking substitute device.

The above disclosure presents an intelligent and sophisticated method and device for controlling operational modes of a smoking substitute device. The approach described herein ensures enhance efficiency and safety of the device at times when operation of certain of its components is not required, and intuitive and straight forward activation of operation of auxiliary components at time when they are likely to be required and appreciated by the user.

The terms "shipping mode", "active mode", "use mode" and "standby mode" are intended to be illustrative only and are not intended to be limiting. Other terms may be used instead, to describe the respective operational states of a smoking substitute device, as detailed above.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

The following statements, which form part of the description, provide general expressions of the disclosure herein:

A1. A smoking substitute device comprising a body housing a power source, an auxiliary component, and an airflow sensor for detecting airflow through the body, wherein:

the body includes a coupling portion arranged to receive a consumable;

the body is selectively operable in a shipping mode and an active mode;

in the active mode, the power source is configured to supply power to the auxiliary component; and in the shipping mode, the power source is restricted from supplying power to the auxiliary component; and the body is configured to transition from the shipping mode to the active mode upon detection of at least two of:

a consumable received in the coupling portion;

a flow of air through the body; and connection of a charging interface to the smoking substitute device.

A2. The smoking substitute device of statement A1, wherein the coupling portion is configured to electrically couple with the consumable and/or mechanically couple with the consumable.

A3. The smoking substitute device of statement A1 or statement A2, wherein the body is configured to monitor an electrical property the coupling portion to detect whether or not a consumable is received in the coupling portion.

A4. The smoking substitute device of any preceding statement, wherein the body is configured to transition from the shipping mode to the active mode upon detection of:

a consumable received in the coupling portion; and a flow of air through the body.

A5. The smoking substitute device of any preceding statement, wherein, in the shipping mode, a power supply from the power source to the auxiliary component is prevented.

A6. The smoking substitute device of any preceding statement, wherein the airflow sensor is positioned in an airflow channel extending through the body of the smoking substitute device.

A7. The smoking substitute device of any preceding statement, wherein the body is configured to transition from the active mode to the shipping mode if the airflow sensor does not detect a flow of air through the body for a predetermined period of time.

A8. The smoking substitute device of any preceding statement, wherein the active mode includes a first sub-mode, in which power is supplied to the consumable.

A9. The smoking substitute device of any preceding statement wherein the active mode includes a second sub-mode in which power is supplied to the auxiliary device but not to the consumable.

A10. The smoking substitute device of any of statements A7 to A9, wherein the body is configured to:

detect whether or not a consumable is received in the coupling portion;

upon detecting that a consumable is received in the coupling portion, transition from the active mode to the shipping mode if the airflow sensor detects no flow of air through the main body after a first predetermined period of time; and upon detecting that a consumable is not received in the coupling portion, transition from the active mode to the shipping mode if the airflow sensor detects no flow of air through the main body after a second predetermined period of time.

A11. The smoking substitute device of statement A10, wherein the first predetermined period of time is longer than the second predetermined period of time.

A12. A computer-implemented method for controlling a smoking substitute device that comprises a body housing a power source, an auxiliary component, and an airflow sensor for detecting airflow through the body, wherein the method comprises:

configuring the smoking substitute device in a shipping mode, in which the power source is restricted from supplying power to the auxiliary component; and transitioning from the shipping mode to an active mode upon detection of a transition condition, wherein, in the active mode the power source is configured to supply power to the auxiliary component, wherein the transition condition comprises at least two of:

a consumable received in a coupling portion of the body;

a flow of air through the body; and connection of a charging interface to the smoking substitute device.

A13. The computer-implemented method of statement A12, wherein the transition condition comprises: a consumable received in a coupling portion of the body; and a flow of air through the body, wherein the method further comprises:

detecting, by a control unit in the body, whether or not a consumable is received in the coupling portion;

detecting, by the airflow sensor, whether or not there is a flow of air through the body; and upon detection of the transition condition, issuing, by the control unit, a control instruction that causes the body to transition from the shipping mode to the active mode.

A14. The computer-implemented method for controlling a smoking substitute device that comprises a body housing a power source, an auxiliary component, and an airflow sensor for detecting airflow through the body, wherein the method comprises:

configuring the smoking substitute device in an active mode, in which the power source is configured to supply power to the auxiliary component;

detecting, by a control unit in the body, whether or not a consumable is received in a coupling portion of the body;

upon detecting that a consumable is received in the coupling portion, transitioning from the active mode to a shipping mode if the airflow sensor detects no flow of air through the main body after a first predetermined period of time; and upon detecting that a consumable is not received in the coupling portion, transitioning from the active mode to the shipping mode if the airflow sensor detects no flow of air through the main body after a second predetermined period of time, wherein, in the shipping mode, the power source is restricted from supplying power to the auxiliary component.

A15. A computer-readable medium containing computer-readable instructions which, when executed by a processor, cause the processor to perform a method according to any one of statements A12 to A14.

PART B (P01013EP)

Technical Field

The present disclosure relates to smoking substitute and particularly, although not exclusively, to monitoring an operational parameter of a smoking substitute device.

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Conventional combustible smoking articles, such as cigarettes, typically comprise a cylindrical rod of tobacco comprising shreds of tobacco which is surrounded by a wrapper, and usually also a cylindrical filter axially aligned in an abutting relationship with the wrapped tobacco rod. The filter typically comprises a filtration material which is circumscribed by a plug wrap. The wrapped tobacco rod and the filter are joined together by a wrapped band of tipping paper that circumscribes the entire length of the filter and an adjacent portion of the wrapped tobacco rod. A conventional cigarette of this type is used by lighting the end opposite to the filter, and burning the tobacco rod. The smoker receives mainstream smoke into their mouth by drawing on the mouth end or filter end of the cigarette.

Combustion of organic material such as tobacco is known to produce tar and other potentially harmful by-products. There have been proposed various smoking substitute devices in order to avoid the smoking of tobacco.

Such smoking substitute devices can form part of nicotine replacement therapies aimed at people who wish to stop smoking and overcome a dependence on nicotine.

Smoking substitute devices may comprise electronic systems that permit a user to simulate the act of smoking by producing an aerosol (also referred to as a "vapor") that is drawn into the lungs through the mouth (inhaled) and then exhaled. The inhaled aerosol typically bears nicotine and/or flavorings without, or with fewer of, the odor and health risks associated with traditional smoking.

In general, smoking substitute devices are intended to provide a substitute for the rituals of smoking, whilst providing the user with a similar experience and satisfaction to those experienced with traditional smoking and tobacco products. Some smoking substitute systems use smoking substitute articles (also referred to as a "consumables") that are designed to resemble a traditional cigarette and are cylindrical in form with a mouthpiece at one end.

The popularity and use of smoking substitute devices has grown rapidly in the past few years. Although originally marketed as an aid to assist habitual smokers wishing to quit tobacco smoking, consumers are increasingly viewing smoking substitute devices as desirable lifestyle accessories. Some smoking substitute devices are designed to resemble a traditional cigarette and are cylindrical in form with a mouthpiece at one end. Other smoking substitute devices do not generally resemble a cigarette (for example, the smoking substitute device may have a generally box-like form).

There are a number of different categories of smoking substitute devices, each utilizing a different smoking substitute approach. A smoking substitute approach corresponds to the manner in which the substitute system operates for a user.

One approach for a smoking substitute device is the so-called "vaping" approach, in which a vaporizable liquid, typically referred to (and referred to herein) as "e-liquid", is heated by a heating device to produce an aerosol vapor which is inhaled by a user. An e-liquid typically includes a base liquid as well as nicotine and/or flavorings. The resulting vapor therefore typically contains nicotine and/or flavorings. The base liquid may include propylene glycol and/or vegetable glycerin.

A typical vaping smoking substitute device includes a mouthpiece, a power source (typically a battery), a tank for containing e-liquid, as well as a heating device. In use, electrical energy is supplied from the power source to the heating device, which heats the e-liquid to produce an aerosol (or "vapor") which is inhaled by a user through the mouthpiece.

Vaping smoking substitute devices can be configured in a variety of ways. For example, there are "closed system" vaping smoking substitute devices which typically have a sealed tank and heating element which is pre-filled with e-liquid and is not intended to be refilled by an end user. One subset of closed system vaping smoking substitute devices include a main body which includes the power source, wherein the main body is configured to be physically and electrically coupled to a consumable including the tank and the heating element. In this way, when the tank of a consumable has been emptied, the main body can be reused by connecting it to a new consumable. Another subset of closed system vaping smoking substitute devices are completely disposable, and intended for one-use only.

There are also "open system" vaping smoking substitute devices which typically have a tank that is configured to be refilled by a user, so the device can be used multiple times.

An example vaping smoking substitute device is the Myblu™ e-cigarette. The Myblu™ e-cigarette is a closed system device which includes a main body and a consumable. The main body and consumable are physically and electrically coupled together by pushing the consumable into the main body. The main body includes a rechargeable battery. The consumable includes a mouthpiece, a sealed tank which contains e-liquid, as well as a heating device, which for this device is a heating filament coiled around a portion of a wick which is partially immersed in the e-liquid. The device is activated when a microprocessor on board the main body detects a user inhaling through the mouthpiece. When the device is activated, electrical energy is supplied from the power source to the heating device, which heats e-liquid from the tank to produce a vapor which is inhaled by a user through the mouthpiece.

Another example vaping smoking substitute device is the blu PRO™ e-cigarette. The blu PRO™ e-cigarette is an open system device which includes a main body, a (refillable) tank, and a mouthpiece. The main body and tank are physically and electrically coupled together by screwing one to the other. The mouthpiece and refillable tank are physically coupled together by screwing one of the other, and detaching the mouthpiece from the refillable tank allows the tank to be refilled with e-liquid. The device is activated by a button on the main body. When the device is activated, electrical energy is supplied from the power source to a heating device, which heats e-liquid from the tank to produce a vapor which is inhaled by a user through the mouthpiece.

Another approach for a smoking substitute system is the so-called Heated Tobacco ("HT") approach in which tobacco (rather than an "e-liquid") is heated or warmed to release vapor. HT is also known as "heat not burn" ("HNB"). The tobacco may be leaf tobacco or reconstituted tobacco. The vapor may contain nicotine and/or flavorings. In the HT approach the intention is that the tobacco is heated but not burned, i.e., the tobacco does not undergo combustion.

A typical HT smoking substitute system may include a device and a consumable. The consumable may include the tobacco material. The device and consumable may be configured to be physically coupled together. In use, heat may be imparted to the tobacco material by a heating element of the device, wherein airflow through the tobacco material causes components in the tobacco material to be released as vapor. A vapor may also be formed from a carrier in the tobacco material (this carrier may for example include propylene glycol and/or vegetable glycerin) and additionally volatile compounds released from the tobacco. The released vapor may be entrained in the airflow drawn through the tobacco.

As the vapor passes through the consumable (entrained in the airflow) from the location of vaporization to an outlet of the consumable (e.g., a mouthpiece), the vapor cools and condenses to form an aerosol for inhalation by the user. The aerosol will normally contain the volatile compounds.

In HT smoking substitute systems, heating as opposed to burning the tobacco material is believed to cause fewer, or smaller quantities, of the more harmful compounds ordinarily produced during smoking. Consequently, the HT approach may reduce the odor and/or health risks that can arise through the burning, combustion and pyrolytic degradation of tobacco.

There may be a need for improved design of smoking substitute systems, in particular HT smoking substitute systems, to enhance the user experience and improve the function of the HT smoking substitute system.

An example of the HT approach is the IQOS™ smoking substitute device from Philip Morris Ltd. The IQOS™ smoking substitute device uses a consumable, including reconstituted tobacco located in a wrapper. The consumable includes a holder incorporating a mouthpiece. The consumable may be inserted into a main body that includes a heating device. The heating device has a thermally conductive heating knife which penetrates the reconstituted tobacco of the consumable, when the consumable is inserted into the heating device. Activation of the heating device heats the heating element (in this case a heating knife), which, in turn, heats the tobacco in the consumable. The heating of the tobacco causes it to release nicotine vapor and flavorings which may be drawn through the mouthpiece by the user through inhalation.

A second example of the HT approach is the device known as "Glo"™ from British American Tobacco p.l.c. Glo™ comprises a relatively thin consumable. The consumable includes leaf tobacco which is heated by a heating device located in a main body. When the consumable is placed in the main body, the tobacco is surrounded by a heating element of the heating device. Activation of the heating device heats the heating element, which, in turn, heats the tobacco in the consumable. The heating of the tobacco causes it to release nicotine vapor and flavorings which may be drawn through the consumable by the user through inhalation. The tobacco, when heated by the heating device, is configured to produce vapor when heated rather than when burned (as in a smoking apparatus, e.g., a cigarette). The tobacco may contain high levels of aerosol formers (carrier), such as vegetable glycerin ("VG") or propylene glycol ("PG").

The present inventor(s) have observed that most smoking substitute devices currently on the market are configured to operate in isolation of other devices, which limits the functions the smoking substitute devices can perform.

The present inventor(s) have observed that, as smoking substitute devices become more sophisticated, user expectations increase in terms of his or her smoking substitute device monitoring operational parameters for itself. It is helpful for the user to be provided with accurate and timely information regarding operation of his or her smoking substitute device, for example regarding liquid reservoir or consumable pod refill level.

The present disclosure has been devised in light of the above considerations.

SUMMARY OF THE DISCLOSURE

At its most general, the disclosure provides a system, device and method that can accurately detect the fill level (or 'liquid level') of a liquid reservoir within, or connected to, a smoking substitute device. The fill level may comprise the fill level of a reservoir or tank that is integral to the smoking substitute device or it may comprise the fill level of a reservoir or tank that is part of a consumable or pod that connects to the main body of a smoking substitute device. The fill level can be determined accurately regardless of the orientation of the device because the control means that determines the fill level considers a measurement made by an orientation sensor within the smoking substitute device as well as a measurement made by a liquid level sensor.

The present inventor(s) have recognized that it is highly desirable and useful, form a user perspective, to know the fill level of his or her smoking substitute device, particularly when the fill level is low. This enables the user to purchase or otherwise obtain replacement consumables (or liquid for refilling the tank) before the current tank fill reduces to zero. It can also help the user avoid attempting smoking substitute action when there is little or no liquid in the tank, which can lead to an unsatisfactory user experience and may also risk damage to components of the device, for example if the heating device is heating a wick which is not soaked in e-liquid.

The control means that determines the fill level may be comprised within the smoking substitute device itself. For example, it may comprise a control unit such as a microprocessor. Alternatively, or additionally, the determination of the fill level may be carried out by a control means within an application that is installed on a mobile device with which the smoking substitute device is in wireless communication. Alternatively, or additionally, the determination of the fill level may be carried out by a control means within a server, for example a cloud-based server, that is in wireless communication with the application and/or with the smoking substitute device.

The control means may be configured to apply an algorithm to a liquid level measurement provided by the liquid level sensor, based on an orientation measurement provided by the orientation level sensor. For example, the algorithm may apply trigonometric principles to the liquid level sensed by the liquid level sensor, wherein the angle of tilt of the upper surface (or 'meniscus') of the liquid, compared to horizontal, is determined based on the orientation measurement obtained by the orientation sensor (such as an accelerometer), and that angle of tilt is used to calculate a liquid level that would have been sensed, had the device been upright (and the upper surface of the liquid had therefore been horizontal) at the time at which the liquid level measurement was taken. That calculation may take into account the physical location of the liquid level sensor, and its shape, size and so on, within the tank or reservoir.

The control means may be configured to, instead of changing or correcting a received liquid level sensed by the liquid level sensor, ignoring any liquid level measurements that are taken when, according to the orientation sensor, the device is not in an upright position. The control means may further be configured to request a liquid level measurement from the liquid level sensor when (and, optionally, only when) the smoking substitute device is determined to be in an upright position.

The control means may used stored look up tables or other reference data, in order to determine a corrected fill level based on a liquid level measurement in combination with an orientation measurement. The liquid level measurements and/or the orientation measurements and/or the determined/corrected liquid level values may be stored in a suitable memory location within the smoking substitute device itself and/or within memory means of an application and/or within memory means of a server.

The determined fill level values may be output to the user, via an output means of the smoking device itself. Alternatively, they may be output via an application, via an output means of a mobile device on which the application is installed. The output may comprise a warning if the determined fill level value is below a predetermined threshold. The output may comprise a warning if the determined fill level value is above a predetermined threshold—for example, to inform the user that he or she has over-filled the tank of a refillable smoking substitute device.

According to a first aspect of the disclosure, there is provided a smoking substitute device comprising: a tank for containing a liquid; a liquid-level sensor for detecting a level of liquid in the tank; an orientation sensor for detecting an orientation of the smoking substitute device; and a control unit. The control unit is configured to determine an amount of liquid in the tank by modifying a liquid level measurement detected by the liquid-level sensor using an orientation measurement detected by the orientation sensor.

The liquid level measurement may be a measurement that relates directly to liquid level. Alternatively, it could be a measurement of another parameter (for example, capacitance, voltage or current output by a sensor) that can be used as an indicator of liquid level in the tank.

The control unit may be configured so that the step of modifying a liquid level measurement detected by the liquid-level sensor based on an orientation measurement detected by the orientation sensor comprises applying an algorithm to the liquid level measurement. For example, the control unit may input the liquid level measurement and the orientation measurement to an algorithm whose output is a modified liquid level measurement. The algorithm may modify the liquid level measurement using a modification value or liquid level adjustment that has a predetermined relationship with the orientation measurement.

For example, the smoking substitute device may include a memory (e.g., non-volatile memory, such as flash) that stores a look-up table. The control unit may be configured to look up a liquid level adjustment from the look-up table using the orientation measurement, and apply the liquid level adjustment to the liquid level measurement detected by the liquid-level sensor. The look-up table may comprises a list of predetermined liquid level adjustments associated with corresponding orientation values. The control unit may be configured to find an orientation value that corresponds to the orientation measurement, and apply the liquid level adjustment associated with that orientation value to the liquid level measurement. Thus, the memory of the smoking substitute device may be configured to store a list of predetermined modification values and corresponding orientation values. Therefore, when the orientation sensor provides an orientation measurement to the control unit of the smoking substitute device (or to another control means), it can use the closest orientation value from the stored list in order to obtain the modification value that it should use in order to modify the liquid level measurement that it has obtained from the liquid level sensor, in order to determine and output a more accurate liquid level value that takes the orientation of the device into account. This can provide the user with a more accurate indication of the amount of liquid in the tank at that time.

The step of modifying a liquid level measurement detected by the liquid-level sensor based on an orientation measurement detected by the orientation sensor may be referred to or regarded as being a 'correction' step, since it may comprise correcting, or offsetting, an inherent assumption made by the liquid-level sensor that the entirety of the liquid in the reservoir or tank is at the same level as the particular region of liquid which comes into physical contact with, or is otherwise being monitored by, the liquid-level sensor. In fact the liquid may be tilted, for example if the smoking substitute device is not physically upright, such that liquid that is physically remote from the liquid-level sensor may be at a different level (when viewed along a substantially vertical axis) to the particular region of liquid which comes into physical contact with, or is otherwise being monitored by, the liquid-level sensor.

The step of modifying a liquid level measurement detected by the liquid-level sensor based on an orientation measurement detected by the orientation sensor may comprise ignoring that liquid level measurement, if it is detected by the orientation sensor that the device was not in a suitable position, when the liquid level measurement was taken. It may further comprise requesting a replacement liquid level measurement, when the device is next determined to be in a suitable position for accurately measuring liquid level in the tank.

The smoking substitute device may be configured so that the liquid-level sensor and/or the orientation sensor detect and provide liquid level and orientation measurements, respectively, at regular pre-determined intervals. Alternatively, or additionally, they may provide such measurements in response to demand, either from the user or the application or the mobile device that is in wireless communication with the smoking substitute device. The measurements may be assigned either absolute or relative times. This can help with synchronizing liquid-level data and orientation data, for determining a more accurate 'corrected' liquid/fill level for the tank and/or for determining the time(s) at which the received liquid level measurements can be deemed to be sufficiently accurate, taking into account the orientation of the device at that time(s).

The liquid may comprise any of a vaporizable e-liquid, or an aerosolizable flavoring. The tank may comprise a refillable reservoir or a consumable pod.

The smoking substitute device may comprise a main body that houses the control unit. The tank and liquid-level sensor may in contrast be in a consumable pod that is detachably mountable to the main body. The main body and the consumable pod may each include an electrical interface, where the electrical interfaces are connected when the consumable pod is mounted to the main body. The liquid-level sensor may be configured to communicate the liquid level measurement to the control unit via the electrical interfaces.

The smoking substitute device may further comprise a display means configured to display an amount of liquid, as determined by control unit. For example, the display means may comprise an LED or an LCD display. Alternatively, or additionally, the smoking substitute device may further comprise an audible output means configured to inform the user of an amount of liquid, as determined by control unit.

The smoking substitute device may further comprise a wireless interface configured to wirelessly communicate with an application installed on a mobile device. The wireless interface may comprise any suitable type of wireless communication interface, or terminal, for example a Wi-Fi or Bluetooth™ or Bluetooth™ Low Energy (BLE) interface. The smoking substitute device may thus be configured to wirelessly communicate a message including an amount of liquid, as determined by control unit, to associated application and/or a mobile device. The smoking substitute device may thus be network-enabled, so that it can communicate wirelessly, via its wireless interface, with a mobile device, and/or with an application running on a mobile device, and/or with a remote server such as a cloud-based server. For example, the mobile device may comprise any of a mobile phone, a smart phone, a laptop computer, a tablet computer, a television or a computer-based gaming device.

The steps for establishing a wireless communication link between the smoking substitute device and a mobile device may follow any suitable protocol. For example, if Bluetooth™ is used, the user can activate the Bluetooth™ functionalities of the smoking substitute device and of his or her selected mobile device, with which a wireless communication link is to be established, and the two devices can identify themselves to one another, exchange Bluetooth™ messages, and form a wireless communication link. The exchange should preferably involve suitable security steps, to ensure that the correct two devices form the wireless communication link. For example, the two devices may form a paired wireless communication link, which is secure, and which is an exclusive communication link, between those two individual devices. In order to form a paired wireless communication link, the devices should exchange security data such as encryption keys, passwords or codes. The devices may each be configured to store the encryption key received from the respective other, and to re-use that encryption key each time a connection between the two devices is required. This is known as establishing a bonded wireless communication link.

The steps for establishing a wireless communication link between the smoking substitute device and a mobile device may comprise any suitable combination of user-implemented, computer-implemented and hardware-implemented steps. For example, specific user input should be required in order to identify the mobile device, with which the smoking substitute device is to establish a wireless communication link. However, some or all of the steps involved in actually establishing wireless communication links between the smoking substitute device and the mobile device(s), and the subsequent wireless transmissions between the devices, may happen without any specific user input being required.

When a mobile device has established a wireless communication link with a smoking substitute device, the devices may share data via that link. For example, if the mobile device comprises a mobile device on which the user has installed an application for management of the smoking substitute device, the smoking substitute device may submit data regarding some of its hardware components, such as its battery, to the mobile device. An application running on the mobile device may access some of that data for storage, or possibly for making determinations—for example, for determining remaining battery power from battery output voltage levels. The application, or the mobile device, may transmit control signals to the smoking substitute device.

The amount of liquid in the reservoir or tank, as determined by the control unit (or other control means) may comprise a fill level or a volume. It may comprise an indication of the proportion of the full reservoir or tank that is currently filled. It may comprise an indication that a predetermined upper or lower fill threshold has been reached or passed.

The liquid level sensor may comprise any suitable sensor, for example a capacitance sensor. For example, the liquid level sensor may comprise a capacitive probe, which is configured to be located within the reservoir or tank, and which is configured to detect a different capacitance charge dependent on what proportion (i.e., how much of the top-to-bottom length) of the probe is exposed to either liquid or air. As will be known to the skilled reader, capacitance sensors and probes can be provided in a light and compact form, that could readily be incorporated into the tank of a smoking substitute device or consumable, without occupying too much space, and therefore without displacing too much liquid or requiring the tank to be unduly large. The capacitance sensor can electrically connect with the control unit of a smoking substitute device, in order to convey sensed capacitance measurements, for the determination of liquid fill level, based on the sensed capacitance measurements.

The orientation sensor may comprise any suitable sensor. For example, it may comprise any of an accelerometer, a gyroscope or a magnetometer. The orientation sensor may be configured to detect an orientation of the smoking substitute device, relative to a reference position. For example, the orientation sensor may detect an angle of tilt of the device, relative to its upright position, or relative to the position of the device in which the reservoir or tank that holds the liquid, the level of which is being determined, is upright.

In broad terms, and as will be known to the skilled reader, an accelerometer is configured to sense and measure acceleration, so can be used to detect movement of the smoking substitute device. A gyroscope is configured to measure and/or maintain orientation and angular velocity, so can be used to detect rotational movement of the smoking substitute device. A magnetometer is configured to measure magnetism, i.e., the direction, strength, or relative change of a magnetic field at a particular location. A magnetometer can be used as a compass for a smoking substitute device.

Some known smoking substitute devices already comprise an orientation sensing component. Such components can be used for management and control of the smoking substitute device. For example, an accelerometer may be comprised within a smoking substitute device and may be used, either in isolation or in combination with other components, to detect motion of the smoking substitute device of the type that is typical during a smoking substitute action. Information regarding such detected motion can be recorded, stored and/or analysed for the smoking substitute device in order to detect smoking substitute actions and, for example, to create a record of the number of smoking substitute actions that a user typically performs within a time period.

Therefore, the present disclosure makes use of components that already are comprised within, and/or which can be readily be comprised within, a smoking substitute device. An orientation sensing component and a liquid-level sensing component, of the type required to embody the present disclosure, can be physically very small and compact. Therefore, their inclusion within a smoking substitute device would not cause significant physical restraint on the device. Nor would the inclusion of a liquid-level sensing component and/or an orientation sensing component, of the type required to embody the present disclosure, require significant additional processing capability from the smoking substitute device.

The manner in which the control means uses the orientation measurement to correct or otherwise change the liquid level measurement that the liquid-level sensor has provided may depend on a number of factors. For example, it may depend on the nature of the output that is to be provided by the user—for example, whether an absolute level or a relative level, compared to a threshold, is to be output. It may also depend on predetermined margins of error that the smoking substitute device has been configured to accept, in relation to the liquid level measurements obtained when the reservoir is not in an upright position.

The functionality described herein for providing a corrected liquid-fill measurement for a smoking substitute device may be pre-programmed into the control means for a smoking substitute device during manufacture and factory setting. Alternatively, an existing smoking substitute device that includes the relevant sensors may be programmed to perform the methods, for example via a software update to an application on a mobile device that is in wireless communication with the smoking substitute device and/or via a firmware update applied to the software running the operation of the smoking substitute device itself.

According to a second aspect of the disclosure, there is provided a computer-implemented method for managing a smoking substitute device, the method comprising: detecting, using a liquid-level sensor, a level of liquid in a tank in the smoking substitute device; communicating a liquid level measurement from the liquid-level sensor to a control unit of the smoking substitute device; detecting, using an orientation sensor, an orientation of the smoking substitute device; communicating an orientation measurement from the orientation sensor to the control unit; and determining, by the control unit, an amount of liquid in the tank by modifying the liquid level measurement transmitted by the liquid-level sensor using the orientation measurement transmitted by the orientation sensor. This method may be carried out wholly at the smoking substitute device.

In other examples, the method may use a mobile device in communication with the smoking substitute device, for example by an application running on a mobile device that is in wireless communication with the smoking substitute device, or by processing means within a server such as, for example, a cloud-based server. Thus, according to a third aspect of the disclosure, there is provided a computer-implemented method for managing a smoking substitute device, the method comprising: receiving a liquid level measurement obtained by a liquid-level sensor in a tank in the smoking substitute device; receiving an orientation measurement obtained by an orientation sensor of the smoking substitute device; and determining an amount of liquid in the tank by modifying the liquid level measurement using the orientation measurement.

According to a fourth aspect of the disclosure, there is provided a computer readable medium containing instructions configured to, when executed by a processor on a smoking substitute device or by an application installed on a mobile device, perform any of the methods described herein.

The disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

SUMMARY OF THE FIGURES

Figure 6:
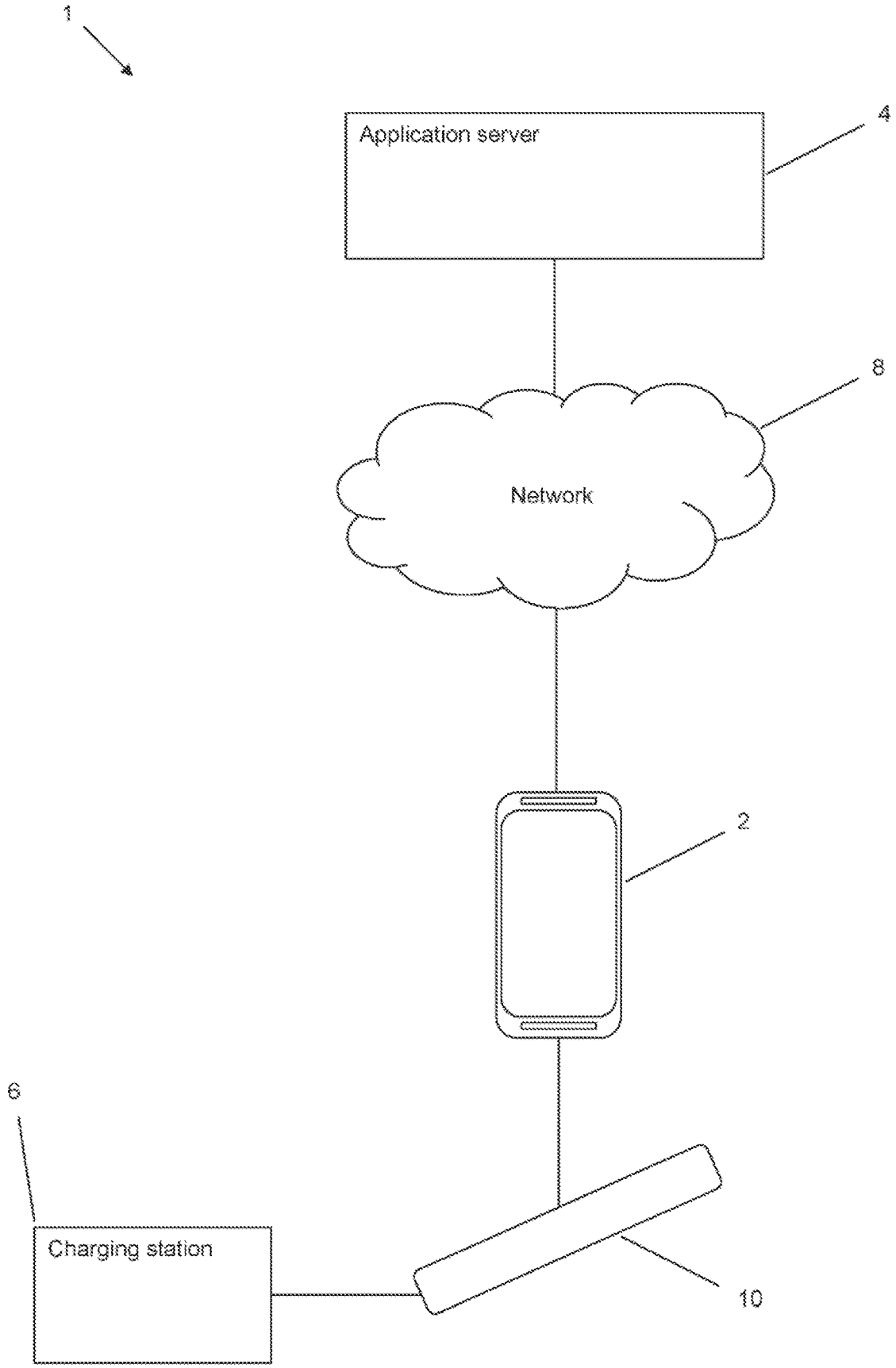

Embodiments and experiments illustrating the principles of the disclosure will now be discussed with reference to the accompanying figures in which:

FIG. 6 shows an example system for managing a smoking substitute device.

Figure 7A:
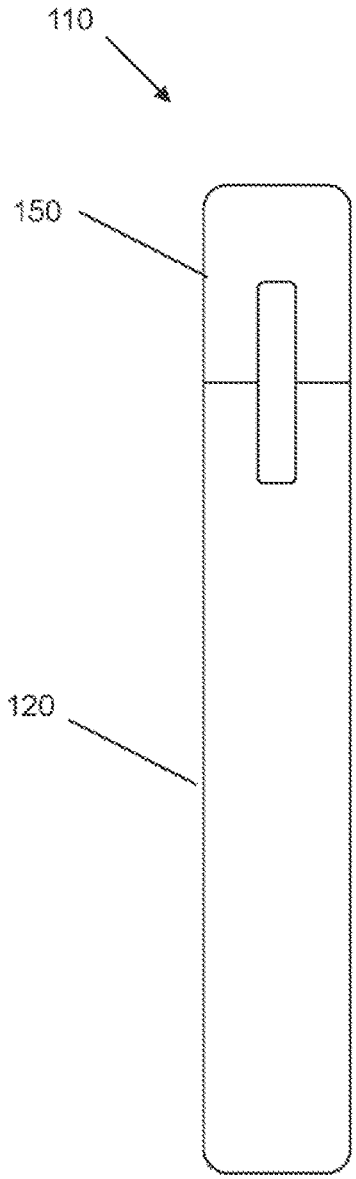

FIG. 7A shows an example smoking substitute device for use as the smoking substitute device in the system of FIG. 6.

Figure 7B:
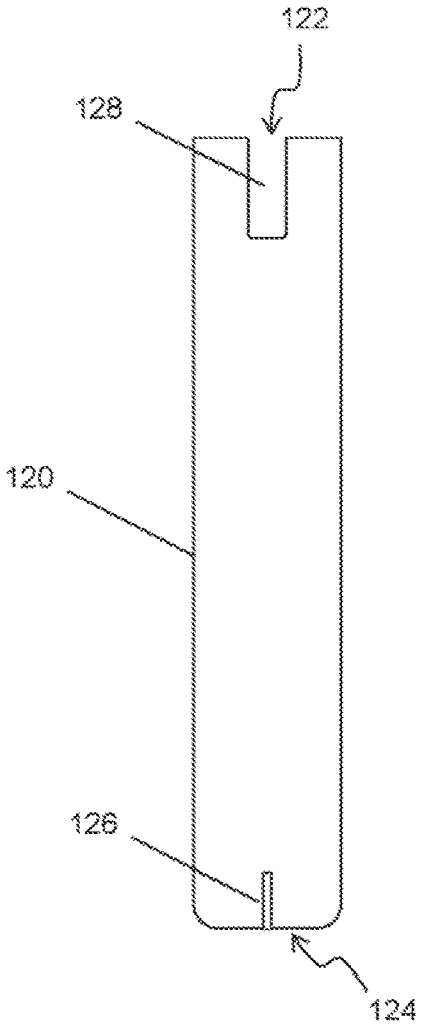

FIG. 7B shows the main body of the smoking substitute device of FIG. 7A without the consumable.

Figure 7C:
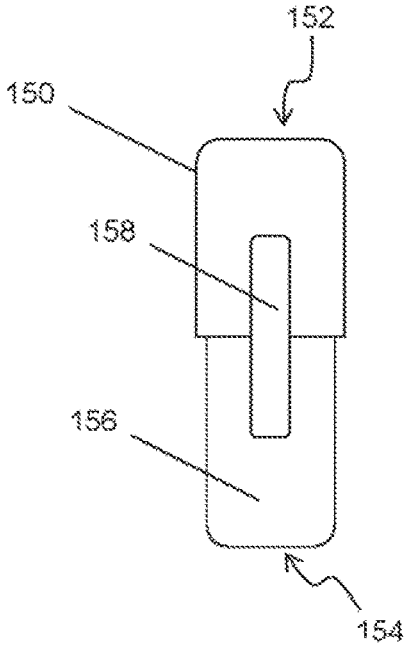

FIG. 7C shows the consumable of the smoking substitute device of FIG. 7B without the main body.

Figure 8A:
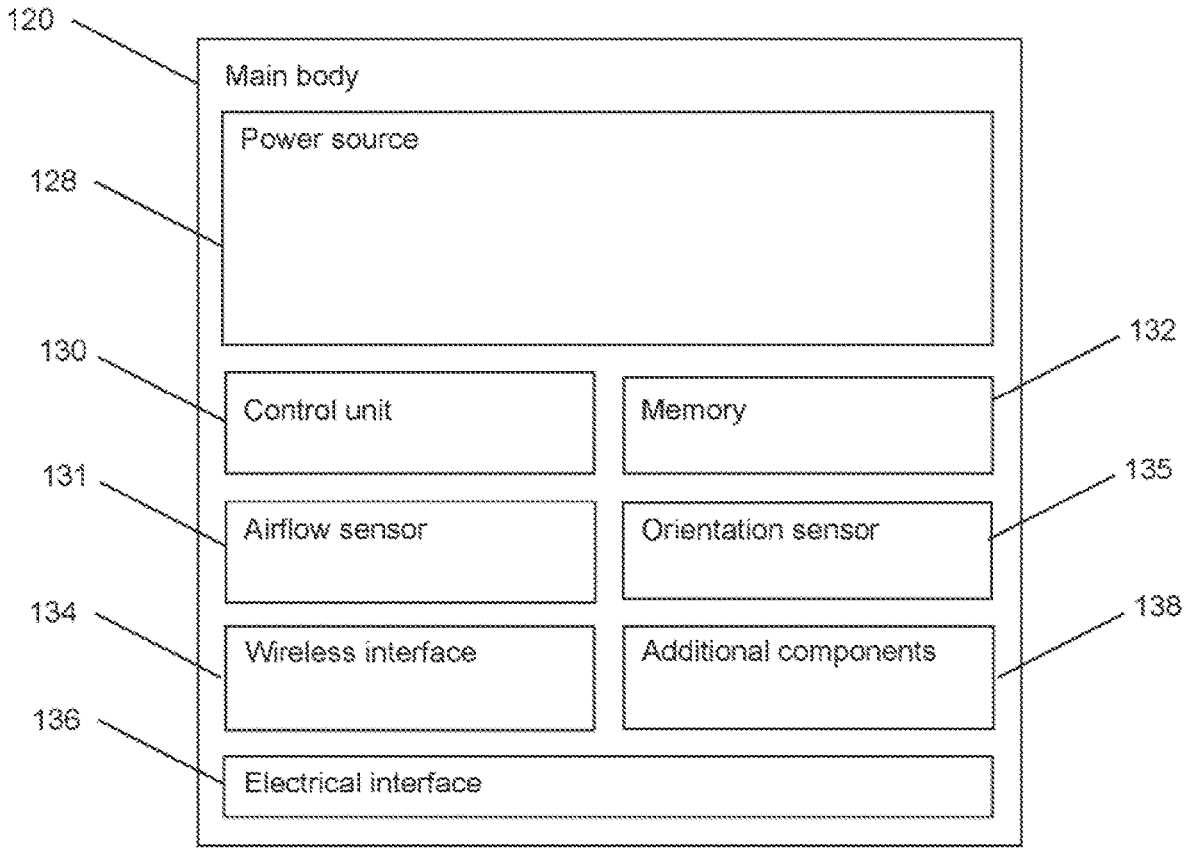

FIG. 8A is a schematic view of the main body of the smoking substitute device of FIG. 7A, in an embodiment of the disclosure.

Figure 8B:
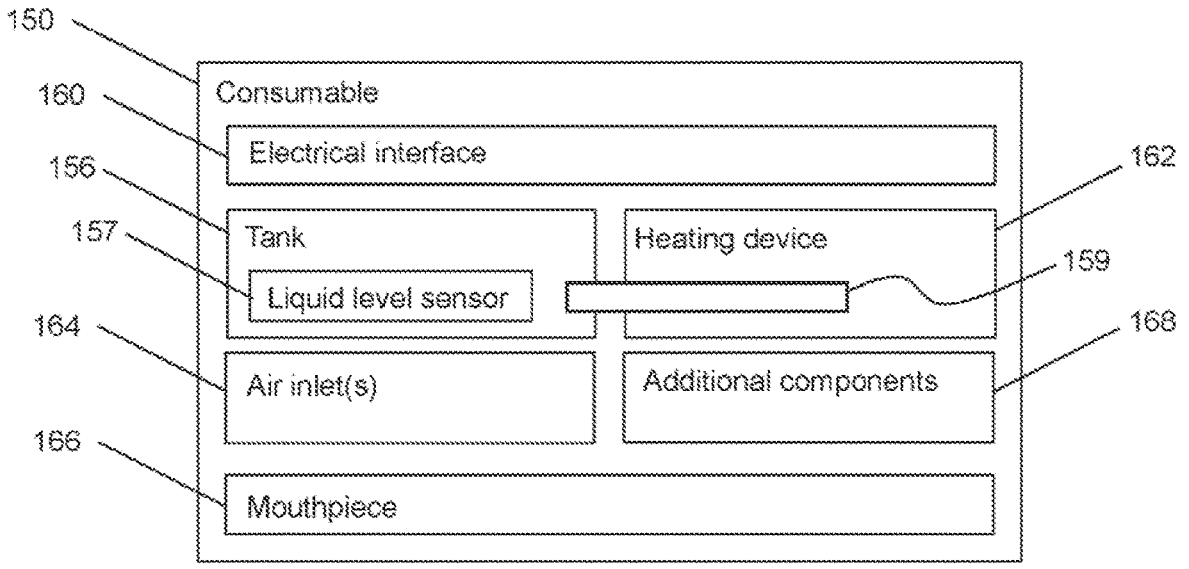

FIG. 8B is a schematic view of the consumable of the smoking substitute device of FIG. 7A, in an embodiment of the disclosure.

Figure 9:
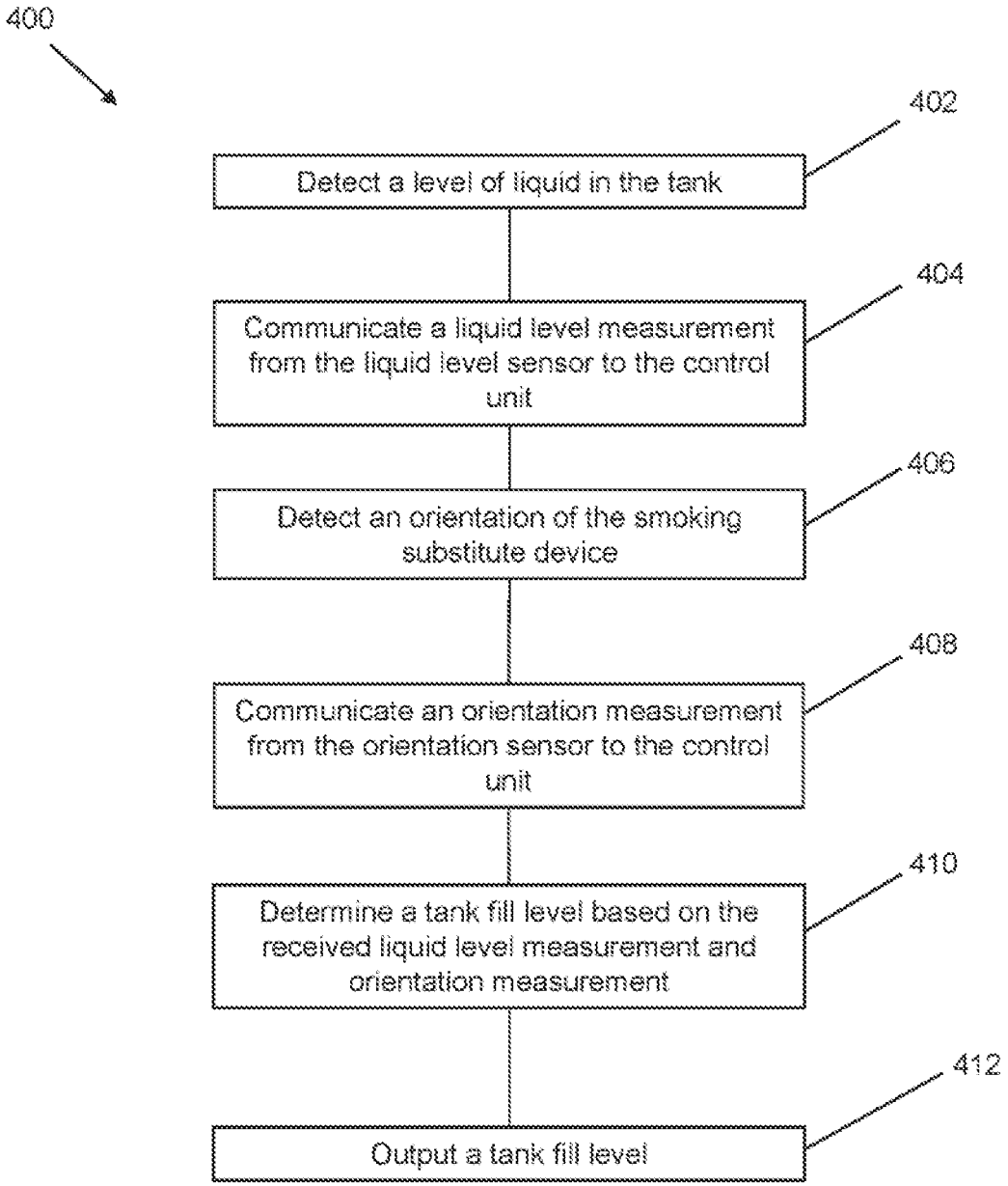

FIG. 9 is a flow diagram of operations carried out by a smoking substitute device, according to an embodiment of the present disclosure.

DETAILED DESCRIPTION OF THE DISCLOSURE

Aspects and embodiments of the present disclosure will now be discussed with reference to the accompanying figures. Further aspects and embodiments will be apparent to those skilled in the art. All documents mentioned in this text are incorporated herein by reference.

FIG. 6 shows an example system 1 for managing a smoking substitute device 10.

The system 1 as shown in FIG. 6 includes a mobile device 2, an application server 4, an optional charging station 6, as well as the smoking substitute device 10.

The smoking substitute device 10 is configured to communicate wirelessly, e.g., via Bluetooth™, with an application (or "app") installed on the mobile device 2, e.g., via a suitable wireless interface (not shown) on the mobile device 2. The mobile device 2 may be a mobile phone, for example. The application on the mobile phone is configured to communicate with the application server 4, via a network 8. The application server 4 may utilize cloud storage, for example.

The network 8 may include a cellular network and/or the internet.

A skilled person would readily appreciate that the mobile device 2 may be configured to communicate via the network 8 according to various communication channels, preferably a wireless communication channel such as via a cellular network (e.g., according to a standard protocol, such as 3G or 4G) or via a Wi-Fi network.

The app installed on the mobile device and the application server 4 may be configured to assist a user with their smoking substitute device 10, based on information communicated between the smoking substitute device 10 and the app and/or information communicated between the app and the application server 4.

The charging station 6 (if present) may be configured to charge (and optionally communicate with) the smoking substitute device 10, via a charging port on the smoking substitute device 10. The charging port on the smoking substitute device 10 may be a USB port, for example, which may allow the smoking substitute device to be charged by any USB-compatible device capable of delivering power to the smoking substitute device 10 via a suitable USB cable (in this case the USB-compatible device would be acting as the charging station 6). Alternatively, the charging station could be a docking station specifically configured to dock with the smoking substitute device 10 and charge the smoking substitute device 10 via the charging port on the smoking substitute device 10.

FIG. 7A shows an example smoking substitute device 110 for use as the smoking substitute device 10 in the system 1 of FIG. 6.

In this example, the smoking substitute device 110 includes a main body 120 and a consumable 150. The consumable 150 may alternatively be referred to as a "pod".

In this example, the smoking substitute device 110 is a closed system vaping device, wherein the consumable 150 includes a sealed tank 156 and is intended for one-use only.

FIG. 7A shows the smoking substitute device 110 with the main body 120 physically coupled to the consumable 150.

FIG. 7B shows the main body 120 of the smoking substitute device 110 without the consumable 150.

FIG. 7C shows the consumable 150 of the smoking substitute device 110 without the main body 120.

The main body 120 and the consumable 150 are configured to be physically coupled together, in this example by pushing the consumable 150 into an aperture in a top end 122 of the main body 120, e.g., with the consumable 150 being retained in the aperture via an interference fit. In other examples, the main body 120 and the consumable could be physically coupled together by screwing one onto the other, through a bayonet fitting, or through a snap engagement mechanism, for example. An optional light 126, e.g., an LED located behind a small translucent cover, is located a bottom end 124 of the main body 120. The light 126 may be configured to illuminate when the smoking substitute device 110 is activated.

The consumable 150 includes a mouthpiece (not shown) at a top end 152 of the consumable 150, as well as one or more air inlets (not shown in FIG. 7A-7C) so that air can be drawn into the smoking substitute device 110 when a user inhales through the mouthpiece. At a bottom end 154 of the consumable 150, there is located a tank 156 that contains e-liquid. The tank 156 may be a translucent body, for example.

The tank 156 preferably includes a window 158, so that the amount of e-liquid in the tank 156 can be visually assessed. The main body 120 includes a slot 128 so that the window 158 of the consumable 150 can be seen whilst the rest of the tank 156 is obscured from view when the consumable 150 is inserted into the aperture in the top end 122 of the main body 120. However, as embodiments of the disclosure also include a liquid level sensor for the tank 156, the window may be omitted such that the tank 156 is not visible in use.

In this present embodiment, the consumable 150 is a "single-use" consumable. That is, upon exhausting the e-liquid in the tank 156, the intention is that the user disposes of the whole consumable 150. In other embodiments, the e-liquid (i.e., aerosol former) may be the only part of the system that is truly "single-use". In such embodiments, the tank 156 may be refillable with e-liquid or the e-liquid may be stored in a non-consumable component of the system. For example, the e-liquid may be stored in a tank located in the device or stored in another component that is itself not single-use (e.g., a refillable tank).

The tank 156 may be referred to as a "clearomizer" if it includes a window 158, or a "cartomizer" if it does not.

FIG. 8A is a schematic view of the main body 120 of the smoking substitute device 110.

FIG. 8B is a schematic view of the consumable 150 of the smoking substitute device 110.

As shown in FIG. 8A, the main body 120 includes a power source 128, a control unit 130, an airflow sensor 131, a memory 132, a wireless interface 134, an orientation sensor 135, an electrical interface 136, and, optionally, one or more additional components 138.

The power source 128 is preferably a battery, more preferably a rechargeable battery.

The control unit 130 may include a microprocessor, for example.

The memory 132 is preferably includes non-volatile memory.

The wireless interface 134 is preferably configured to communicate wirelessly with the mobile device 2, e.g., via Bluetooth. To this end, the wireless interface 134 could include a Bluetooth™ antenna. Other wireless communication interfaces, e.g., Wi-Fi, are also possible.

The electrical interface 136 of the main body 120 may include one or more electrical contacts. The electrical interface 136 may be located in, and preferably at the bottom of, the aperture in the top end 122 of the main body 120. When the main body 120 is physically coupled to the consumable 150, the electrical interface 136 may be configured to pass electrical power from the power source 128 to (e.g., a heating device of) the consumable 150 when the smoking substitute device 110 is activated, e.g., via the electrical interface 160 of the consumable 150 (discussed below). When the main body 120 is not physically coupled to the consumable 150, the electrical interface may be configured to receive power from the charging station 6.

The additional components 138 of the main body 120 may include the optional light 126 discussed above.

The additional components 138 of the main body 120 may, if the power source 128 is a rechargeable battery, include a charging port configured to receive power from the charging station 6. This may be located at the bottom end 124 of the main body 120. Alternatively, the electrical interface 136 discussed above is configured to act as a charging port configured to receive power from the charging station 6 such that a separate charging port is not required.

The additional components 138 of the main body 120 may, if the power source 128 is a rechargeable battery, include a battery charging control circuit, for controlling the charging of the rechargeable battery. However, a battery charging control circuit could equally be located in the charging station 6 (if present).

The airflow sensor 131 may be configured to detecting airflow in the smoking substitute device 110, e.g., caused by a user inhaling through a mouthpiece 166 (discussed below) of the smoking substitute device 110. The smoking substitute device 110 may be configured to be activated when airflow is detected by the airflow sensor 131. This optional sensor could alternatively be included in the consumable 150 (though this is less preferred where the consumable 150 is intended to be disposed of after use, as in this example).

The additional components 138 of the main body 120 may include an actuator, e.g., a button. The smoking substitute device 110 may be configured to be activated when the actuator is actuated. This provides an alternative to the airflow sensor noted, as a mechanism for activating the smoking substitute device 110.

The additional components 138 of the main body 120 may include a reader configured to read information associated with the consumable from a machine readable data source included in (e.g., contained in the body of, or attached to) the consumable 150.

The reader may be configured to read information from the machine readable data source wirelessly, e.g., via electromagnetic waves or optically. Thus, for example, the machine readable data source included in the consumable 150 could be an RFID tag (in which case the reader included in the main body 120 may be an RFID reader) or a visual data source such as a barcode (in which case the reader included in the main body may be an optical reader, e.g., a barcode scanner). Various wireless technologies and protocols may be employed to allow the reader to wirelessly read information from a machine readable data source included in or attached to the consumable 150, e.g., NFC, Bluetooth, Wi-Fi, as would be appreciated by a skilled person.

For avoidance of any doubt, the reader (if present) may be configured to read information from the machine readable data source non-wirelessly, e.g., using a direct electrical connection between the main body 120 and consumable 150.

The orientation sensor 135 is configured to detect a current orientation of the device. The orientation may be relative to a reference direction, which may be the direction gravity or some other predetermined or settable reference orientation. The orientation sensor may comprise an accelerometer, gyroscope and/or a magnetometer.

The orientation sensor 135 may comprise an electromechanical device that measures acceleration forces, and provides a measure of "proper acceleration", which is the acceleration of a body or object, relative to free fall. Some accelerometers are configured to measure static acceleration forces, like the continuous force of gravity. In one example, the orientation sensor 135 may be an accelerometer configured to measure dynamic acceleration forces, and so can sense movement or vibrations. The accelerometer may be configured to measure acceleration and its outputs may be used to determine orientation factors such as tilt, tilt angle, and incline. It may also be configured to determine actions or events such as rotation, vibration and collision. The accelerometer may be a piezoelectric accelerometer. However other types of accelerometer may be used in a smoking substitute device, such as a capacitance accelerometer. In brief; a piezoelectric accelerometer uses microscopic crystal structures that become stressed due to accelerative forces. These crystals create a voltage from the stress, and the accelerometer outputs a voltage, which can be used to determine velocity and orientation. The accelerometer comprises a three-axis model, to enable it to sense rotational tilt, as well as movement in a two-dimensional plane.

In this disclosure, the orientation sensor 135 is used to determine an amount of tilt or incline of the smoking substitute device, and therefore of the tank 156 which is housed therein, away from a substantially upright position. In this embodiment, the smoking substitute device is physically configured so that, when the consumable 150 is inserted correctly into the main body 120 of the smoking substitute device 110, the tank 156 within the consumable 150 is substantially upright—and so the top level of the liquid in the tank 156 is substantially flat or horizontal—when the main body 120 of the device 110 is upright. Of course, in other embodiments there could be a different physical configuration, in which the tank is at an incline to the vertical (or upright) axis of the main body of the smoking substitute device. In such an embodiment, the control means would account for this relative positioning, when using the orientation and liquid-level measurements to determine an accurate fill level for the tank.

In this embodiment, the orientation sensor 135 is configured to detect movement and relative positioning of the smoking substitute device 110, for example relative to a reference position such as its upright position, and to provide one or more voltage outputs to the control unit 130, within the smoking substitute device 110, as a result of what it has detected. For example, when the orientation sensor 135 detects that the smoking substitute device 110 has moved such as to be inclined relative to its upright position, the orientation sensor 135 transmits a corresponding voltage signal to the control unit 130. The control unit 130 can then control the memory 132 of the smoking substitute device 110 to store (at least temporarily) a measure of the voltage signal, along with an indicator of the time at which it was received.

As shown in FIG. 8B, the consumable 150 includes the tank 156, an electrical interface 160, a heating device 162, one or more air inlets 164, a mouthpiece 166, and, optionally, one or more additional components 168.

The electrical interface 160 of the consumable 150 may include one or more electrical contacts. The electrical interface 136 of the main body 120 and an electrical interface 160 of the consumable 150 are preferably configured to contact each other and therefore electrically couple the main body 120 to the consumable 150 when the main body 120 is physically coupled to the consumable 150. In this way, electrical energy (e.g., in the form of an electrical current) is able to be supplied from the power source 128 in the main body 120 to the heating device 162 in the consumable 150.

The heating device 162 is preferably configured to heat e-liquid contained in the tank 156, e.g., using electrical energy supplied from the power source 128. In one example, the heating device 162 may include a heating filament and a wick 159, wherein a first portion of the wick extends into the tank 156 in order to draw e-liquid out from the tank 156, and wherein the heating filament coils around a second portion of the wick located outside the tank 156. In this example, the heating filament is configured to heat up e-liquid drawn out of the tank 156 by the wick to produce an aerosol vapor.

The one or more air inlets 164 are preferably configured to allow air to be drawn into the smoking substitute device 110, when a user inhales through the mouthpiece 166.

The additional components 168 of the consumable 150 may include a machine readable data source, which may e.g., be contained in the body of, or attached to the consumable 150. The machine readable data source may store information associated with the consumable. The information associated with the consumable may include information concerning the content of the consumable (e.g., e-liquid type, batch number) and/or a unique identifier, for example.

The machine readable data source may be rewritable, e.g., a rewritable RFID chip, or read only, e.g., a visual data source such as a barcode. As indicated above, the additional components 138 of the main body 120 may include a reader configured to read information associated with the consumable from the machine readable data source.

In use, a user activates the smoking substitute device 110, e.g., through actuating an actuator included in the main body 120 or by inhaling through the mouthpiece 166 as described above. Upon activation, the control unit 130 may supply electrical energy from the power source 128 to the heating device 162 (via electrical interfaces 136, 166), which may cause the heating device 162 to heat e-liquid drawn from the tank 156 to produce a vapor which is inhaled by a user through the mouthpiece 166.

In the present example, the consumable 150 includes a liquid level sensor 157, which may be disposed in or adjacent the tank 156 and operably engaged with an internal volume of the tank to detect a fill level thereof. Knowledge of the fill level can enable a user to known how much longer he or she can continue to use the smoking substitute device for smoking substitute action (i.e., how many more inhalations he or she can make using the device) before the consumable 150 will have to be replaced or before the fill level of the tank 156 in the consumable 150 will reach such a low level that smoking substitute action may be difficult, inadequate or even unpleasant. For example, an unpleasant taste can be created when the user takes a so-called 'dry hit' from a smoking substitute device, in which the heating filament heats the wick 159 without any liquid.

The liquid level sensor 157 may be used instead of or in addition to a window that permits visual inspection of liquid in the tank. For example, at least in so-called 'clearomizer' embodiments, the user may be able to see the remaining liquid level in the consumable of his or her smoking substitute device. However, it can be appreciated that such an approach may be quite approximate. It also relies on the window giving the user visual access to the entire tank, top-to-bottom, which is potentially difficult to provide in practice in a physically quite compact consumable. Furthermore, since the user inherently does not look at his or her smoking substitute device during smoking substitute action, because the device will be located at and below the user's mouth level, a user is likely to find it inconvenient to rely solely on visual inspection (or trial and error) in order to determine whether and when a consumable must be replaced for his or her smoking substitute device.

The liquid level sensor 157 may comprise a capacitive probe, which is located within the tank 156 of the consumable 150. For example, the tank 156 may be configured such that at least a portion of one inner wall thereof comprises a metal. The capacitive probe may include a metal shaft inserted along the length of the tank. The shaft and the inner wall are electrically connected in a manner that causes them to resemble or behave as a capacitor, i.e., as spaced parallel conductive structures, similar to capacitor plates. In this arrangement, a dielectric medium between the plates is formed by a combination of air and e-liquid in the tank 156. As the skilled reader will recognize, the e-liquid and the air will have different respective inherent dielectric permittivity values (or dielectric constants (ε)). Therefore, as the fill level of e-liquid within the tank 156 changes, so too will the overall dielectric permittivity of the medium within the capacitor and so the output capacitance will change.

The capacitive probe is configured to electrically connect to the control unit 130, via the electrical interfaces 136, 160 of the consumable 150 and the smoking substitute device 110. Therefore, the control unit 130 can receive a signal indicative of the capacitance values of the probe to determine a corresponding fill levels for the tank 156. The control unit 130 may assign time values to the received signals, so that they can be stored in the memory 132 in connection with their time values, and/or used in conjunction with other operating data for the same time—which may be an instantaneous time or may be a time period.

When the smoking substitute device is network-enabled and configured to communicate with an application installed on a mobile device, the application may also make use of information from the liquid level sensor 157 (i.e., information indicative of a fill level of the consumable 150) received from the smoking substitute device. The control unit 130 in the main body 120 may be arranged to receive data from the liquid level sensor via a communication link that runs through the electrical interfaces 136,160, for example. The application may be configured to automatically link to an online facility for purchasing replacement consumables when the fill level of the tank 156 within the current consumable 150 (or the fill level of the tank within a pre-determined one of a previously purchased batch of consumables) falls below a pre-determined level.

Of course, a skilled reader would readily appreciate that the smoking substitute device 110 shown in FIGS. 7A-7C and 8A-8B shows just one example implementation of a smoking substitute device, and that other forms of smoking substitute device could be used as the smoking substitute device 10 of FIG. 6.

By way of example, a HNB smoking substitute device including a main body and a consumable could be used as the smoking substitute device 10 of FIG. 6, instead of the smoking substitute device 110. One such HNB smoking substitute device is the IQOS™ smoking substitute device discussed above.

As another example, an open system vaping device which includes a main body, a refillable tank, and a mouthpiece could be used as the smoking substitute device 10 of FIG. 6, instead of the smoking substitute device 110. One such open system vaping device is the blu PRO™ e-cigarette discussed above.

As another example, an entirely disposable (one use) smoking substitute device could be used as the smoking substitute device 10 of FIG. 6, instead of the smoking substitute device 110.

Embodiments of the present disclosure relate to the accurate determination of the tank fill level. Although the description above relates to a "closed system" type smoking substitute device, in which the smoking substitute device is arranged to mechanically and electrically interface with a consumable or "pod", it will be appreciated that the present disclosure is not limited to that particular type of smoking substitute device and corresponding consumable but could be applied to other types as well.

The present disclosure provides an accurate means for determining a fill level for a smoking substitute device through the inclusion of both an orientation sensor and a liquid level sensor in the smoking substitute device and/or in the consumable which inserts into a smoking substitute device.

According to the present embodiment, the control unit 130 is configured to obtain a signal from the liquid level sensor 157 on a periodic or ad hoc basis. The control unit 130 is configured to obtain a orientation signal from the orientation sensor 135 when a signal from the liquid level sensor 157 is obtained. In this way, the sensed liquid level may always be associated with a detected orientation. In other examples, the control unit 130 may operate to derive or estimate an orientation based on the most recent available measurement.

In one example, when the control unit 130 receive a signal from the liquid level sensor 157, it judges, based on the corresponding orientation signal, whether or not the smoking substitute device 110 is upright at that time. If the orientation signal from the orientation sensor 135 indicates that the smoking substitute device 110 was upright at the time, or could have been deemed to have been upright within a pre-determined acceptable margin of error, then it can use the signal from the liquid level sensor 157 directly in order to determine a fill level for the tank 156 at that time. The control unit 130 may include or have access to calibration data or some other look up data structure that transforms the signal from the liquid level sensor 157 to a fill level. The fill level may be displayed on the device using a suitable indicator (e.g., LED or LCD) or may be communicated, e.g., using the wireless interface 134, for display on the application running on the mobile device.

If the orientation signal from the orientation sensor 135 indicates that the smoking substitute device 110 was not upright or not sufficiently upright at the time at which the signal from the liquid level sensor 157 was measured, the control unit 130 may be configured to determine a corrected fill level based on the signal from the liquid level sensor 157 and received orientation signal. For example, if the orientation signal indicates that the smoking substitute device was tilted, so that the height, in a substantially vertical plane, of the upper surface of the e-liquid in the tank 156 was not uniform, when viewed along a left-to-right horizontal plane, the control unit 130 may apply an algorithm or look up function to correct the fill level to what it would be if the device was held upright and therefore the height of the e-liquid in the tank 156 had been uniform across its upper surface.

The algorithm may operate in any suitable manner. For example, it may correct the signal output by the liquid level sensor 157 before a fill level is obtained from that signal. Alternatively, it may correct the fill level itself. The algorithm may be established based on measurements obtained in advance, which are indicative of the effect of orientation on output of the sensor. Alternatively, the algorithm may be configured to construct a virtual model of the tank using pre-stored information about tank dimensions together with information from the orientation sensor. In conjunction with pre-stored knowledge about the location of a probe of the liquid level sensor 157 in the tank, the algorithm may be able to determine a volume of liquid in the tank using a signal from the liquid level sensor 157 and a signal from the orientation sensor 135, wherein the determined volume of liquid is used to obtain the fill level that is communicated or displayed to the user. In examples where the probe of the liquid level sensor is not symmetrically mounted in the tank, the algorithm may make use of an orientation signal that includes not only the angle or extent of tilt of the device but also the direction of the tilt.

In one example, instead of correcting the signal output by the liquid level sensor at times at which the smoking substitute device is determined to have been tilted, the control unit may instead be configured to ignore such signals and wait until it next receives a signal output by the liquid level sensor at a time at which the smoking substitute device is not tilted. The smoking substitute device may include means for indicating to a user that the device is not upright.

Referring back to FIG. 8A, the additional components 138 of the smoking substitute device 110 may also comprises a visual display, e.g., comprises an LCD or LED display. The smoking substitute device 110 may be configured so that the tank fill level can be displayed on the visual display. The tank fill level need not be permanently displayed on the visual display but can be displayed in response to a user command, for example by actuating a switch on the smoking substitute device. In addition, the control unit 130 is configured to store or access a predetermined threshold value that indicates that the fill level of the tank is low, such that the present consumable will soon have to be replaced. When it is determined that the fill level of the tank has reached or gone below this predetermined threshold value, a warning will be issued to the user via the visual display.

As mentioned above, the smoking substitute device 110 may have an establish bonded wireless communication link to a mobile device and can provide data to an application running on that mobile device. The data provided to the application can include fill level data as determined by the control unit 130. In a variation of the present embodiment, the raw capacitance and orientation measurements obtained by the liquid level sensor 157 and orientation sensor 135 respectively can be sent to the application, so that processing capability on the mobile device on which the application runs is used to determine tank fill level. The application may be configured to provide fill level data to the user either automatically and/or in response to a user request. The application may also be configured to output a warning to the user via an output of the mobile device to warn the user that the tank fill level is low, for example below a predetermined low threshold value.

FIG. 9 is a flow diagram depicting steps in a method 400 carried out by the components of the smoking substitute device and its consumable according to the above described embodiment of the present disclosure.

At step 402, the liquid-level sensor detects a level of liquid in the tank. This is done by a capacitive probe in this embodiment, but other types of liquid level sensors could be used to perform this task, e.g., optical sensors, ultrasonic sensors, etc.

At step 404, a liquid level measurement is transmitted from the liquid-level sensor to the control unit. The control unit may comprise a microprocessor located within the smoking substitute device. Alternatively, or additionally, the liquid level measurement may be transmitted to an application or to a server for use in a subsequent determination. As the skilled reader will appreciate, any suitable electrical components and software may be used in the smoking substitute device in order to provide a connection between the liquid level sensor and control unit.

At step 406, the orientation sensor detects an orientation of the smoking substitute device. For example, it may obtain one or more orientation measurements regarding absolute or relative position of the device and/or measurements of movement of the device away from a reference position. In this embodiment the orientation sensor is an accelerometer, but other types of orientation sensor could be used to perform this task.

At step 408, an orientation measurement is transmitted from the orientation sensor to the control unit. As the skilled reader will appreciate, any suitable electrical components and software may be used in the smoking substitute device in order to provide a connection between the orientation sensor and control unit.

At step 410, the control unit modifies the liquid level measurement transmitted by the liquid-level sensor, based on the orientation measurement transmitted by the orientation sensor, to determine a tank fill level. This modification may comprise applying an algorithm to the liquid level measurement or changing it in accordance with values in a pre-stored database. Or the modification may include discarding or ignoring the liquid level measurement, based on an assessment that the tilt of the device at the time was too great for it to be reliable.

Step 412 is an optional step, in which a tank fill level is output to the user, via a visual display. As mentioned above, the smoking substitute device in this particular embodiment may have a screen via which to display tank fill level but it will not do so at all times. it will only do so in response to a user request to see the tank fill level and when the tank fill level has reached or passed a predetermined low threshold, at which point a suitable warning will be issued to the user via the screen. As also mentioned already above, the output to the user of tank fill level data could instead be done by the mobile device which is in wireless communication with the smoking substitute device.

Thus, a reliable and efficient means is provided for accurately monitoring the tank fill level for a smoking substitute device and for providing tank fill level data to the user. This is achieved using components that are physically small and compact enough to be readily incorporated into a smoking substitute device and or a consumable for a smoking substitute device consumable, without requiring significant additional physical space or without adding significantly to the size, weight or cost of the device or the consumable. The method employed to provide accurate tank fill level data is computationally streamlined and does not present an undue processing burden on the control unit of a smoking substitute device.

Whilst a particular embodiment has been shown and described in detail herein, it will be appreciated that variations can be made to the physical details without departing from the described disclosure. For example, an alternative type of capacitive probe may be used which has a substantially cylindrical inner rod and an outer shell, concentric with one another, with a gap between the inner rod and the outer shell, wherein a capacitor is formed between the inner rod and the outer shell. In use, when such a capacitive probe is inserted into the tank of a smoking substitute consumable, e-liquid from the tank will flow up into the gap between the inner rod and the outer shell, therefore enabling the e-liquid to displace air as part of the dielectric medium between the inner rod and the outer shell. In such an embodiment, there is no need for part of the tank inner wall to be metal.

The terms 'liquid level sensor', 'orientation sensor', 'tank fill level;' and so on are intended to be illustrative of the functions on the relevant component and need not to be limited to specific types of device.

The smoking substitute device does not have to form a bonded wireless communication link with the mobile device on which the application ins installed. But there should preferably be some security or identification steps followed, before the smoking substitute device accepts firmware update messages from the application, via the wireless interface of a mobile device.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

The following statements, which form part of the description, provide general expressions of the disclosure herein:

B1. A smoking substitute device comprising:

a tank for containing a liquid;

a liquid-level sensor for detecting a level of liquid in the tank;

an orientation sensor for detecting an orientation of the smoking substitute device; and a control unit, wherein the control unit is configured to determine an amount of liquid in the tank by modifying a liquid level measurement detected by the liquid-level sensor using an orientation measurement detected by the orientation sensor.

B2. The smoking substitute device of statement B1, wherein the control unit inputs the liquid level measurement and the orientation measurement to an algorithm whose output is a modified liquid level measurement.

B3. The smoking substitute device of statement B1 or B2 further comprising a memory storing a look-up table, wherein the control unit is configured to look up a liquid level adjustment from the look-up table using the orientation measurement, and apply the liquid level adjustment to the liquid level measurement detected by the liquid-level sensor.

B4. The smoking substitute device of statement B3, wherein the look-up table comprises a list of predetermined liquid level adjustments associated with corresponding orientation values.

B5. The smoking substitute device of statement B4, wherein the control unit is configured to find an orientation value that corresponds to the orientation measurement, and apply the liquid level adjustment associated with that orientation value to the liquid level measurement.

B6. The smoking substitute device of any preceding statement, wherein the liquid comprises any of: a vaporizable e-liquid, or an aerosolizable flavoring.

B7. The smoking substitute device of any preceding statement, wherein the tank comprises a refillable reservoir or a consumable pod.

B8. The smoking substitute device of any preceding statement comprising a main body that houses the control unit, wherein the tank and liquid-level sensor are in a consumable pod that is detachably mountable to the main body, wherein the main body and the consumable pod each include an electrical interface, where the electrical interfaces are connected when the consumable pod is mounted to the main body, and wherein the liquid-liquid sensor is configured to communicate the liquid level measurement to the control unit via the electrical interfaces.

B9. The smoking substitute device of any preceding statement, further comprising a display means configured to display an amount of liquid, as determined by control unit.

B10. The smoking substitute device of any preceding statement further comprising a wireless interface configured to wirelessly communicate with an application installed on a mobile device.

B11. The smoking substitute device of any preceding statement wherein the liquid level sensor comprises a capacitance sensor.

B12. The smoking substitute device of any preceding statement wherein the orientation sensor comprises any of: an accelerometer, a gyroscope or a magnetometer.

B13. A computer-implemented method for managing a smoking substitute device, the method comprising:

detecting, using a liquid-level sensor, a level of liquid in a tank in the smoking substitute device;

communicating a liquid level measurement from the liquid-level sensor to a control unit of the smoking substitute device;

detecting, using an orientation sensor, an orientation of the smoking substitute device;

communicating an orientation measurement from the orientation sensor to the control unit; and determining, by the control unit, an amount of liquid in the tank by modifying the liquid level measurement transmitted by the liquid-level sensor using the orientation measurement transmitted by the orientation sensor.

B14. A computer-implemented method for managing a smoking substitute device, the method comprising:

receiving a liquid level measurement obtained by a liquid-level sensor in a tank in the smoking substitute device;

receiving an orientation measurement obtained by an orientation sensor of the smoking substitute device; and determining an amount of liquid in the tank by modifying the liquid level measurement using the orientation measurement.

B15. A computer readable medium containing instructions configured to, when executed by processor, perform the method of statement B13 or statement B14.

PART C (P01012EP)

Technical Field

The present disclosure relates to smoking substitute devices and particularly, although not exclusively, to apparatus and methods for controlling operation of a smoking substitute device.

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Conventional combustible smoking articles, such as cigarettes, typically comprise a cylindrical rod of tobacco comprising shreds of tobacco which is surrounded by a wrapper, and usually also a cylindrical filter axially aligned in an abutting relationship with the wrapped tobacco rod. The filter typically comprises a filtration material which is circumscribed by a plug wrap. The wrapped tobacco rod and the filter are joined together by a wrapped band of tipping paper that circumscribes the entire length of the filter and an adjacent portion of the wrapped tobacco rod. A conventional cigarette of this type is used by lighting the end opposite to the filter, and burning the tobacco rod. The smoker receives mainstream smoke into their mouth by drawing on the mouth end or filter end of the cigarette.

Combustion of organic material such as tobacco is known to produce tar and other potentially harmful by-products. There have been proposed various smoking substitute devices in order to avoid the smoking of tobacco.

Such smoking substitute devices can form part of nicotine replacement therapies aimed at people who wish to stop smoking and overcome a dependence on nicotine.

Smoking substitute devices may comprise electronic systems that permit a user to simulate the act of smoking by producing an aerosol (also referred to as a "vapor") that is drawn into the lungs through the mouth (inhaled) and then exhaled. The inhaled aerosol typically bears nicotine and/or flavorings without, or with fewer of, the odor and health risks associated with traditional smoking.

In general, smoking substitute devices are intended to provide a substitute for the rituals of smoking, whilst providing the user with a similar experience and satisfaction to those experienced with traditional smoking and tobacco products. Some smoking substitute systems use smoking substitute articles (also referred to as a "consumables") that are designed to resemble a traditional cigarette and are cylindrical in form with a mouthpiece at one end.

The popularity and use of smoking substitute devices has grown rapidly in the past few years. Although originally marketed as an aid to assist habitual smokers wishing to quit tobacco smoking, consumers are increasingly viewing smoking substitute devices as desirable lifestyle accessories. Some smoking substitute devices are designed to resemble a traditional cigarette and are cylindrical in form with a mouthpiece at one end. Other smoking substitute devices do not generally resemble a cigarette (for example, the smoking substitute device may have a generally box-like form).

There are a number of different categories of smoking substitute devices, each utilizing a different smoking substitute approach. A smoking substitute approach corresponds to the manner in which the substitute system operates for a user.

One approach for a smoking substitute device is the so-called "vaping" approach, in which a vaporizable liquid, typically referred to (and referred to herein) as "e-liquid", is heated by a heating device to produce an aerosol vapor which is inhaled by a user. An e-liquid typically includes a base liquid as well as nicotine and/or flavorings. The resulting vapor therefore typically contains nicotine and/or flavorings. The base liquid may include propylene glycol and/or vegetable glycerin.

A typical vaping smoking substitute device includes a mouthpiece, a power source (typically a battery), a tank for containing e-liquid, as well as a heating device. In use, electrical energy is supplied from the power source to the heating device, which heats the e-liquid to produce an aerosol (or "vapor") which is inhaled by a user through the mouthpiece.

Vaping smoking substitute devices can be configured in a variety of ways. For example, there are "closed system" vaping smoking substitute devices which typically have a sealed tank and heating element which is pre-filled with e-liquid and is not intended to be refilled by an end user. One subset of closed system vaping smoking substitute devices include a main body which includes the power source, wherein the main body is configured to be physically and electrically coupled to a consumable including the tank and the heating element. In this way, when the tank of a consumable has been emptied, the main body can be reused by connecting it to a new consumable. Another subset of closed system vaping smoking substitute devices are completely disposable, and intended for one-use only.

There are also "open system" vaping smoking substitute devices which typically have a tank that is configured to be refilled by a user, so the device can be used multiple times.

An example vaping smoking substitute device is the Myblu™ e-cigarette. The Myblu™ e-cigarette is a closed system device which includes a main body and a consumable. The main body and consumable are physically and electrically coupled together by pushing the consumable into the main body. The main body includes a rechargeable battery. The consumable includes a mouthpiece, a sealed tank which contains e-liquid, as well as a heating device, which for this device is a heating filament coiled around a portion of a wick which is partially immersed in the e-liquid. The device is activated when a microprocessor on board the main body detects a user inhaling through the mouthpiece. When the device is activated, electrical energy is supplied from the power source to the heating device, which heats e-liquid from the tank to produce a vapor which is inhaled by a user through the mouthpiece.

Another example vaping smoking substitute device is the blu PRO™ e-cigarette. The blu PRO™ e-cigarette is an open system device which includes a main body, a (refillable) tank, and a mouthpiece. The main body and tank are physically and electrically coupled together by screwing one to the other. The mouthpiece and refillable tank are physically coupled together by screwing one to the other, and detaching the mouthpiece from the refillable tank allows the tank to be refilled with e-liquid. The device is activated by a button on the main body. When the device is activated, electrical energy is supplied from the power source to a heating device, which heats e-liquid from the tank to produce a vapor which is inhaled by a user through the mouthpiece.

Another approach for a smoking substitute system is the so-called Heated Tobacco ("HT") approach in which tobacco (rather than an "e-liquid") is heated or warmed to release vapor. HT is also known as "heat not burn" ("HNB"). The tobacco may be leaf tobacco or reconstituted tobacco. The vapor may contain nicotine and/or flavorings. In the HT approach the intention is that the tobacco is heated but not burned, i.e., the tobacco does not undergo combustion.

A typical HT smoking substitute system may include a device and a consumable. The consumable may include the tobacco material. The device and consumable may be configured to be physically coupled together. In use, heat may be imparted to the tobacco material by a heating element of the device, wherein airflow through the tobacco material causes components in the tobacco material to be released as vapor. A vapor may also be formed from a carrier in the tobacco material (this carrier may for example include propylene glycol and/or vegetable glycerin) and additionally volatile compounds released from the tobacco. The released vapor may be entrained in the airflow drawn through the tobacco.

As the vapor passes through the consumable (entrained in the airflow) from the location of vaporization to an outlet of the consumable (e.g., a mouthpiece), the vapor cools and condenses to form an aerosol for inhalation by the user. The aerosol will normally contain the volatile compounds.

In HT smoking substitute systems, heating as opposed to burning the tobacco material is believed to cause fewer, or smaller quantities, of the more harmful compounds ordinarily produced during smoking. Consequently, the HT approach may reduce the odor and/or health risks that can arise through the burning, combustion and pyrolytic degradation of tobacco.

There may be a need for improved design of smoking substitute systems, in particular HT smoking substitute systems, to enhance the user experience and improve the function of the HT smoking substitute system.

An example of the HT approach is the IQOS™ smoking substitute device from Philip Morris Ltd. The IQOS™ smoking substitute device uses a consumable, including reconstituted tobacco located in a wrapper. The consumable includes a holder incorporating a mouthpiece. The consumable may be inserted into a main body that includes a heating device. The heating device has a thermally conductive heating knife which penetrates the reconstituted tobacco of the consumable, when the consumable is inserted into the heating device. Activation of the heating device heats the heating element (in this case a heating knife), which, in turn, heats the tobacco in the consumable. The heating of the tobacco causes it to release nicotine vapor and flavorings which may be drawn through the mouthpiece by the user through inhalation.

A second example of the HT approach is the device known as "Glo"™ from British American Tobacco p.l.c. Glo™ comprises a relatively thin consumable. The consumable includes leaf tobacco which is heated by a heating device located in a main body. When the consumable is placed in the main body, the tobacco is surrounded by a heating element of the heating device. Activation of the heating device heats the heating element, which, in turn, heats the tobacco in the consumable. The heating of the tobacco causes it to release nicotine vapor and flavorings which may be drawn through the consumable by the user through inhalation. The tobacco, when heated by the heating device, is configured to produce vapor when heated rather than when burned (as in a smoking apparatus, e.g., a cigarette). The tobacco may contain high levels of aerosol formers (carrier), such as vegetable glycerin ("VG") or propylene glycol ("PG").

The present inventor(s) have observed that most smoking substitute devices currently on the market are configured to operate in isolation of other devices, which limits the functions the smoking substitute devices can perform.

The present inventor(s) have also observed that, as smoking substitute devices become more sophisticated and are able to perform more functions, certain of those functions of a smoking substitute device become important to the user, beyond the core function of heating liquid and/or tobacco. For example, the transmission of component data from a smoking substitute device to a mobile device can be an important function that the user may wish to protect and maintain during operation of the smoking substitute device. Other data acquisition, storage and transmission functions may also be important to the user.

The present disclosure has been devised in light of the above considerations.

SUMMARY OF THE DISCLOSURE

At its most general, the present disclosure provides a smoking substitute device that is configured to implement a sophisticated and technically improved shutdown or "power-off" process. The smoking substitute device embodies the recognition that, when there is insufficient battery power to provide enough heat to the heating element for it to operate at a level required by the user to provide a satisfactory smoking substitute experience, it is preferable to temporarily suspend the operation of that heating device and to instead direct remaining battery power towards enabling continued operation of one or more auxiliary components of the smoking substitute device. In particular, it may be preferable to prioritize the continued operation of data critical functions such as telemetry and/or the recordal and/or storage of data. The smoking substitute device may be network enabled in order to communicate wirelessly with a portable communication terminal such as a mobile phone or other mobile device. The smoking substitute device may be configured to provide notification to the user when the improved shutdown process is to be initiated. Such notification may be provided either directly via an output of the smoking substitute device and or it may be provided via an output of a mobile device with which the smoking substitute device communicates. The smoking substitute device may be configured to discontinue the improved shutdown process, and to resume normal operation including functioning of the heating element, upon detection that the smoking substitute device has been recharged and therefore has enough power to once again able to function normally.

According to a first aspect of the disclosure, there may be provided a smoking substitute device comprising a heating device, at least one auxiliary device configured to perform a background task, a battery configured to supply power to the heating device and the auxiliary device; and a control unit. The control unit may be configured to obtain data indicative of a state of charge of the battery. The smoking substitute device may be configured such that, if the determined state of charge meets a predetermined criterion indicating that the state of charge is inadequate to permit normal operation of the heating device, the control unit will prevent the supply of power to the heating device whilst continuing the supply of power to the at least one auxiliary device.

The "prevention" of the supply of power to the heating device, by the control unit, need not be a permanent or irreversible prevention. Rather, it may be a pausing, or a temporary suspension, of that supply, until such a time that it is determined that the state of charge of the battery is sufficient to resume supply of power to the heating device, and to permit normal operation of the heating device. The control unit should therefore be configured to reversibly switch the power supply away from the heating device, when the predetermined criterion is met.

The temporary prevention of the power supply to the heating device may be implemented by any suitable means. For example, it may compromise the control unit operating a switch to effectively "switch off" the power supply to the heating device, or it may comprise temporarily rerouting or blocking the current flow to the heating device. The steps taken to prevent power supply to the heating device should be temporary, and reversible, so that the heating device can resume normal operation, once the device's battery is charged to a sufficient level as to support such normal operation.

The so-called "auxiliary device" may comprise any suitable component, within the smoking substitute device, other than the heating device. The function, or one of the functions, carried out by such a component can be regarded as its "background task". For example, the auxiliary device may comprise a telemetry means such as a wireless interface, for example a Bluetooth™ antenna, and one of its background tasks may comprise effecting wireless communication between the smoking substitute device and a mobile device such as a mobile phone, smart phone, tablet computer or laptop computer. In such an example, the background task of communicating with a mobile device may comprise transmitting operational data regarding other components of the smoking substitute device—such as, for example, indicators of battery charge level (discussed further below), usage information derived from an airflow sensor, and/or consumable data obtained by a consumable data reader within the smoking substitute device.

Another example of an auxiliary device is an air flow sensor, for which an associated background task is to sense air flow, i.e., to sense an inhale action by the user. In some embodiments, the air flow sensor has an additional background task of providing sensor information to a control unit, in order to activate operation of the smoking substitute device when an inhale is sensed. For example, a smoking substitute device may be provided without an on/off button but instead rely on the air flow sensor to activate operation.

Another example of an auxiliary device is a consumable data reader. This may comprise any suitable electronic reader such as a barcode reader, for which an associated "background task" is to read information from a consumable (or "refill" or "pod") that is inserted into, or otherwise connected to, the smoking substitute device. A further background task of the consumable data reader may be to transmit data to a memory within the smoking substitute device, and/or to a control unit such as a microprocessor therein.

Another example of an auxiliary device is a memory, such as a non-volatile memory. Its background task may be to log operational data and/or usage data. For example, the memory may include a buffer, for which a background task is to repeatedly/cyclically log new data and delete the oldest data stored thereon. It may also have a background task of transferring data to a more permanent memory means. The memory may also have a background task of communicating with a control unit, which itself may also be regarded as an auxiliary device within the smoking substitute device, and/or to the wireless interface, for subsequent transmission of data to a mobile device. The control unit may carry out a number of background tasks such as using operational data received from the memory or from other components and manipulating that data to provide statistical data and/or other forms of data that represent how the device is operating, and possibly to detect any operation errors or faults or dangers. The control unit may also perform a background task of transferring data to the memory and/or to the wireless interface.

The step of "obtaining data indicative of a state of charge of the battery", at the control unit, may comprise obtaining one or measurements from one or more components within the smoking substitute device. They could be raw data measurements, obtained e.g., from sensors, and/or they could be the results of calculations or determinations made by analogue components within the smoking substitute device, based on raw data measurements.

Alternatively or additionally, the step of "obtaining data indicative of a state of charge of the battery", at the control unit, may comprise the control unit receiving, via the wireless interface, data measurements and/or the results of calculations or determinations that have been made by a second control means, external to the smoking substitute device.

The step of 'determining' whether a state of charge of the battery meets a predetermined criterion may be carried out by the control unit of the smoking substitute device. Alternatively, it may be carried by a second control unit, external to the smoking substitute device. Such a second control unit may comprise any combination of hardware and/or software and may be comprised within any of: a mobile device that is in wireless communication with the smoking substitute device, an application running on a mobile device and a cloud-based application.

For example, components such as sensors within the smoking substitute device may be configured to transmit raw measurement data to the wireless interface, for onward transmission to a mobile device on which an appropriate application is installed. Calculations may then be carried out externally to the smoking substitute device, at the mobile device or in the "cloud", using that raw measurement data. For example, the determination of whether the state of charge of the battery meets a predetermined criterion may be made at the mobile device or "cloud", based on raw data received from the wireless interface of the smoking substitute device. The result of that determination can then be transmitted back to the control unit of the smoking substitute device, via the wireless interface, in order for the control unit to carry out the step of temporarily preventing power supply to the hearting device, when the predetermined criterion is met.

The smoking substitute device may be controlled to monitor, analyze and/or determine other component data, which might also be referred to as "auxiliary data", in addition to battery charge status data. For example, it may monitor, analyze and/or determine data pertaining to one or more of the auxiliary devices, examples of which are given above. For example, it may store data read by the consumable data reader, and/or it may transmit some or all of that data to a mobile device, via its wireless interface. It may also monitor, store and/or transmit data obtained from the airflow sensor. For example, that data may be used to determine—either within the control unit of the smoking substitute device or at a linked mobile device—statistics relating to usage including frequency, usage patterns and user preferences.

The heating device may comprise a heating element. The smoking substitute device may comprise battery monitoring circuitry configured to monitor a voltage provided by the battery, wherein that voltage is regarded as being indicative of the state of charge of the battery. The battery monitoring circuitry may comprise any suitable components configured to sense, measure or otherwise obtain data indicative of an output voltage of the battery, i.e., a voltage applied to power the heating device. The smoking substitute may comprise a Low Dropout (LDO) voltage regulator, for example a 3V LDO voltage regulator.

The smoking substitute device may be configured such that the predetermined criterion is deemed to have been met when the magnitude of a voltage provided by the battery is equal to or less than a predetermined threshold. That predetermined threshold may be set or selected in order to be greater than the magnitude of a drop out voltage. For example, the drop out voltage may comprise a voltage differential required between the input and output terminals of an LDO voltage regulator in order to provide full power to components of the smoking substitute device, such as the battery. The magnitude of the drop out voltage may be set or selected as being the voltage at which a user of the smoking substitute device would detect that the heating device of smoking substitute device is no longer functioning normally, for example due to a reduction in the amount of vapor produced during a smoking substitute action. The magnitude of the drop out voltage may be set or selected as being the voltage at which it is no longer possible for the heating device to function within defined operational parameters of the smoking substitute device. For example, it may be the voltage at which the battery can no longer supply a defined amount of heating power to the heating device.

The magnitude of predetermined threshold may be set or selected to be less than 1V greater than that of a drop out voltage. For example, if the drop out voltage is 3V, the magnitude of predetermined threshold may be a value in the range 3.1V-3.3V.

As mentioned above, the at least one auxiliary device may include any one or more of: a control unit, a memory, a wireless interface, a Bluetooth antenna, a light, an LED and an airflow sensor. The smoking substitute device may be configured to continue power supply to one or more of the auxiliary devices during a time period in which the provision of power supply to the heating device has been suspended.

The at least one auxiliary device may be configured to record and/or store auxiliary data, during part or all of a time period in which the control unit prevents the supply of power to the heating device. For example, it may log, move or store telemetry data.

The smoking substitute device may be configured for provision of a notification to a user, when the predetermined criterion is met. That notification may be provided directly, by the smoking substitute device itself, to the user. The notification may comprise any combination of visual, audible and readable signals. For example, the notification may be provided via any of: a light, an LED or a screen, comprised within the smoking substitute device.

The smoking substitute device may be configured for transfer of data to a mobile device, such as a mobile phone, tablet or laptop. It may further be configured to receive data or other signals from a mobile device. When the smoking substitute device is configured for provision of a notification to a user, when the predetermined criterion is met, that notification may be provided to the user via an output of the mobile device. The smoking substitute device may be configured for transfer of data to an application running on the mobile device and the application may prompt provision of the notification to the user, via an output of the mobile device. The application may be a cloud-based or other virtual application.

According to another aspect of the disclosure, a method is provided for controlling an operation of a smoking substitute device, wherein said smoking substitute device comprises a heating device, at least one auxiliary device configured to perform a background task, a battery configured to supply power to the heating device and the auxiliary device, and a control unit. The method comprises obtaining, at the control unit, data indicative of a state of charge of the battery; determining whether or not the determined state of charge meets a predetermined criterion indicating that the state of charge is inadequate to permit normal operation of the heating device; and, if the determined state of charge meets the predetermined criterion, configuring the control unit to prevent the supply of power to the heating device whilst continuing the supply of power to the at least one auxiliary device.

As mentioned above, the control unit may obtain data indicative of a state of charge of the battery directly form components within the smoking substitute device, or from a mobile device, via a wireless interface of the smoking substitute device. The control unit may carry out the step of determining whether or not the determined state of charge meets a predetermined criterion, or that determination may be made by a second control unit, external to the smoking substitute device.

The disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

SUMMARY OF THE FIGURES

Figure 10:
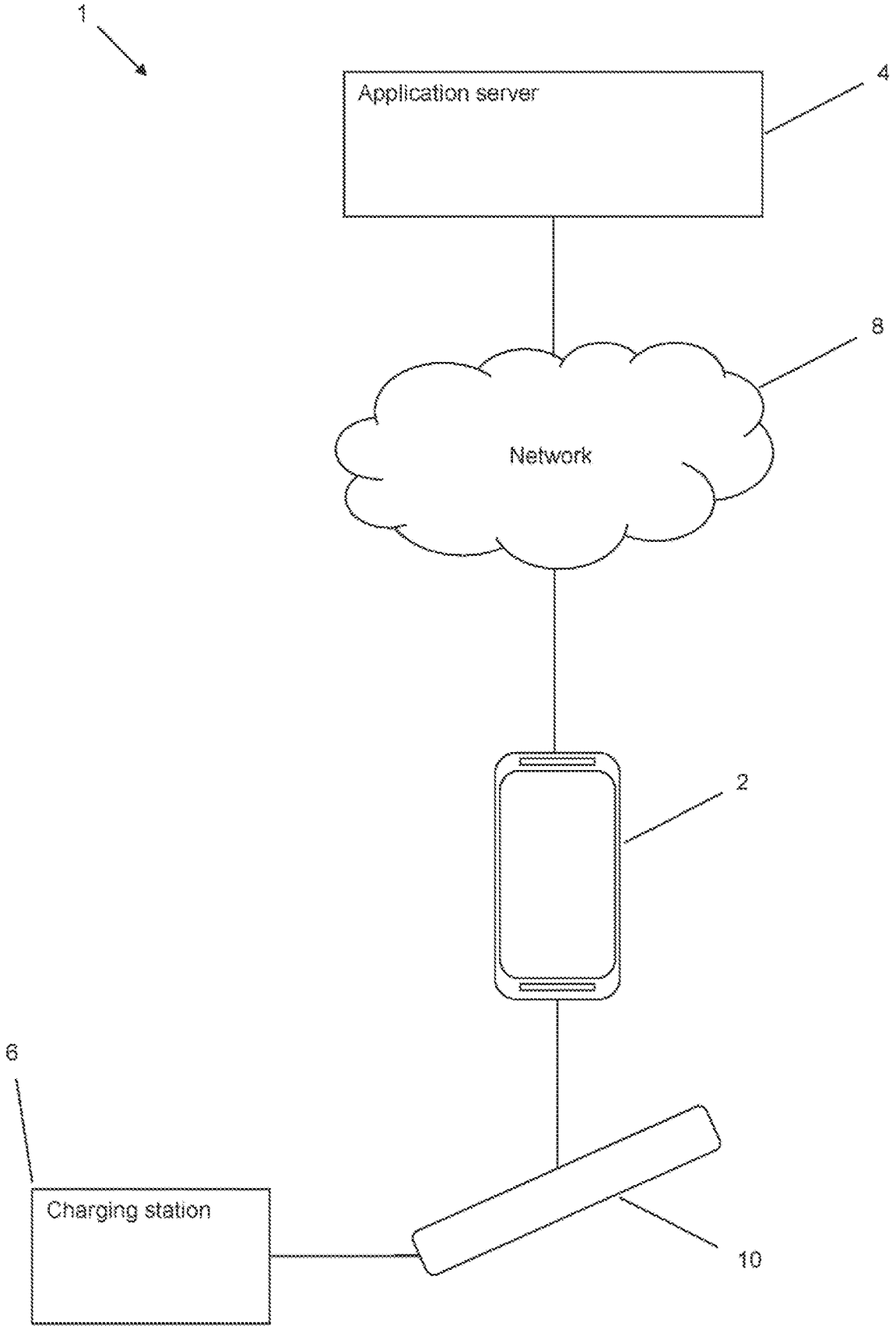

Embodiments and experiments illustrating the principles of the disclosure will now be discussed with reference to the accompanying figures in which:

FIG. 10 shows an example system for managing a smoking substitute device.

Figure 11A:
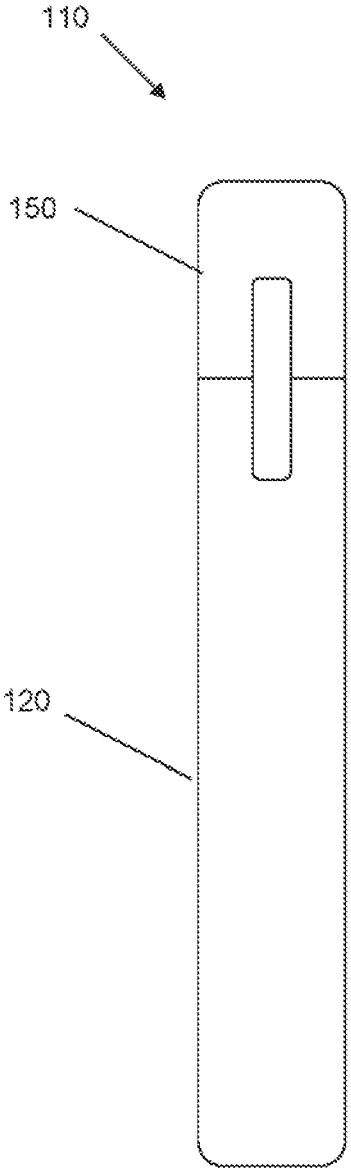

FIG. 11A shows an example smoking substitute device for use as the smoking substitute device in the system of FIG. 10.

Figure 11B:
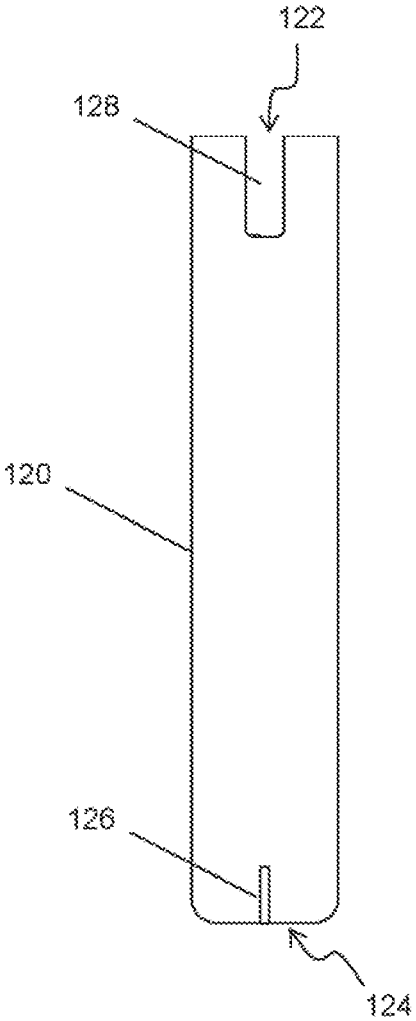

FIG. 11B shows the main body of the smoking substitute device of FIG. 11A without the consumable.

Figure 11C:
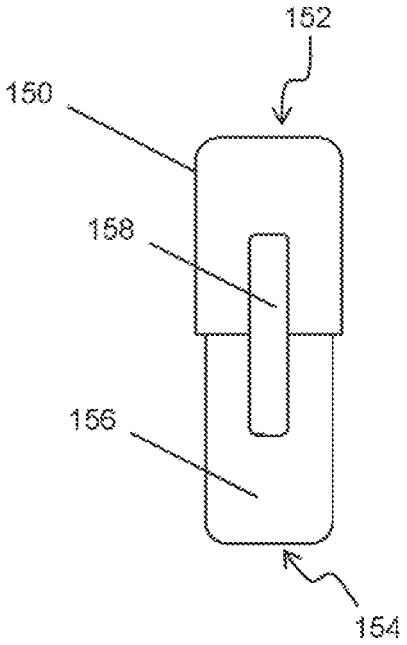

FIG. 11C shows the consumable of the smoking substitute device of FIG. 11A without the main body.

Figure 12A:
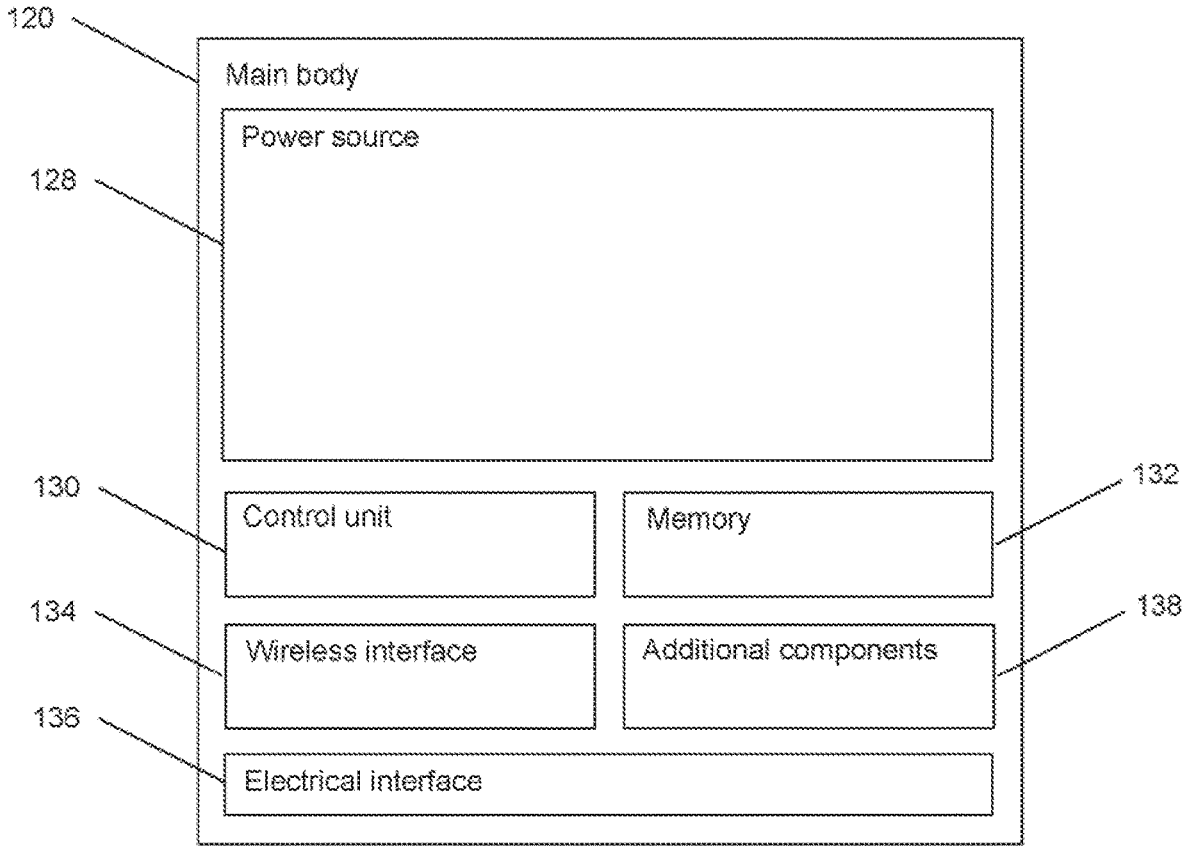

FIG. 12A is a schematic view of the main body of the smoking substitute device of FIG. 11A.

Figure 12B:
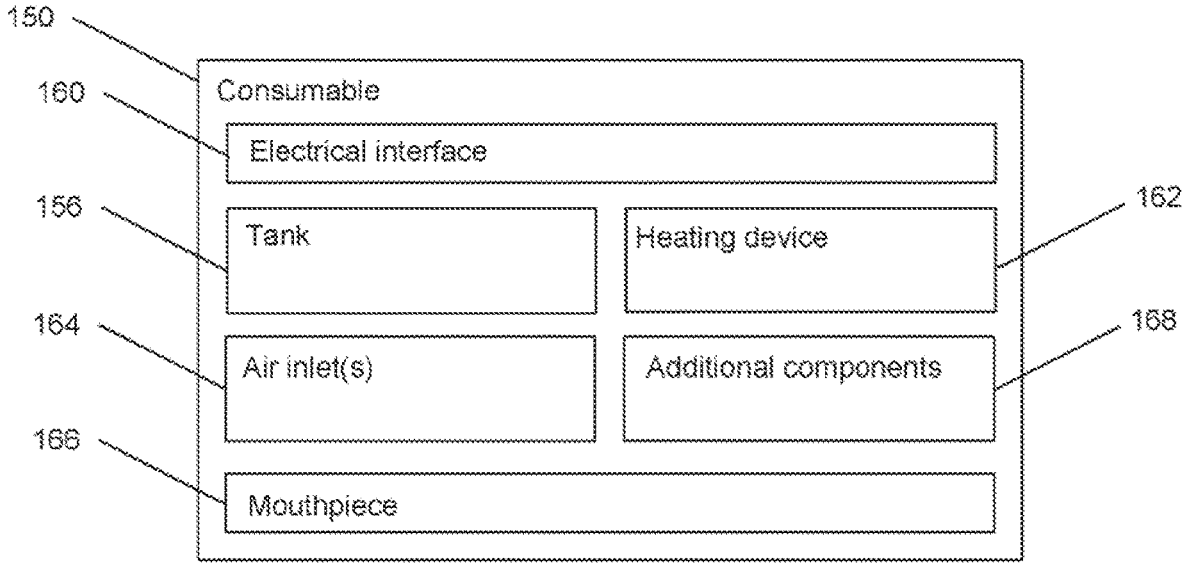

FIG. 12B is a schematic view of the consumable of the smoking substitute device of FIG. 11A.

Figure 13:
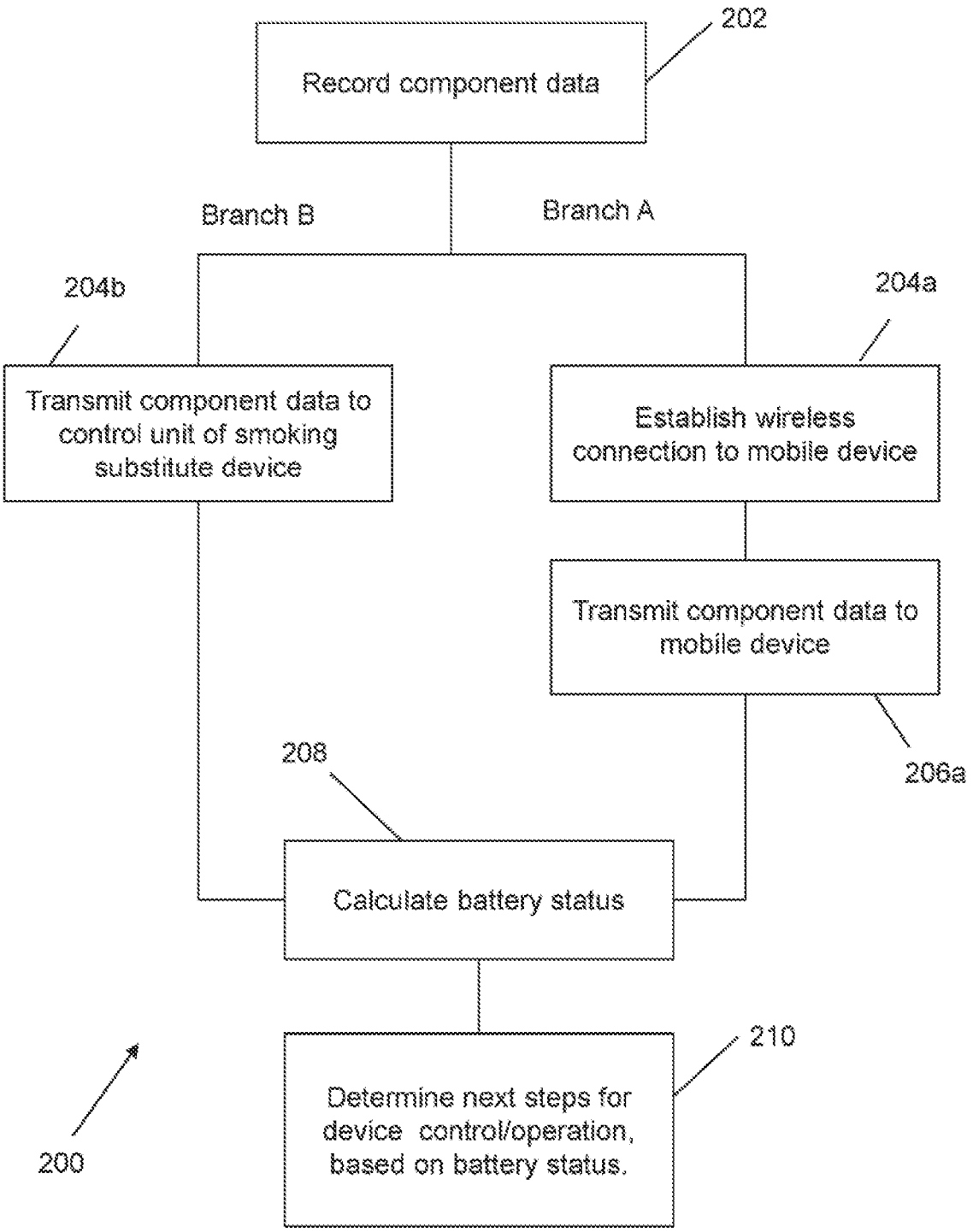

FIG. 13. is a flow chart of a component monitoring method that contributes to an embodiment of the disclosure.

Figure 14:
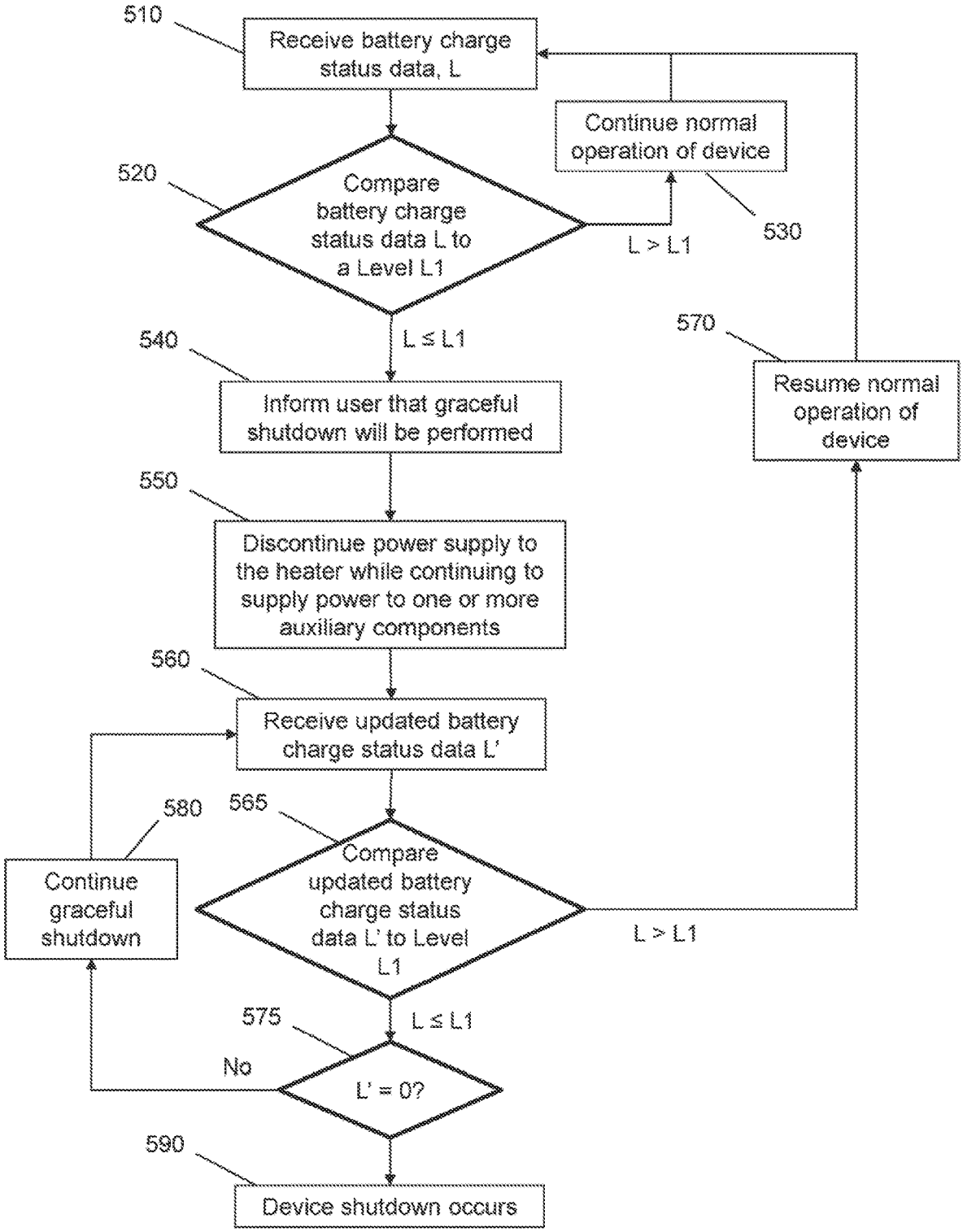

FIG. 14. is a flow chart of a battery status data comparison and device control method, for controlling operation of a smoking substitute device in accordance with an embodiment of the disclosure.

DETAILED DESCRIPTION OF THE DISCLOSURE

Aspects and embodiments of the present disclosure will now be discussed with reference to the accompanying figures. Further aspects and embodiments will be apparent to those skilled in the art. All documents mentioned in this text are incorporated herein by reference.

FIG. 10 shows an example system 1 for managing a smoking substitute device 10.

The system 1 as shown in FIG. 10 includes a mobile device 2, an application server 4, an optional charging station 6, as well as the smoking substitute device 10.

The smoking substitute device 10 is configured to communicate wirelessly, e.g., via Bluetooth™, with an application (or "app") installed on the mobile device 2, e.g., via a suitable wireless interface (not shown) on the mobile device 2. The mobile device 2 may be a mobile phone, for example. The application on the mobile phone is configured to communicate with the application server 4, via a network 8. The application server 4 may utilize cloud storage, for example.

The network 8 may include a cellular network and/or the internet.

A skilled person would readily appreciate that the mobile device 2 may be configured to communicate via the network 8 according to various communication channels, preferably a wireless communication channel such as via a cellular network (e.g., according to a standard protocol, such as 3G or 4G) or via a Wi-Fi network.

The app installed on the mobile device and the application server 4 may be configured to assist a user with their smoking substitute device 10, based on information communicated between the smoking substitute device 10 and the app and/or information communicated between the app and the application server 4.

The charging station 6 (if present) may be configured to charge (and optionally communicate with) the smoking substitute device 10, via a charging port on the smoking substitute device 10. The charging port on the smoking substitute device 10 may be a USB port, for example, which may allow the smoking substitute device to be charged by any USB-compatible device capable of delivering power to the smoking substitute device 10 via a suitable USB cable (in this case the USB-compatible device would be acting as the charging station 6). Alternatively, the charging station could be a docking station specifically configured to dock with the smoking substitute device 10 and charge the smoking substitute device 10 via the charging port on the smoking substitute device 10.

FIG. 11A shows an example smoking substitute device 110 for use as the smoking substitute device 10 in the system 1 of FIG. 10.

In this example, the smoking substitute device 110 includes a main body 120 and a consumable 150. The consumable 150 may alternatively be referred to as a "pod".

In this example, the smoking substitute device 110 is a closed system vaping device, wherein the consumable 150 includes a sealed tank 156 and is intended for one-use only.

FIG. 11A shows the smoking substitute device 110 with the main body 120 physically coupled to the consumable 150.

FIG. 11B shows the main body 120 of the smoking substitute device 110 without the consumable 150.

FIG. 11C shows the consumable 150 of the smoking substitute device 110 without the main body 120.

The main body 120 and the consumable 150 are configured to be physically coupled together, in this example by pushing the consumable 150 into an aperture in a top end 122 of the main body 120, e.g., with the consumable 150 being retained in the aperture via an interference fit. In other examples, the main body 120 and the consumable could be physically coupled together by screwing one onto the other, through a bayonet fitting, or through a snap engagement mechanism, for example. An optional light 126, e.g., an LED located behind a small translucent cover, is located a bottom end 124 of the main body 120. The light 126 may be configured to illuminate when the smoking substitute device 110 is activated.

The consumable 150 includes a mouthpiece (not shown) at a top end 152 of the consumable 150, as well as one or more air inlets (not shown in FIGS. 11A-11C) so that air can be drawn into the smoking substitute device 110 when a user inhales through the mouthpiece. At a bottom end 154 of the consumable 150, there is located a tank 156 that contains e-liquid. The tank 156 may be a translucent body, for example.

The tank 156 preferably includes a window 158, so that the amount of e-liquid in the tank 156 can be visually assessed. The main body 120 includes a slot 128 so that the window 158 of the consumable 150 can be seen whilst the rest of the tank 156 is obscured from view when the consumable 150 is inserted into the aperture in the top end 122 of the main body 120.

In this present embodiment, the consumable 302 is a "single-use" consumable. That is, upon exhausting the e-liquid in the tank 156, the intention is that the user disposes of the whole consumable 150. In other embodiments, the e-liquid (i.e., aerosol former) may be the only part of the system that is truly "single-use". In such embodiments, the tank 156 may be refillable with e-liquid or the e-liquid may be stored in a non-consumable component of the system. For example, the e-liquid may be stored in a tank located in the device or stored in another component that is itself not single-use (e.g., a refillable tank).

The tank 156 may be referred to as a "clearomizer" if it includes a window 158, or a "cartomizer" if it does not.

FIG. 12A is a schematic view of the main body 120 of the smoking substitute device 110.

FIG. 12B is a schematic view of the consumable 150 of the smoking substitute device 110.

As shown in FIG. 12A, the main body 120 includes a power source 128, a control unit 130, a memory 132, a wireless interface 134, an electrical interface 136, and, optionally, one or more additional components 138.

The power source 128 is preferably a battery, more preferably a rechargeable battery.

The control unit 130 may include a microprocessor, for example.

The memory 132 is preferably includes non-volatile memory.

The wireless interface 134 is preferably configured to communicate wirelessly with the mobile device 2, e.g., via Bluetooth. To this end, the wireless interface 134 could include a Bluetooth™ antenna. Other wireless communication interfaces, e.g., Wi-Fi, are also possible.

The electrical interface 136 of the main body 120 may include one or more electrical contacts. The electrical interface 136 may be located in, and preferably at the bottom of, the aperture in the top end 122 of the main body 120. When the main body 120 is physically coupled to the consumable 150, the electrical interface 136 may be configured to pass electrical power from the power source 128 to (e.g., a heating device of) the consumable 150 when the smoking substitute device 110 is activated, e.g., via the electrical interface 160 of the consumable 150 (discussed below). When the main body 120 is not physically coupled to the consumable 150, the electrical interface may be configured to receive power from the charging station 6.

The additional components 138 of the main body 120 may include the optional light 126 discussed above.

The additional components 138 of the main body 120 may, if the power source 128 is a rechargeable battery, include a charging port configured to receive power from the charging station 6. This may be located at the bottom end 124 of the main body 120. Alternatively, the electrical interface 136 discussed above is configured to act as a charging port configured to receive power from the charging station 6 such that a separate charging port is not required.

The additional components 138 of the main body 120 may, if the power source 128 is a rechargeable battery, include a battery charging control circuit, for controlling the charging of the rechargeable battery. However, a battery charging control circuit could equally be located in the charging station 6 (if present).

The additional components 138 of the main body 120 may include an airflow sensor for detecting airflow in the smoking substitute device 110, e.g., caused by a user inhaling through a mouthpiece 166 (discussed below) of the smoking substitute device 110. The smoking substitute device 110 may be configured to be activated when airflow is detected by the airflow sensor. This optional sensor could alternatively be included in the consumable 150 (though this is less preferred where the consumable 150 is intended to be disposed of after use, as in this example).

The additional components 138 of the main body 120 may include an actuator, e.g., a button. The smoking substitute device 110 may be configured to be activated when the actuator is actuated. This provides an alternative to the airflow sensor noted, as a mechanism for activating the smoking substitute device 110.

The additional components 138 of the main body 120 may include a reader configured to read information associated with the consumable from a machine readable data source included in (e.g., contained in the body of, or attached to) the consumable 150.

The reader may be configured to read information from the machine readable data source wirelessly, e.g., via electromagnetic waves or optically. Thus, for example, the machine readable data source included in the consumable 150 could be an RFID tag (in which case the reader included in the main body 120 may be an RFID reader) or a visual data source such as a barcode (in which case the reader included in the main body may be an optical reader, e.g., a barcode scanner). Various wireless technologies and protocols may be employed to allow the reader to wirelessly read information from a machine readable data source included in or attached to the consumable 150, e.g., NFC, Bluetooth, Wi-Fi, as would be appreciated by a skilled person.

For avoidance of any doubt, the reader (if present) may be configured to read information from the machine readable data source non-wirelessly, e.g., using a direct electrical connection between the main body 120 and consumable 150.

As shown in FIG. 12B, the consumable 150 includes the tank 156, an electrical interface 160, a heating device 162, one or more air inlets 164, a mouthpiece 166, and, optionally, one or more additional components 168.

The electrical interface 160 of the consumable 150 may include one or more electrical contacts. The electrical interface 136 of the main body 120 and an electrical interface 160 of the consumable 150 are preferably configured to contact each other and therefore electrically couple the main body 120 to the consumable 150 when the main body 120 is physically coupled to the consumable 150. In this way, electrical energy (e.g., in the form of an electrical current) is able to be supplied from the power source 128 in the main body 120 to the heating device 162 in the consumable 150.

The heating device 162 is preferably configured to heat e-liquid contained in the tank 156, e.g., using electrical energy supplied from the power source 128. In one example, the heating device 162 may include a heating filament and a wick, wherein a first portion of the wick extends into the tank 156 in order to draw e-liquid out from the tank 156, and wherein the heating filament coils around a second portion of the wick located outside the tank 156. In this example, the heating filament is configured to heat up e-liquid drawn out of the tank 156 by the wick to produce an aerosol vapor.

The one or more air inlets 164 are preferably configured to allow air to be drawn into the smoking substitute device 110, when a user inhales through the mouthpiece 166.

The additional components 168 of the consumable 150 may include a machine readable data source, which may e.g., be contained in the body of, or attached to the consumable 150. The machine readable data source may store information associated with the consumable. The information associated with the consumable may include information concerning the content of the consumable (e.g., e-liquid type, batch number) and/or a unique identifier, for example.

The machine readable data source may be rewritable, e.g., a rewritable RFID chip, or read only, e.g., a visual data source such as a barcode. As indicated above, the additional components 138 of the main body 120 may include a reader configured to read information associated with the consumable from the machine readable data source.

In use, a user activates the smoking substitute device 110, e.g., through actuating an actuator included in the main body 120 or by inhaling through the mouthpiece 166 as described above. Upon activation, the control unit 130 may supply electrical energy from the power source 128 to the heating device 162 (via electrical interfaces 136, 166), which may cause the heating device 162 to heat e-liquid drawn from the tank 156 to produce a vapor which is inhaled by a user through the mouthpiece 166.

Of course, a skilled reader would readily appreciate that the smoking substitute device 110 shown in FIGS. 11A-11C and 12A-12B shows just one example implementation of a smoking substitute device, and that other forms of smoking substitute device could be used as the smoking substitute device 10 of FIG. 10.

By way of example, a HNB smoking substitute device including a main body and a consumable could be used as the smoking substitute device 10 of FIG. 10, instead of the smoking substitute device 110. One such HNB smoking substitute device is the IQOS™ smoking substitute device discussed above.

As another example, an open system vaping device which includes a main body, a refillable tank, and a mouthpiece could be used as the smoking substitute device 10 of FIG. 10, instead of the smoking substitute device 110. One such open system vaping device is the blu PRO™ e-cigarette discussed above.

As another example, an entirely disposable (one use) smoking substitute device could be used as the smoking substitute device 10 of FIG. 10, instead of the smoking substitute device 110.

Embodiments of the present disclosure relate to the configuration and use of a network-enabled smoking substitute device such as that discussed above in relation to FIG. 10. In particular, they relate to monitoring the status of one or more components in the device such as the battery or other power source and controlling operation of the device, based at least in part on the monitored status of the battery or other power source.

In embodiments of the disclosure, as described in more detail below, operation of selected components within the device may be favored over others, in the event that the monitored battery status is determined to be insufficient to run all of (or multiple of) the components simultaneously, at an acceptable level of performance. For example, if insufficient power is available to heat the heating element, and thus the output of the device is affected, i.e., less vapor is being produced because the heating element doesn't get as hot, the heating element may temporarily cease to function, until the battery is recharged to a certain level. However at least certain selected other components of the device will be allowed to continue to function during this time. For example, the wireless interface may be allowed to continue to transmit data to a mobile device, and/or the memory may log non-vape related data and/or transfer data from a buffer to a non-volatile memory, when operation of the heating element has been temporarily suspended.

In embodiments of the disclosure, a plurality of components within a smoking substitute device may be monitored. For example, the component may include any one or more of the power source, heating device, consumable, etc. An application (app) running on a mobile device, to which the smoking substitute device can transmit information, may process the received information to determine status information for the components. The app may be configured to transmit control signals back to the smoking substitute device, based on that received information, and/or to transmit a message to the user suggesting pre-emptive action, such as suggesting that the device needs to be recharged. Alternatively, or additionally, the information obtained from monitoring one or more of the components may be used by the control unit of the smoking substitute device itself in order to control subsequent operations of the device.

FIG. 13 is a flow chart showing steps in a component monitoring method 200 that can be followed according to an embodiment of the disclosure. The method 200 begins with a step 202 of recording component data in a smoking substitute device, such as the device 110 discussed above. For example; the component may be the power source in the main body, for example a battery such as a rechargeable battery. Alternatively, or additionally, the component may be a part of the consumable such as the tank, the heating device or the like. However, embodiments of the present disclosure are concerned predominantly with monitoring the power source such as the battery within the main body of the smoking substitute device, and controlling subsequent operation of the device based on the real-time status of the battery.

The component data may be recorded repeatedly, in a regular or periodic manner or in an ad hoc manner. Preferably, when the component is the battery, the component data is recorded on a regular or periodic basis. The component data may be obtained by measuring or otherwise detecting a property of the component, wherein the property of the component exhibits a change during operation of the smoking substitute device.

The step 202 may thus include detecting, by the smoking substitute device, a plurality of component property measurements. The component data may be generated from the plurality of component property measurements, as a component data log.

When the monitored component is the battery for the device, the recorded data may comprise a battery data log. The battery data log may be a data structure that is indicative of battery status measurements recorded by the smoking substitute device. In one example, the control unit 130 of the main body 120 of the device is arranged to execute a routine that measures a charge related property of the battery and record the result with a timestamp 132. The battery data log may be a collection of this type of battery status measurements.

The charge related property of the battery may be any parameter that allows the battery's remaining charge to be calculated. For example, the charge related property may be the battery's voltage. The routine may be executed periodically, whereby the battery data log is indicative of the change over time of the voltage. In another example, the charge related property may be indicative of drawn charge from the battery, e.g., measured by the amount of current drawn together with the period for which it was drawn. In this example, the routine may be executed for each activation event of the device, e.g., each time the user inhales to draw vapor.

The battery may comprise any suitable battery cell or combination of battery cells. For example, it may be a lithium cell. The monitoring means provided within the smoking substitute device for monitoring a charge related property of the battery may comprise any suitable battery monitoring circuitry. For example, it may include components that are configured to measure voltage and/or current, together with the time at which (or time period over which) the measurement(s) were taken.

The component data may relate to the configuration of the device. For example, it may relate to the type of battery or the power configuration of the device, which may affect the voltage applied to the heating element on each activation event.

It is possible for other components to be monitored by the device, and their data recorded, in a similar manner to the method described herein for monitoring and recording battery data. This can be done in addition to monitoring and recording battery data. However, the monitoring of those other components' data will not be discussed in further detail herein.

As mentioned above, the component data obtained by the monitoring means within the smoking substitute device may be processed internally by the control unit of the device. Additionally, or alternatively, the data may be transmitted to an external processing means such as a remote mobile device, for example the mobile device 2 discussed above. Processing may occur at the mobile device itself and/or at another location in communication with the mobile device, e.g., using a cloud-based application or the like.

Branch 'A' of FIG. 13 shows a step 204*a* according to an optional embodiment in which the monitored battery data is to be transmitted to a mobile device. Branch 'B' of FIG. 13 shows a step 204*b* according to another embodiment, which can be followed in addition to or as an alternative to branch A, wherein the monitored battery data is transmitted to suitable processing means within the smoking substitute device. For example, the processing means may be the control unit 130 as shown in FIG. 12A and may comprise a microprocessor. The processing means may be configured to compare an instantaneous or up-to-date measure of battery component data, such as a battery charge (i.e., remaining power) level, to one or more predetermined levels or thresholds. This will be discussed further below.

According to step 204*a*, comprised within branch A of FIG. 13, a wireless connection is established between the smoking substitute device and a mobile device. The wireless connection may be via any suitable wireless protocol that permits transmission of information. For example, the smoking substitute device may pair with the mobile device using a short range transmission protocol such as Bluetooth™ or the like. The smoking substitute device may be wirelessly connectable to a mobile device via any suitable personal area network.

The method of branch A continues with a step 206*a* of transmitting, from the smoking substitute device to the mobile device over the established wireless connection, the recorded battery component data.

The battery component data that has been obtained by the monitoring means will be stored, at least temporarily, in a memory of the smoking substitute device. In a device which embodies the method of branch A, disclosed herein, some or all of the stored battery component data may be renewed or restarted after it has been successfully transmitted to the mobile device. For example, a portion or partition of the memory in the smoking substitute device that is allocated for the battery component data may be cleared following successful transmission of that data to the mobile device. In this way, information from a certain time period need only be transmitted once to the mobile device. Minimizing data transfer in this way can reduce the load placed on the battery by the wireless communication module, and prolong battery life. Alternatively, the battery component data stored in the memory of the smoking substitute device may be stored for a predetermined period of time and/or the memory may be a buffer or other memory means that is configured to store such data up to a storage capacity limit wherein, when the storage capacity limit has been reached, the oldest stored data is deleted in order to make room for new data.

After its transmission and receipt at the mobile device, the battery component data may be stored locally on the mobile device and/or it may be retransmitted to an application server for subsequent processing. It is to be understood that the present disclosure contemplates processing battery component data either within a control unit of the smoking substitute device and/or at the mobile device and/or at a virtual location, for example in a cloud-based application server. The received battery component data in any of these locations may be consolidated with previously-received battery component data, to generate a more complete data history for the battery.

Regardless of whether branch A or branch B of the method of FIG. 13 has been followed, the next step 208 of the method is to calculate a status for the battery. This can be done by the control unit of the smoking substitute device or by a second controller, external to the smoking substitute device. In this example, this step 208 is embodied as a calculation of a charge status for the battery—i.e., to determine remaining battery power. However, it may be understood that other calculations may also be made that are indicative of other parameters of the battery and/or indicative of the operation of other components within the smoking substitute device. The charge status of the battery can then be used to determine whether and how one or more components within the smoking substitute device should be operated and controlled, as detailed below in relation to FIG. 14.

As regards analysis and use of the battery charge status data; the present inventor(s) have identified that, as the sophistication of smoking substitute devices increases, for example with the devices becoming capable of telemetry and having additional component features, the manner in which the operation of such devices is controlled must also improve. In particular; it has been recognized by the present inventor(s) that the purpose of the battery of a smoking substitute device is no longer merely to provide power to a heating device. Instead, whilst the heating functionality is core to the successful operation of the device, the battery must also provide power to other (auxiliary) components such as the wireless interface (or telemetry means), the control unit, the memory, and, in some devices, additional other (auxiliary) components such as airflow sensors, lights and LED's.

Furthermore, the present inventors have recognized that, when consumers begin using more sophisticated smoking substitute devices, those consumers come to rely on and demand the operation of those devices' additional functional components. For example, a telemetry means within a smoking substitute device may be configured to transmit data to a mobile app that the user finds highly useful—such as the current state of fill of the tank and/or the data read from a consumable, such as the brand, type or flavoring of the current consumable, which the user may wish to remember and refer to for future reference. It can therefore cause user dissatisfaction if the control of at least some of these additional functional components is not properly considered as part of the process for monitoring and controlling operation of the battery. Moreover, it could cause a loss of data, including time-critical data—which could be regarded as a technical malfunction and/or could lead to errors in subsequent operation of the smoking substitute device—if certain components are allowed to lose power abruptly, without sufficient warning.

The present inventors have further recognized that, in certain circumstances, it would be preferable to prioritize continuation of certain additional functional components of a smoking substitute device, at the expense of operating the heating device, if the instantaneous battery charge status did not allow for all the components to be run concurrently in a manner that would provide user-satisfaction and correct technical functioning of the device. That is, it has been recognized that there becomes a point, during the battery discharge cycle (when the battery is losing charge, due to providing power to various components of a smoking substitute device), where the device may not function with sufficient quality for the user. This may be due to less power being available for transfer to the heating element. When this happens, the output of the device is affected, i.e., less vapor is produced because the heating element doesn't get as hot. Such a situation is unsatisfactory for the user, and so he or she may be less likely to want to use the device as a smoking substitute, until the battery has been recharged to a sufficient point as to heat the heating element to a greater extent. However, as mentioned above, there may be other operations such as telemetry and/or data recording or storing, that it would be useful to continue—both from a user satisfaction perspective and to avoid loss of data or other technical errors—at that time.

In view of the above, a method is provided herein for monitoring the battery charge status within a smoking substitute device and initiating a "graceful shutdown" of the device. During graceful shutdown—which is a gradual process, as compared to the abrupt shutdown methods of prior art smoking substitute devices—the device may still appear to be "ON", albeit only in a partially functional capacity.

Referring to FIG. 14; as a first step 510, the relevant processor or control means (which could be the control unit of the smoking substitute device or could be a second control unit, external to the smoking substitute device) receives the battery charge status data, which has been calculated for example according to the method of FIG. 13. As mentioned above, the battery charge status data could, for example, be in the form of a voltage level 'L' or in the form of an amount of current drawn from the battery per unit time. The second step 520 is to compare the battery charge status data L to a predetermined threshold level $L_1$. The numerical value for the predetermined threshold level '$L_1$' is discussed further below. The next step taken in the method will depend on the outcome of the comparison of battery charge status data to $L_1$. If it is determined that the present battery charge status level exceeds $L_1$, then at step 530 it is determined that the smoking substitute device should continue its normal operations. It will be appreciated from the foregoing description that battery charge status data will be determined and received by the control means repeatedly, preferably periodically, and therefore steps 510 to 530 can continue until such time as it is determined at the second step 520 that the present battery charge status falls below level $L_1$.

If it is determined that the present battery charge status is equal to or falls below level $L_1$, then the method proceeds to step 540, in which the user is informed that graceful shutdown of the device is beginning. The form of that message to the user may depend on the location of the controller that is carrying out the method of FIG. 14. For example, if the method is being carried out locally within the control unit of a smoking substitute device, the graceful shutdown message may be conveyed to the user via a written message on an LED screen or may comprise a flashing light and/or a light of a particular color becoming illuminated. If a written message is displayed, the content may comprise any suitable wording such as "battery recharge required" or "heating element disabled" or "graceful shutdown initiated" or any other suitable wording. If the method of FIG. 14 is being carried out by a mobile device, either within the mobile device or, for example, via a virtual processing means such as a cloud-based application running on the mobile device, any suitable message may be conveyed to the user regarding graceful shutdown, using the outputs of the mobile device.

For example, a written message may flash up on the screen of the mobile device to alert the user to the graceful shutdown being initiated. Alternatively, or additionally, the mobile device may make a sound and/or vibrate or send the user an SMS to alert the user to the graceful shutdown. It is also possible for the method of FIG. 14 to be carried out remotely to the smoking substitute device but for the user notification to be issued by the smoking substitute device, as a result of instructions sent to it by a mobile device.

At step 550, which may happen immediately after, or before, step 540 or simultaneously with step 540, the control means temporarily switches off power to the heating element within the smoking substitute device while allowing the battery to continue provide power to at least certain of the other functional components within the device. Dependent on the magnitude of the pre-determined level $L_1$, and/or dependent on the number, the purpose, and/or the power requirements of the other functional components within the smoking substitute device, the control means may operate a hierarchical approach to determining which other functional components are allowed to continue functioning after power has been discontinued to the heating element. For example, the control means may prioritize continued operation of a telemetry means and/or continued operation of a memory, for example to enable data to be written from a buffer to a non volatile memory means, over the continued operation of certain other components such as, for example, a light or a consumable data reader and/or an air flow sensor, given that sensing air flow would not be required if operation of the heating element had been temporarily suspended. The control means may be configured to suspend certain peripheral functions at the same time as suspending operation of the heating element. The control means may also schedule shutdown of certain functional components before others, during the battery discharge cycle down from level $L_1$ to zero charge, in the event that the smoking substitute device was not recharged before the battery charge level reached zero. In such a schedule, the control means may schedule shut down of data-critical functions after shut down of more peripheral functions.

According to an embodiment, the control means will configure operation of the smoking substitute device such that battery charge status data will continue to be determined and received by the control means repeatedly, preferably periodically, even after graceful shutdown has begun. Therefore, according to an embodiment, the method continues with step 560 in which the control means receives updated battery charge status data, after graceful shutdown has been initiated. It is possible that, either independently or on receipt of the message at step 540, or as soon as practicable thereafter, the user will recharge his or her smoking substitute device during the graceful shutdown period. It is therefore possible that, during the graceful shutdown period, the battery will be recharged and, at some point in time, the battery charge level will begin to exceed predetermined threshold level $L_1$. If that happens, at step 570 the normal operations of the smoking substitute device can be resumed and the method will revert back to the initial step 510, in which battery charge status data is received repeatedly, preferably periodically.

According to an embodiment, battery charge status data will continue to be determined and received by the control means only for a limited time after graceful shutdown has begun, or battery charge status may not be monitored at all, after graceful shutdown has begun. In the latter example, therefore, the graceful shutdown cannot be reversed, and the mobile device would inevitably shut down completely, after a period, once the graceful shutdown process has been initiated. Of course, the mobile device could subsequently be restarted in the usual manner, once it had been recharged sufficiently.

As shown at method step 580 in FIG. 14, if, during the graceful shutdown period, the battery level is determined to still be below level $L_1$, the device will continue to operate in graceful shutdown mode, with operation of the heating device suspended but with some other components (i.e., "auxiliary devices") still functioning to perform so-called "background" tasks. This will continue until the battery runs out of charge. When the battery is out of charge, the whole device necessarily will shut down at step 590. The user will then have to recharge the battery in order to resume operation of the device. According to an alternative embodiment, shutdown of the device may happen at a nominal non-zero voltage level, that is below $L_1$. For example, it may be deemed to be less damaging for the battery, if it is not always allowed to run out of power completely. Moreover, there may be a very low voltage level, below which none of the auxiliary devices can usefully operate, such that it may be deemed best for the device to shut down completely, when that very low voltage level is reached.

According to an embodiment, in which the determined battery charge status data (L) comprises a voltage level, the power supply circuitry in the smoking substitute device includes a 3V LDO (Low Drop Out Regulator). A 3V LDO requires a "drop-out" level—i.e., a minimum difference between its input voltage and its output voltage—of 3V (3 volts) in order to maintain voltage regulation and continue to supply current at a specified level. If the drop-out falls below 3V in such an embodiment, the components that the LDO is supplying experience a drop-off in supply voltage. For a heating element, such a drop-off in supply voltage would result in reduced heating, as discussed above. Therefore, in such an embodiment, the "graceful shutdown" level $L_1$ for the battery would be set at just above the dropout voltage level of 3V. For example, it may be set at less than 1V greater than 3V, for example at around 3.1V-3.3V. This enables the smoking substitute device, including the heating element, to continue to operate normally during the battery discharge cycle for as long as possible, until just before the point at which the heating element would begin (in the absence of graceful shutdown) to experience reduced heating. According to this embodiment, when $L_1$ is reached, instead of allowing the heating element to continue operating, with reduced heating capabilities, instead the graceful shutdown routine is initiated and operation of the heating element is temporarily suspended in order to make way for continued operation of some of the other (auxiliary) functional components of the smoking substitute device.

Therefore, according to embodiments of the disclosure described herein, the battery charge status of a smoking substitute device is monitored, and that monitoring data is made use of, in a sophisticated, efficient and user-friendly manner. The method, and devices configured to embody that method, can prioritize the continued function of data-critical components of the device, at least for a limited period of time, over operating the heating element at reduced capacity (which is likely to be unattractive to the user anyway). It can thus reduce the potential for loss of data, which previous, more abrupt shutdown methods would lead to. It can give the user sufficient warning to prompt recharging of the device, before total shutdown (and therefore potential data loss) has to occur. Moreover, it respects and reflects the fact that consumers who use more sophisticated smoking substitute devices come to expect, rely on and demand certain functionalities from their devices—they do not just want heating, especially if instantaneous battery charge level would only allow for impaired/reduced heating.

An example has been given above of the power circuitry including a 3V LDO however it is possible for other levels of LDO to be utilized and/or for other hardware and/or software features to be employed in order to establish be predetermined threshold level at which graceful shutdown should begin.

It may be possible for the predetermined threshold level at which graceful shutdown should begin, to be changeable for a smoking substitute device. For example, the predetermined threshold level may depend on which additional functional components are currently in use and/or on usage history of the device. It may be possible for the user to selectively determine which additional functional components should continue to operate during the graceful shutdown period and/or to determine a hierarchical order in which additional functional components should be shut down (or temporarily suspended) when the battery level of their smoking substitute device is depleted.

The term "graceful shutdown" is illustrative only and should not be construed as limiting on the disclosure as disclosed herein. It will be appreciated from the foregoing detailed description that so-called "graceful shutdown" is a process via which abrupt shutdown of all components of a smoking substitute device, without sufficient user warning, is avoided. Moreover, it is a process via which completion of critical processes is enabled before the smoking substitute device becomes completely inoperable, as a result of the device's battery or other power source having run out of power.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

The following statements, which form part of the description, provide general expressions of the disclosure herein:

C1. A smoking substitute device comprising:

a heating device;

at least one auxiliary device configured to perform a background task;

a battery configured to supply power to the heating device and the auxiliary device; and a control unit, wherein the control unit is configured to obtain data indicative of the state of charge of the battery and, if it is determined that the state of charge meets a predetermined criterion indicating that the state of charge is inadequate to permit normal operation of the heating device, the control unit is configured to prevent the supply of power to the heating device whilst continuing the supply of power to the at least one auxiliary device.

C2. The smoking substitute device of statement 1 further comprising battery monitoring circuitry configured to monitor a voltage of the battery, wherein the battery monitoring circuitry is configured to provide the data indicative of the state of charge of the battery.

C3. The smoking substitute device of statement C1, wherein the predetermined criterion is met when the data indicative of the state of charge of the battery indicates that a magnitude of the state of charge of the battery is equal to or less than a predetermined threshold.

C4. The smoking substitute device of statements C2 or C3, wherein the data indicative of the state of charge of the battery represents a voltage provided by the battery, and wherein the predetermined criterion is met when the magnitude (L) of a voltage provided by battery is equal to or less than a predetermined threshold (L1).

C5. The smoking substitute device of statement C4, wherein the magnitude of the predetermined threshold is set or selected to be greater than a drop out voltage for the heating device.

C6. The smoking substitute device of statement C5, wherein the magnitude of predetermined threshold is set or selected to be less than 1V greater than that of a drop out voltage.

C7. The smoking substitute device of any of statements C1 to C6, wherein the at least one auxiliary device includes any one or more of: the control unit, a memory, a wireless interface, a Bluetooth antenna, a light, an LED and an airflow sensor.

C8. The smoking substitute device of any of statements C1 to C7, wherein the at least one auxiliary device can be configured to record and/or store auxiliary data, during a time period in which the control unit prevents the supply of power to the heating device.

C9. The smoking substitute device of any of statements C1 to C8, wherein the device is configured to provide a notification signal when the predetermined criterion is met.

C10. The smoking substitute device of any of statements C1 to C9 configured to transfer data to a mobile device during a time period in which the control unit prevents the supply of power to the heating device.

C11. A method of controlling an operation of the smoking substitute device of any preceding statement, the method comprising:

obtaining, at the control unit, data indicative of a state of charge of the battery;

determining whether or not the state of charge meets a predetermined criterion, indicating that the state of charge is inadequate to permit normal operation of the heating device; and, if the state of charge meets the predetermined criterion, configuring the control unit to prevent the supply of power to the heating device whilst continuing the supply of power to the at least one auxiliary device.

C12. The method of statement C11, wherein the step of obtaining, at the control unit, data indicative of a state of charge of the battery comprises receiving data indicative of the state of charge of the battery from a second control unit, external to the smoking substitute device.

C13. The method of statement C11 or statement C12, wherein the step of determining whether or not the state of charge meets a predetermined criterion is carried out by a second control unit, external to the smoking substitute device.

C14. The method of statement C11, wherein the step of obtaining, at the control unit, data indicative of a state of charge of the battery includes receiving, at the control unit, a measurement, which has been obtained by one or more components within the smoking substitute device.

C15. The method of statement C14, wherein the step of determining whether or not the state of charge meets a predetermined criterion is carried out by the control unit of the smoking substitute device.

The invention claimed is:

1. A smoking substitute device comprising a body, wherein the body houses a power source, and an auxiliary component, wherein:

the body includes a coupling portion arranged to receive a consumable;

the body is selectively operable in a shipping mode and an active mode;

in the active mode, the power source is configured to supply power to the auxiliary component; and in the shipping mode, the power source is restricted from supplying power to the auxiliary component and the smoking substitute device is configured to prevent or restrict smoking substitute action; and the body is configured to transition from the shipping mode to the active mode upon detection of a transition condition, wherein the transition condition comprises at least two of the following criteria:

a consumable received in the coupling portion;

actuating a button of the smoking substitute device; and connection of a charging interface to the smoking substitute device.

2. The smoking substitute device of claim 1, wherein the coupling portion is configured to electrically couple with the consumable and/or mechanically couple with the consumable.

3. The smoking substitute device of claim 1, wherein the body is configured to monitor an electrical property the coupling portion to detect whether or not a consumable is received in the coupling portion.

4. The smoking substitute device of claim 1, wherein the transition condition comprises:

the consumable received in the coupling portion; and actuating the button of the smoking substitute device.

5. The smoking substitute device of claim 1, wherein, in the shipping mode, a power supply from the power source to the auxiliary component is prevented.

6. The smoking substitute device of claim 1, wherein the body houses an airflow sensor for detecting airflow through the body, wherein the airflow sensor is positioned in an airflow channel extending through the body of the smoking substitute device.

7. The smoking substitute device of claim 1, wherein the body houses an airflow sensor for detecting airflow through the body, wherein the wherein the body is configured to transition from the active mode to the shipping mode if the airflow sensor does not detect a flow of air through the body for a predetermined period of time.

8. The smoking substitute device of claim 1, wherein the active mode includes a first sub-mode, in which power is supplied to the consumable.

9. The smoking substitute device of claim 1, wherein the active mode includes a second sub-mode in which power is supplied to the auxiliary device but not to the consumable.

10. The smoking substitute device of claim 7, wherein the body houses an airflow sensor for detecting airflow through the body and is configured to:

detect whether or not a consumable is received in the coupling portion;

upon detecting that a consumable is received in the coupling portion, transition from the active mode to the shipping mode if the airflow sensor detects no flow of air through the main body after a first predetermined period of time; and upon detecting that a consumable is not received in the coupling portion, transition from the active mode to the shipping mode if the airflow sensor detects no flow of air through the main body after a second predetermined period of time.

11. The smoking substitute device of claim 10, wherein the first predetermined period of time is longer than the second predetermined period of time.

12. A computer-implemented method for controlling a smoking substitute device that comprises a body, wherein the body houses a power source, and an auxiliary component, wherein the method comprises:

configuring the smoking substitute device in a shipping mode, in which the power source is restricted from supplying power to the auxiliary component and the smoking substitute device is configured to prevent or restrict smoking substitute action; and transitioning from the shipping mode to an active mode upon detection of a transition condition, wherein, in the active mode the power source is configured to supply power to the auxiliary component, wherein the transition condition comprises at least two of:

a consumable received in a coupling portion of the body;

actuating a button of the smoking substitute device; and connection of a charging interface to the smoking substitute device.

13. The computer-implemented method of claim 12, wherein the transition condition comprises: a consumable received in a coupling portion of the body; and actuating a button of the smoking substitute device, wherein the method further comprises:

detecting, by a control unit in the body, whether or not a consumable is received in the coupling portion;

detecting whether or not the button of the smoking substitute device has been actuated; and upon detection of the transition condition, issuing, by the control unit, a control instruction that causes the body to transition from the shipping mode to the active mode.

14. A computer-implemented method for controlling a smoking substitute device that comprises a body, wherein the body houses a power source, and an auxiliary component, wherein the method comprises:

configuring the smoking substitute device in an active mode, in which the power source is configured to supply power to the auxiliary component;

detecting, by a control unit in the body, whether or not a consumable is received in a coupling portion of the body;

upon detecting that a consumable is received in the coupling portion, transitioning from the active mode to a shipping mode after a first predetermined period of time; and upon detecting that a consumable is not received in the coupling portion, transitioning from the active mode to the shipping mode after a second predetermined period of time, wherein, in the shipping mode, the power source is restricted from supplying power to the auxiliary component.

15. An apparatus, comprising:

a non-transitory computer-readable medium containing computer-readable instructions which, when executed by a processor, cause the processor to configure a smoking substitute device in a shipping mode in which a power source is restricted from supplying power to an auxiliary component and the smoking substitute device is configured to prevent or restrict smoking substitute action, the smoking substitute device comprising a body, wherein the body houses the power source, and the auxiliary component; and transition from the shipping mode to an active mode upon detection of a transition condition, wherein, in the active mode the power source is configured to supply power to the auxiliary component, wherein the transition condition comprises at least two of:

a consumable received in a coupling portion of the body;

actuating a button of the smoking substitute device; and connection of a charging interface to the smoking substitute device.

* * * * *